US006969092B2

(12) United States Patent
MacWilliams et al.

(10) Patent No.: US 6,969,092 B2
(45) **Date of Patent: *Nov. 29, 2005**

(54) DESKTOP PRINTABLE FILE FOLDER BLANK AND FILING SYSTEM

(75) Inventors: Steve C. MacWilliams, Fullerton, CA (US); John A. Calkins, Hastings, MN (US)

(73) Assignee: Smead Manufacturing Company, Hastings, MN (US)

( * ) Notice: Subject to any disclaimer, the term of this patent is extended or adjusted under 35 U.S.C. 154(b) by 16 days.

This patent is subject to a terminal disclaimer.

(21) Appl. No.: 10/602,014

(22) Filed: Jun. 23, 2003

(65) Prior Publication Data

US 2004/0051296 A1 Mar. 18, 2004

Related U.S. Application Data

(63) Continuation of application No. 09/693,615, filed on Oct. 20, 2000, now Pat. No. 6,581,971, which is a continuation-in-part of application No. 09/235,974, filed on Jan. 22, 1999, now Pat. No. 6,352,286, which is a continuation of application No. 08/418,522, filed on Apr. 7, 1995, now Pat. No. 5,906,397.

(51) Int. Cl.[7] ..... B42F 21/00

(52) U.S. Cl. ..... 283/36; 283/39; 283/41; 283/45; 281/29; 281/31; 281/38; 281/45; 281/51; 40/359; 40/641; 270/58.32; 116/319; 116/327

(58) Field of Search ..... 283/36, 39, 41, 283/45; 116/319, 327; 40/359, 641; 270/58.32; 281/29, 31, 38, 45, 51

(56) References Cited

U.S. PATENT DOCUMENTS

| | | | | | |
|---|---|---|---|---|---|
| 2,052,623 A | | 9/1936 | Harby | | |
| 2,450,558 A | | 10/1948 | Ogren | | |
| 2,539,718 A | | 1/1951 | Balzak | | |
| 3,054,202 A | | 9/1962 | Scholfield | | |
| 3,643,363 A | * | 2/1972 | Biro | | 40/359 |
| 3,805,426 A | * | 4/1974 | Cunningham | | 40/641 |
| 3,937,493 A | * | 2/1976 | Fasbender | | 283/36 |
| 4,204,639 A | * | 5/1980 | Barber et al. | | 235/488 |
| 4,240,848 A | | 12/1980 | Barber | | |
| 4,329,191 A | | 5/1982 | Barber | | |
| 4,523,776 A | | 6/1985 | Barber | | |
| 4,580,815 A | * | 4/1986 | Barber | | 283/81 |
| 4,583,764 A | * | 4/1986 | Steffen | | 281/31 |
| 4,715,621 A | | 12/1987 | Colavito et al. | | |
| 4,905,393 A | | 3/1990 | Laurie | | |
| 5,016,370 A | | 5/1991 | Rhian et al. | | |

(Continued)

FOREIGN PATENT DOCUMENTS

| | | | | |
|---|---|---|---|---|
| CA | 1103716 | | 6/1981 | |
| FR | 308585 | | 12/1952 | |
| FR | 1449885 | | 7/1965 | |
| FR | 1449885 | * | 7/1966 | |
| FR | 2444571 | | 12/1978 | |
| GB | 2299547 A | * | 10/1996 | B42F/21/02 |
| WO | WO 99/22359 | | 5/1999 | |

*Primary Examiner*—Derris H. Banks
*Assistant Examiner*—Mark Henderson
(74) *Attorney, Agent, or Firm*—Altera Law Group, LLC

(57) ABSTRACT

A file folder blank can be folded to form a file folder. The file folder blank is designed for single side printing. The file folder blank can be folded to reveal printed indicia to two directions of a single panel. The printed indicia can be printed by a standard desktop type of printer. The printed indicia can include graphics, location indicator, content indicators, pictures, graphs or the like. In addition, top taps or side tabs are integrally formed with the file folder blank that can be printed with identifying indicia. In some applications, the identifying indicia comprises a repeating set of color bars that can be individualized during printing of the folder blank.

9 Claims, 42 Drawing Sheets

U.S. PATENT DOCUMENTS

| | | | | | |
|---|---|---|---|---|---|
| 5,025,978 | A | | 6/1991 | Pacione | |
| 5,104,250 | A | | 4/1992 | Pacione | |
| 5,174,606 | A | * | 12/1992 | Hure | 281/45 |
| 5,197,764 | A | * | 3/1993 | Hicinbothem et al. | 283/81 |
| 5,284,362 | A | * | 2/1994 | Kachel et al. | 281/45 |
| 5,445,468 | A | | 8/1995 | Pacione | |
| 5,447,334 | A | * | 9/1995 | Hartsock | 281/45 |
| 5,518,273 | A | * | 5/1996 | Olson | 283/36 |
| 5,639,124 | A | * | 6/1997 | Jung | 283/36 |
| 5,906,397 | A | * | 5/1999 | MacWilliams et al. | 283/36 |
| 6,138,900 | A | * | 10/2000 | Zeiler | 229/67.4 |
| 6,193,457 | B1 | | 2/2001 | Pacione | |
| 6,206,425 | B1 | * | 3/2001 | Heyer | 281/29 |
| 6,352,286 | B1 | * | 3/2002 | MacWilliams et al. | 281/29 |
| 6,375,604 | B1 | * | 4/2002 | Verhines | 40/641 |
| 6,460,760 | B1 | * | 10/2002 | Sass | 229/305 |
| 6,581,971 | B1 | * | 6/2003 | MacWilliams | 283/36 |
| 6,666,610 | B1 | * | 12/2003 | Moor et al. | 402/79 |
| 6,764,101 | B2 | * | 7/2004 | MacWilliams et al. | 281/29 |
| 2002/0050711 | A1 | * | 5/2002 | MacWilliams et al. | 283/62 |
| 2002/0147093 | A1 | * | 10/2002 | Cobble | 493/413 |

* cited by examiner

DESKTOP PRINTABLE FILE FOLDER BLANK AND FILING SYSTEM

RELATED APPLICATIONS

This application is a continuation application of U.S. patent application Ser. No. 09/693,615, filed on Oct. 20, 2000, now U.S. Pat. No. 6,581,971 which was a continuation-in-part application of U.S. application Ser. No. 09/235,974, filed on Jan. 22, 1999, which issued as U.S. Pat. No. 6,352,286 on Mar. 5, 2002, which was a continuation of U.S. patent application Ser. No. 08/418,522, filed on Apr. 7, 1995, which issued as U.S. Pat. No. 5,906,397 on May 25, 1999.

BACKGROUND OF THE INVENTION

1. Field of the Invention

The present invention generally relates to the field of document management. More specifically, the present invention relates to an improved document folder blank construction that can be printed by single-sided printers prior to being folded.

2. Related Art

Organizations which require significant amounts of paperwork employ a variety of document filing methods in order to easily access this paperwork. The basic document filing method utilizes folders constructed of heavy paper or cardboard, each of which stores a set of related documents. For example, a medical office might store documents pertaining to an individual patient in a single folder. A bank might store documents pertaining to a specific loan account in a single folder. These folders are maintained side-by-side on a shelf or in a container, such as a file drawer. The folders are typically ordered sequentially on the shelf or in the container according to some convenient scheme, for example alphabetically by last name or numerically by social security number. The folders are labeled according to the chosen sequence for ease of filing, that is the location, retrieval and storage of document folders.

The document management industry has long offered various document folders and methods of labeling these folders to streamline the document filing process. For example, a folder can be pre-printed with identifying categories such as NAME, SUBJECT and FILE NUMBER. Specific identifying information can then be handwritten on the folder according to these categories or an appropriate printed label can be applied. Hand-labeling folders, however, is labor intensive. Further, location of a specific folder requires reading the identifying information on several folders until the desired folder is located.

Color-coded folders are offered to assist the folder filing process. A specific color can be designated to correspond to a particular category of documents. For example, a bank might use yellow folders corresponding to loan documents, blue folders corresponding to savings accounts, etc. Such color coding allows categories of documents to be quickly filed without the need to read and search for specific folder identifying information. This filing system, however, also requires handwritten identification of specific folders. Another drawback to pre-printed and colored folders is the need to maintain an inventory of each unique type of folder. More folder types facilitate filing but increase inventory requirements.

Color-coded labels are offered which can be applied to a folder tab. A tab is the extended portion of the folder used for sight reference when folders are stored in sequence and serves the same purpose as a book spine. The tab is located to be visible when the folder is stored alongside other folders on a shelf or in a container. A drawback to this folder identification scheme, however, is that the application of the color-coded labels is labor-intensive. Also, manually folded and applied labels are prone to misregistration on the folder tab. These drawbacks become more pronounced as the number of folders in this type of filing system increases.

In addition to efficient document filing methods, the document management industry has offered so-called paperless systems that reduce or eliminate the need to handle physical documents. Image capture systems either photograph documents, storing the documents as micrographic images, or scan documents, storing the documents as digital images on a mass storage device such as compact disk, read-only memory (CD-ROM). A collection of stored document images forms an image database equivalent to a document filing system.

As in any database system, efficient image database access requires an indexing method; much like an index in the back of a book allows quick location of information within the book. An image database is often indexed by attaching a "document label" printed with a unique document identifier to the first page of each document. For example, if the document relates to an individual's file, the document identifier may be the individual's social security number (SSN) concatenated with an abbreviation representing the type of document. Specifically, if a loan application (LA) was filed by an individual with the SSN 012-34-5678, the document label attached to the loan application might be printed with the identifier "012345678LA." The database index can then simply reference that document by that identifier. The identifier is typically printed in "machine-recognizable" form, such as bar codes or optical character recognition (OCR) fonts, along with text.

Another use for document labels is for "element verification," i.e. verification that all documents which belong in a folder are present. Without document labels, element verification is often done manually. A manual element verification system might have each document that should be in a folder listed on the folder front panel. Verification would consist of checking-off each document on the list if it is contained in the folder. If document labels are used, a bar code wand interfaced to a computer can be used to scan the label of each document in a folder. A computer software routine would then automatically verify the index values read from the document labels against a computerized list of documents.

For new files, element verification is used to determine when a folder contains a complete set of documents. In the banking industry, for example, element verification might be used to determine if all documents necessary to evaluate a home loan have been received: the application, credit reports, appraisals, etc. For existing files, element verification serves an auditing function, i.e. verification that no documents are lost or misplaced. Using a banking industry example again, element verification might be used to audit the documentation for various home mortgages prior to sale of the mortgages to another financial institution.

A drawback to image capture systems and automated element verification systems is that document preparation is difficult and labor intensive. Separately printed document labels must first be matched to a specific folder and then to the documents in that folder. These two matching processes are time consuming and complicated by the fact that the document and tab labels are typically generated by different printing processes, adding the step of first matching a tab label to a specific folder. A further drawback to image capture systems is that, typically, all documents to be photographed or scanned are first separated from their folders. The documents are then processed in mass with the documents from each folder being separated by single sheets, called "document separators." The document separators have a bar code label with a "null" value not corresponding to any document label bar code values and located at a specific location. The document separators are recognized by the scanning system as indications of the end of the documents associated with one folder and the beginning of the documents associated with another folder. In this manner, the document images from each folder are kept separate. Typically, however, the document separator itself conveys no other information to the scanning system. That is, the scanning system must read the document page following the document separator in order to identify the folder associated with the next documents to be processed. Ultimately, the documents must be manually reunited with their folders, and documents can be inadvertently placed in the wrong folder with potentially catastrophic results. Another drawback is that a complete set of document labels is typically printed for each folder in a file. Many folders, however, might contain only a small subset of documents, wasting the bulk of the pre-printed labels.

SUMMARY OF THE INVENTION

Accordingly, one aspect of the present invention involves a folder blank comprising a first panel and a second panel. The first panel is connected to the second panel and the first and second panels are capable of being folded to form a folder sized to hold documents of the type ordinarily found in a business office. The first panel comprises an elongated tab extending at least partially along one side of the folder blank. The tab comprises a length, a width and an edge surface that extends along the length of the tab. The tab is foldable along a first fold line extending along the length of the tab and extending parallel to the one side of the folder blank, whereby when the tab is folded along the first fold line any identifying indicia which may be printed on the tab on one side of the first fold line can be seen from the front of the folder and any identifying indicia which may be printed on the tab on the other side of the first fold line can be seen from the back of the folder. The second panel includes an elongated portion extending at least partially along the one side of the folder blank. The elongated portion comprises a length, a width and an edge surface that extends along the length of the elongated portion. The elongated portion is foldable along a second fold line extending along the length of the elongated portion and extending parallel to the one side of the folder blank, whereby when the tab is folded along the second fold line the elongated portion reinforces at least a portion of the second panel.

Another aspect of the present invention involves a folder blank comprising a first flap and a second flap. The first flap and the second flap are separated by a first flap fold line. The first flap has a first length and a first width. The second flap has a second length and a second width. The blank also comprises a first tab and a second tab. The first tab is foldable about a first tab fold line and the second tab is foldable about a second tab fold line. The first tab fold line is disposed such that when the first tab is folded about the first tab fold line an indicia which may be printed on the first tab on one side of the first tab fold line can be seen from a front side of the folder and any identifying indicia which may be printed on the first tab on an opposite side of the first tab fold line can be seen from a back side of the folder.

A further aspect of the present invention involves a folder blank comprising a first panel and a second panel connected to the first panel. The first panel and the second panel together forms a folder for holding documents. The first panel includes an elongated tab on one edge. The tab has a length and a width. The tab has a fold line extending along the length of the tab parallel to the one edge of the first panel. The fold line divides the width of the tab into a first portion and a second portion, whereby when the tab is folded along the fold line the first portion is the front side of a completed folder tab and the second portion is the back side of the completed folder tab. The folder further comprising identifying indicia printed on at least a portion of the front side and substantially identical indicia printed on a corresponding portion of the back side of the completed folder tab. The indicia comprises a repeating pattern of a plurality of color bars.

BRIEF DESCRIPTION OF THE DRAWINGS

These and other features, aspects and advantages of the present invention will be described with reference to drawings depicting several preferred arrangements. The arrangements are exemplary in nature and should not be considered limiting upon the scope of the present invention. A description of each of the figures follows.

FIG. 2(*b*) is a perspective view of the front side of the preferred embodiment of FIG. 2(*a*).

FIG. 3(*b*) is a plan view of the improved folder before the folder is assembled.

FIG. 3(*c*) is a front view of a series of improved folders configured for continuous tractor-feed printing.

FIG. 3(*d*) is a front view of a series of improved folders configured for single-sheet feed printing.

FIG. 3(*e*) shows the exploded view of the improved folder of FIG. 3(*a*) with an alternate file identification print pattern.

FIGS. 3(*f*) and 3(*g*) show one way in which the folder of FIG. 3(*e*) may be completed.

FIG. 4(*b*) is a perspective view of the improved folder showing the folder folding step, the tab folding step and the steps for affixing the tabs to the folder side edges, completing assembly of the preferred embodiment of FIG. 2(*a*).

FIG. 4(*c*) is a perspective view of the front side of the preferred embodiment of FIG. 3(*a*) alternatively assembled such that the side edges remain unsealed.

FIG. 4(*d*) is a perspective view of the back side of the preferred embodiment of FIG. 4(*c*).

FIG. 4(*e*) is a perspective view showing alternative folder assembly steps of peeling-off the release liner from the tabs to create the preferred embodiment of FIGS. 4(*c*) and 4(*d*).

FIG. 4(*f*) is a perspective view showing alternative folder assembly steps of folding the folder and folding the tabs onto themselves, completing the alternative assembly of the preferred embodiment of FIGS. 4(*c*) and 4(*d*).

FIG. 5(*b*) shows another preferred monochrome printing scheme for the improved folder using numeral symbols adjacent to white, gray and black backgrounds and bars.

FIG. 5(*c*) shows another preferred monochrome printing scheme for the improved folder using bar codes.

FIG. 8(*b*) is a color-wheel illustrating a color-encoding scheme for translating a colored tab to alphabetic groups.

FIG. 9(*b*) is a perspective view of the back side of this embodiment.

FIG. 9(*c*) is an exploded view of the three layers of this embodiment of the improved folder.

FIG. 9(*d*) is a perspective view of this embodiment with the front and back panels attached along their bottom edges and in a fully opened position for printing.

FIG. 9(*e*) is a detailed view of the attachment point of the front and back panels of this embodiment.

FIG. 9(*f*) is a front view of a series of this embodiment of the improved folder, configured for continuous tractor-feed printing.

FIG. 9(*g*) is a front view of a series of this embodiment of the improved folder configured for single-sheet feed printing.

FIG. 11(*b*) is a perspective view of the embodiment of the improved folder of FIG. 11(*a*) when assembled.

FIG. 12(*b*) is a perspective view of the embodiment of the improved folder of FIG. 12(*a*) when assembled.

FIG. 12(*c*) and FIG. (*d*) are plan views of continuous feed and separated label sheets.

FIG. 13(*b*) is an information flow diagram of the preferred folder printing system.

FIG. 18(*b*) is a perspective view of a number of file folders arranged on a shelf. The multi-color identifying indicia strip of each of the file folders has been individualized. The fifth folder from the left illustrates the appearance of a misfiled file folder.

FIG. 19(*b*) is a plan view of another file folder blank similar to that illustrated in FIG. 19(*a*) but the multi-color identifying indicia strip has been individualized.

DETAILED DESCRIPTION OF THE PREFERRED ARRANGEMENTS OF THE PRESENT INVENTION

Figure 1:
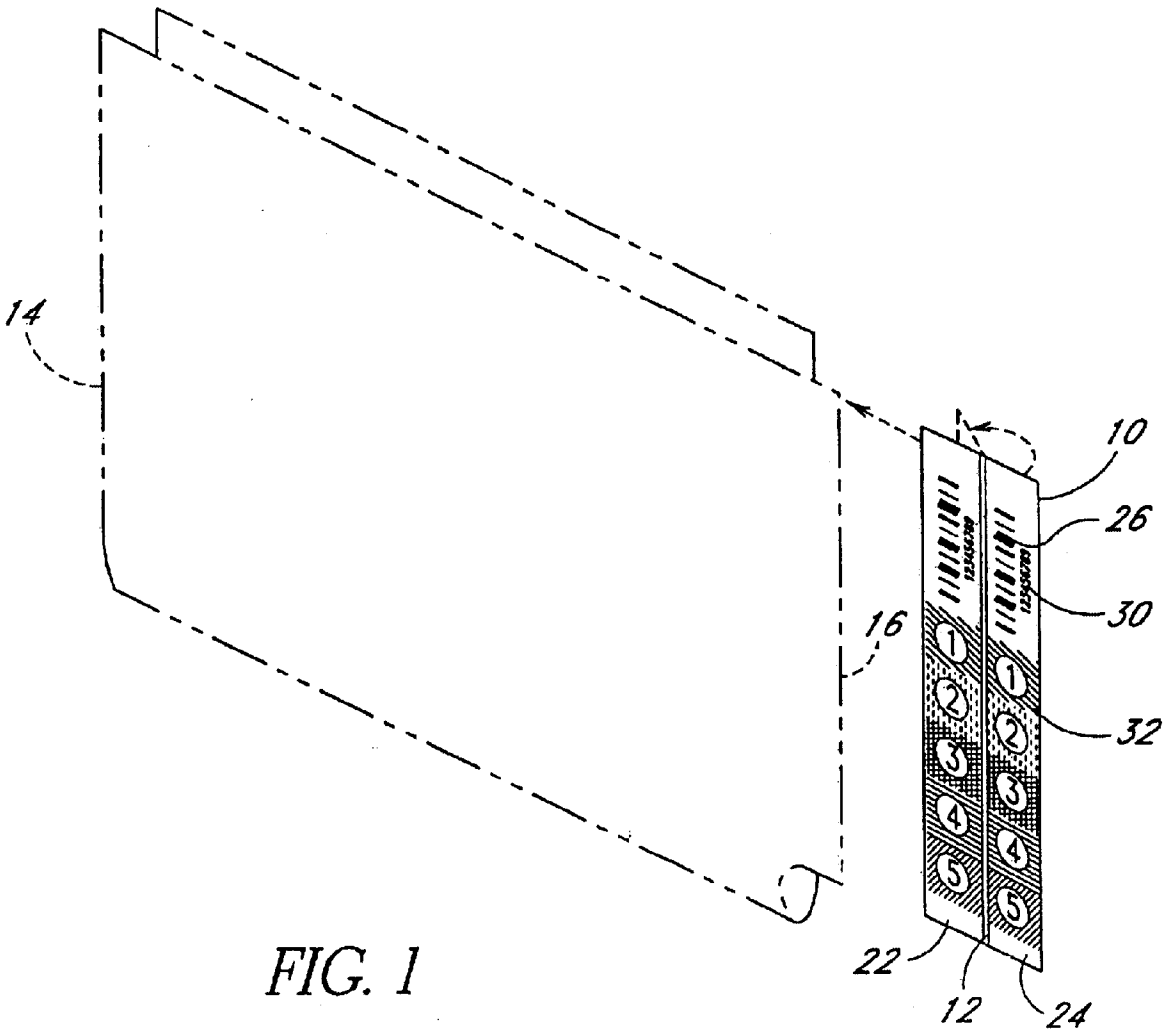
FIG. 1 is a perspective view of a conventional folder label which must be manually folded and applied to the tab end of a conventional folder.

As shown in FIG. 1, a conventional label 10 can be folded at its mid-point 12 and manually applied to a conventional folder 14 on the folder tab 16. The label is adhesive-backed so that it adheres to the tab. The label is printed with indicia which serve to identify a specific folder. Duplicative indicia are printed on the label front portion 22 and the label back portion 24 to be readily seen from either side of the folder. The typical folder identification scheme employed on these labels utilizes a combination of machine-recognizable indicia, text and color blocks. The color blocks provide visual cues for quickly identifying folder groups and possibly specific folders within a group. For example, FIG. 1 shows bar code 26 and text 30 identifying this folder as "123456789." Unique color blocks 32 associated with each numeral of the first five folder digits are also printed on the label in this example. For example "1" is green, "2" is violet, "3" is yellow, "4" is blue and "5" is brown. Thus, this folder can be readily identified with the folder group "12345xxxx."

Figure 2B:
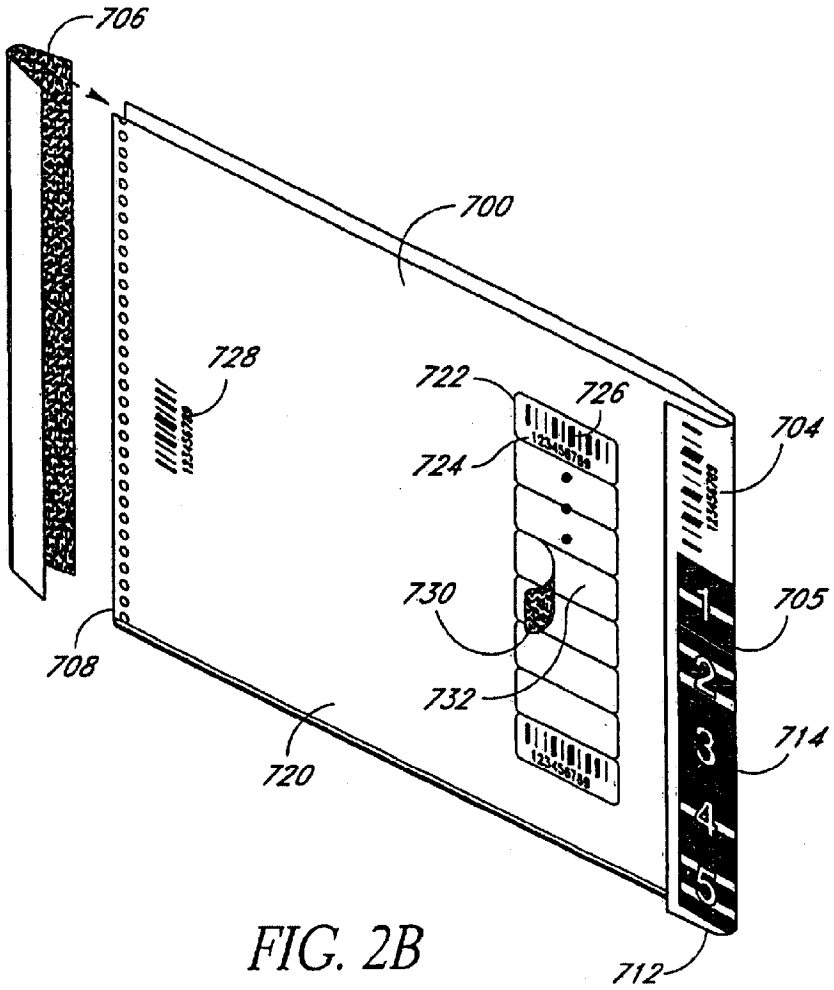
FIG. 2(*a*) is a perspective view of the back side of a preferred embodiment of the improved folder according to certain features, aspects and advantages of the present invention.
Figure 2A:
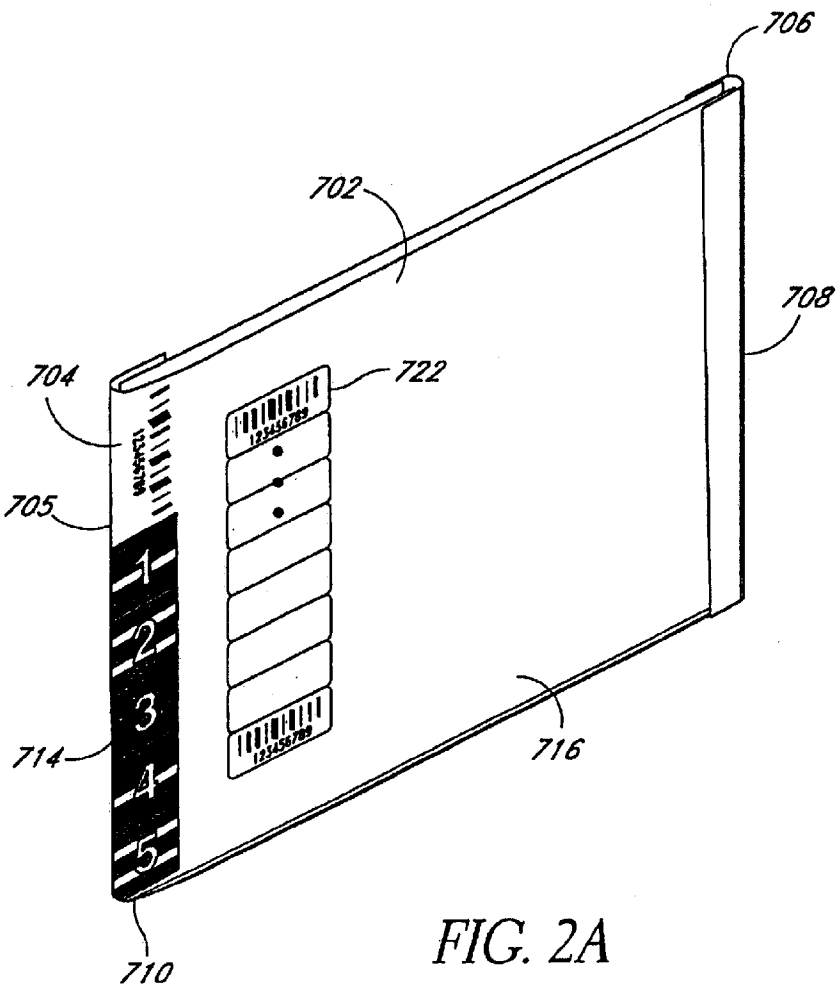
Figure 3A:
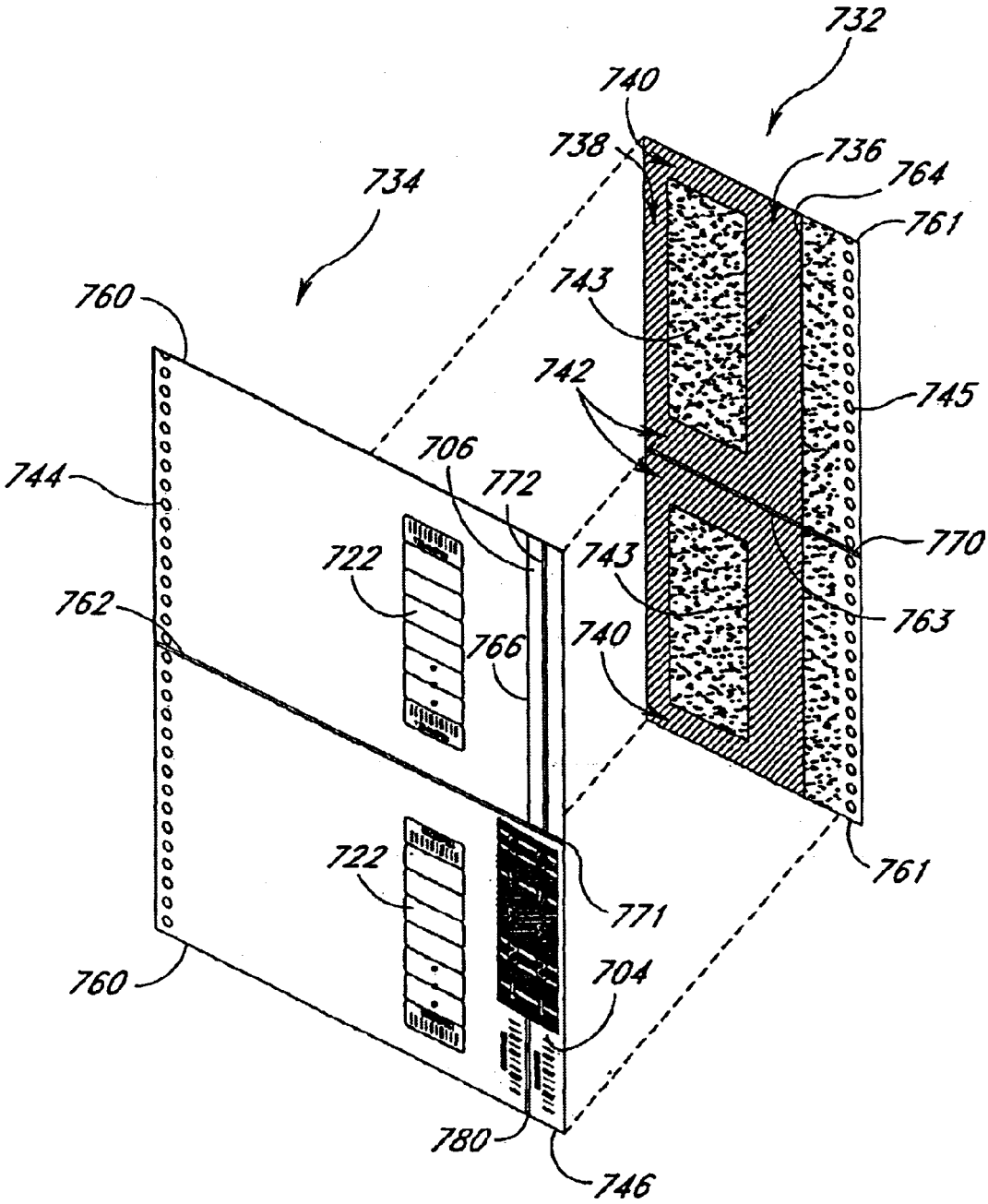
FIG. 3(*a*) is an exploded view of the label stock and release liner layers of the improved folder.
Figure 3B:
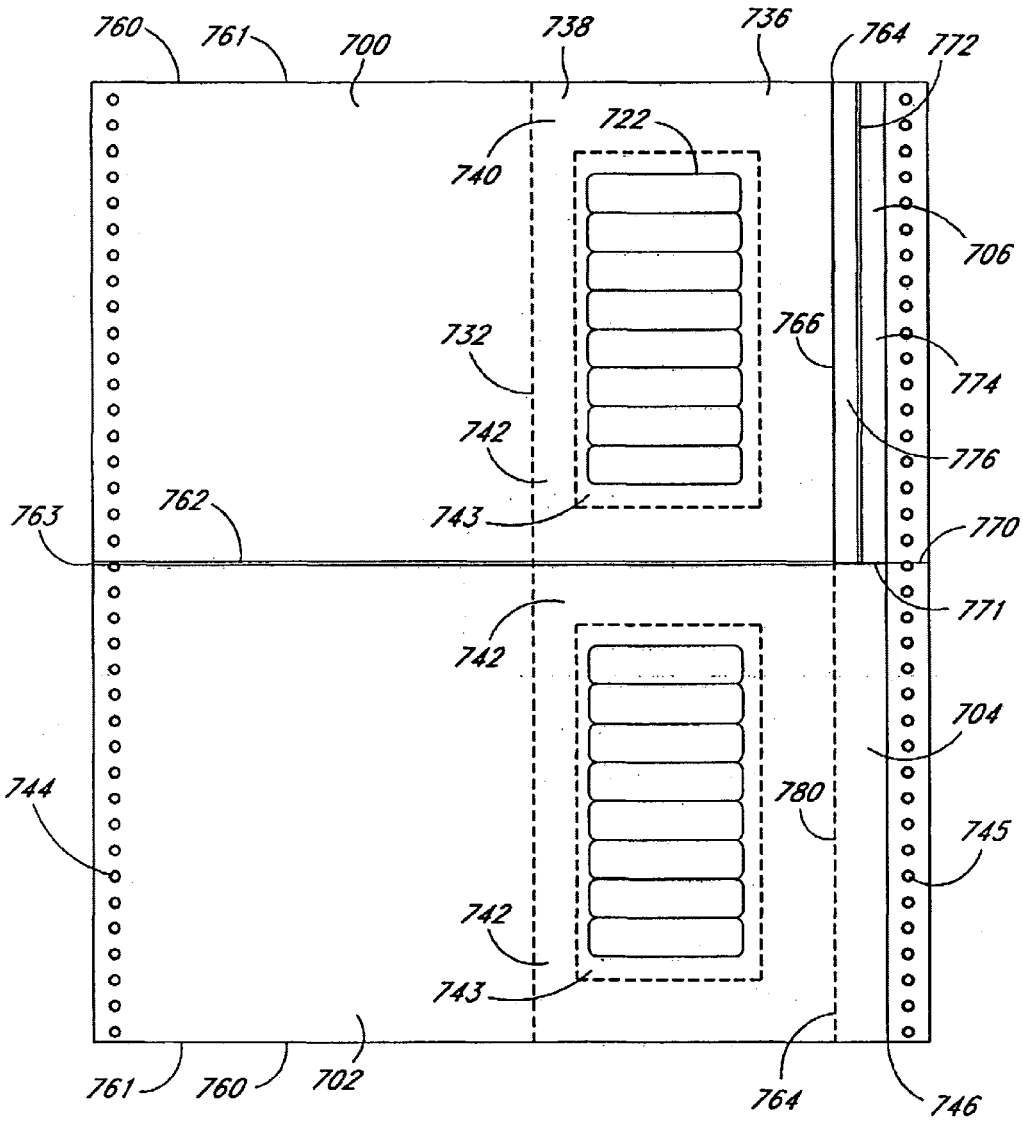
Figure 3C:
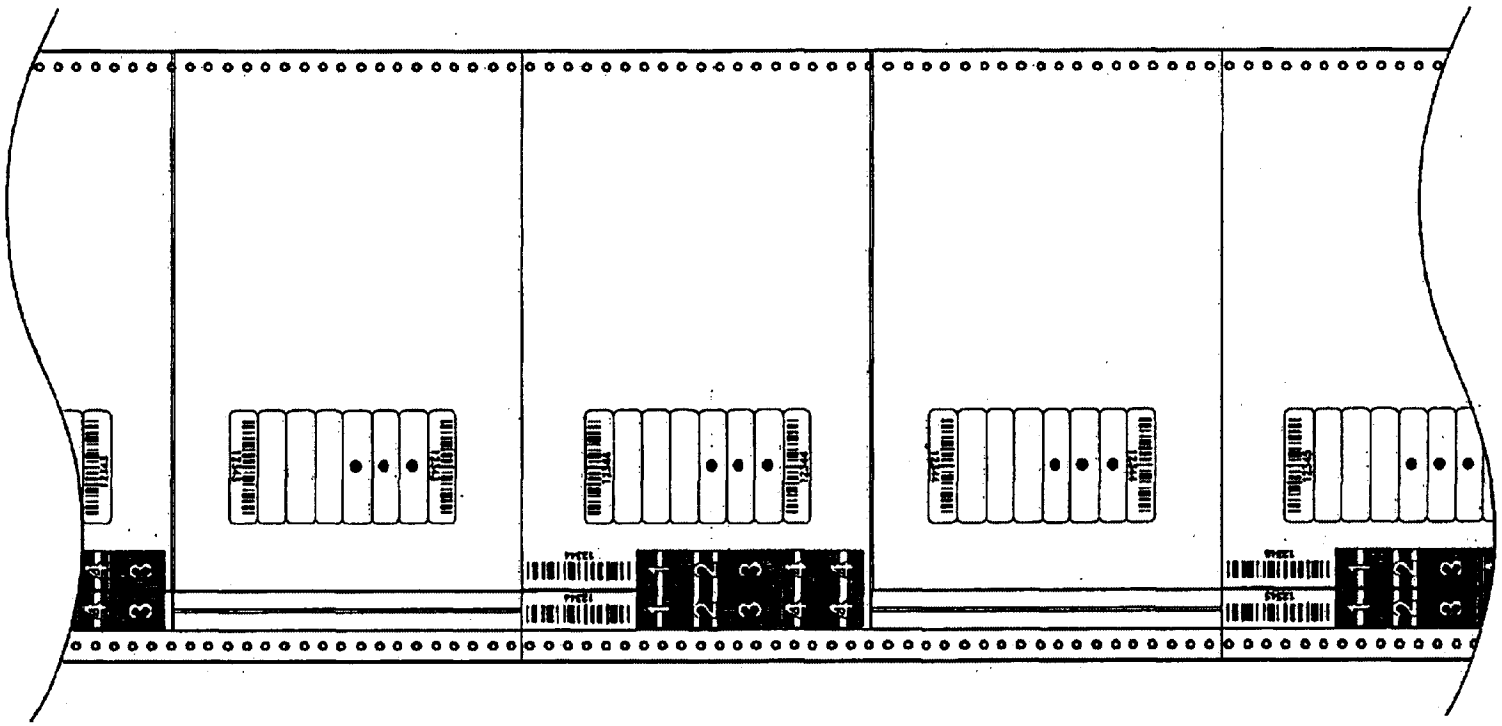
Figure 3D:
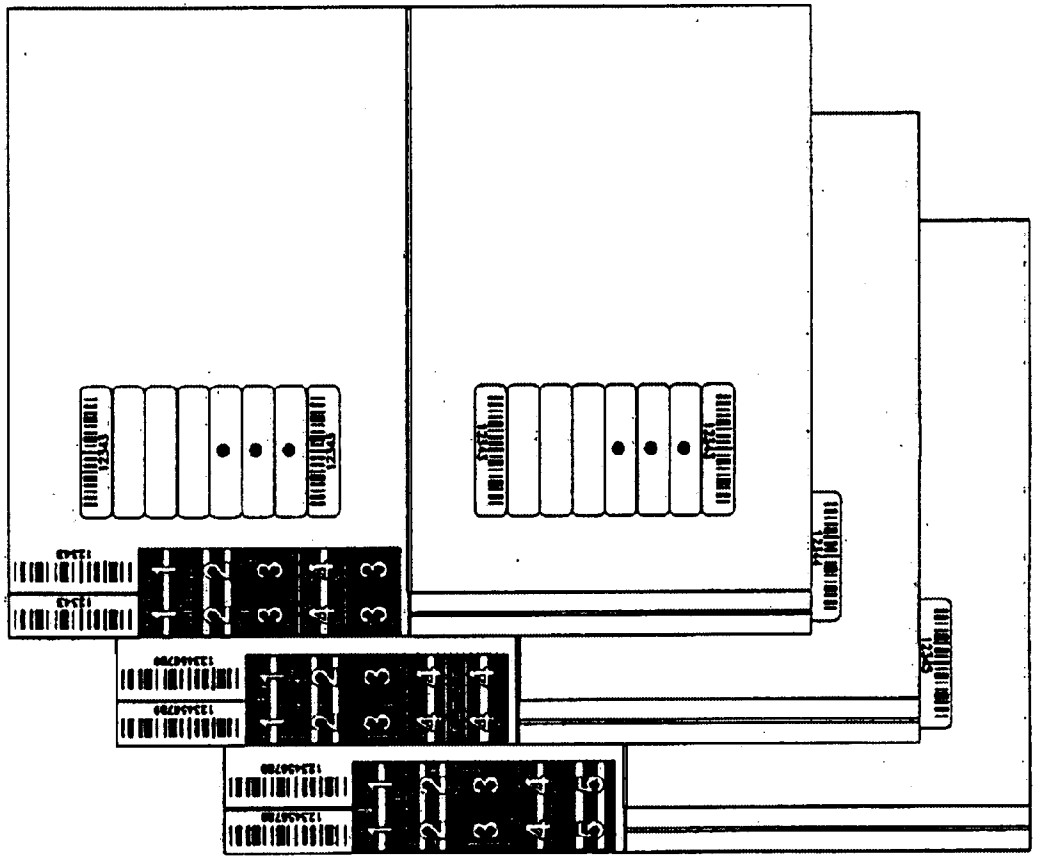
Figure 3E:
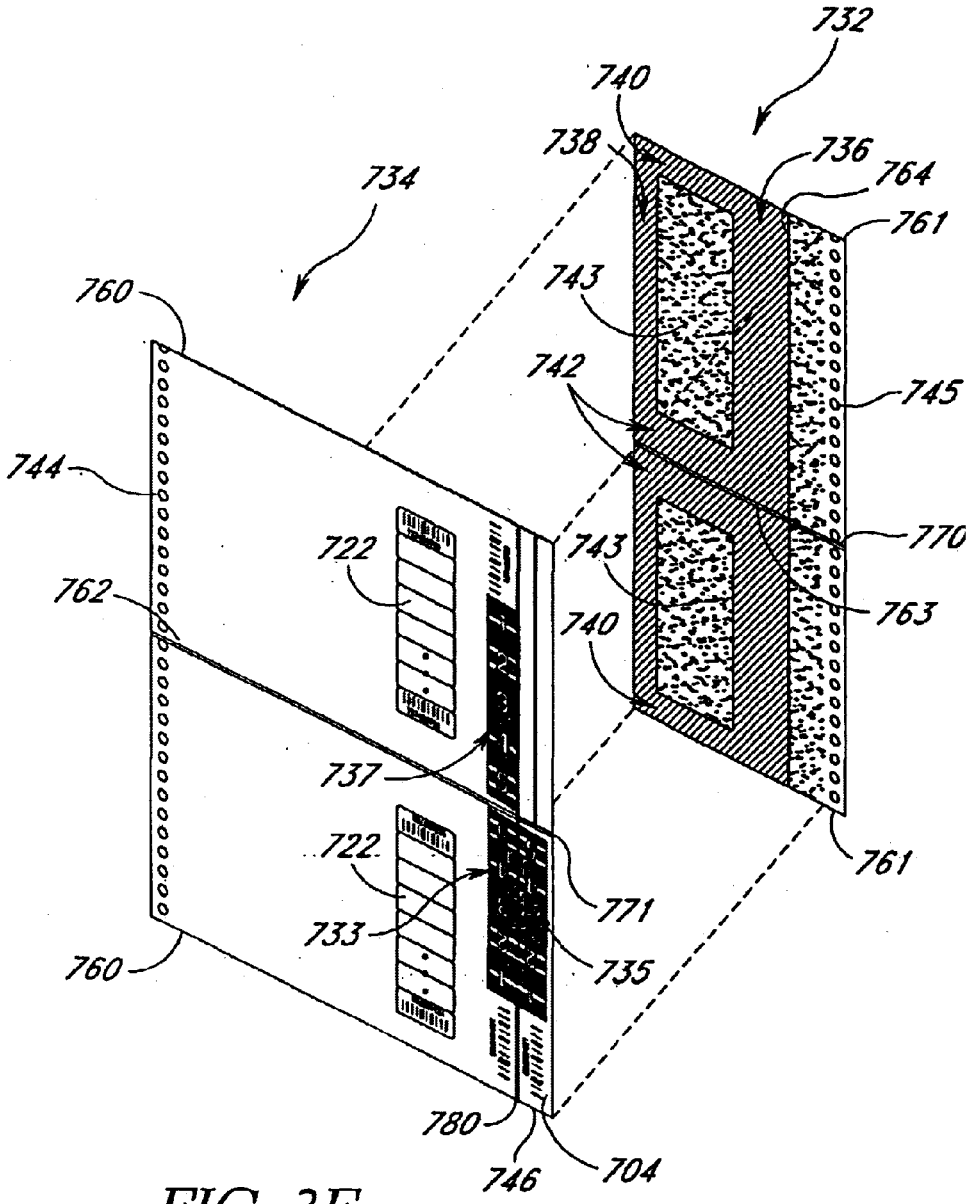
Figure 3G:
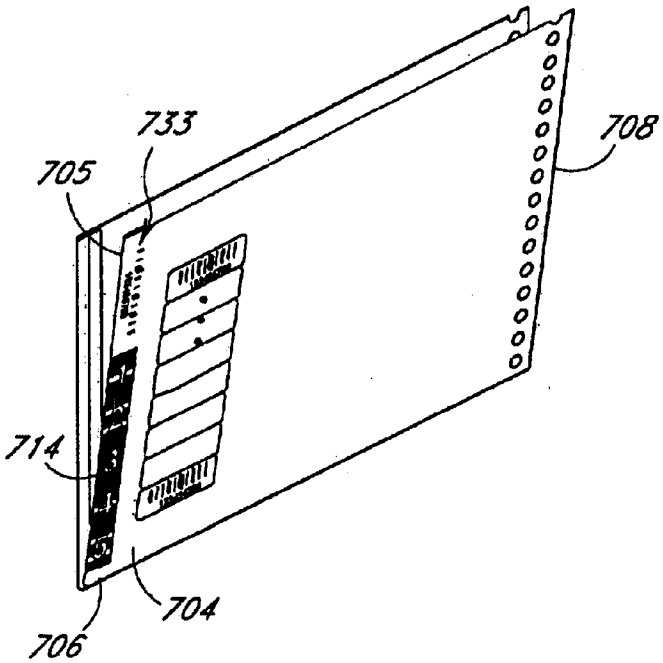
Figure 3F:
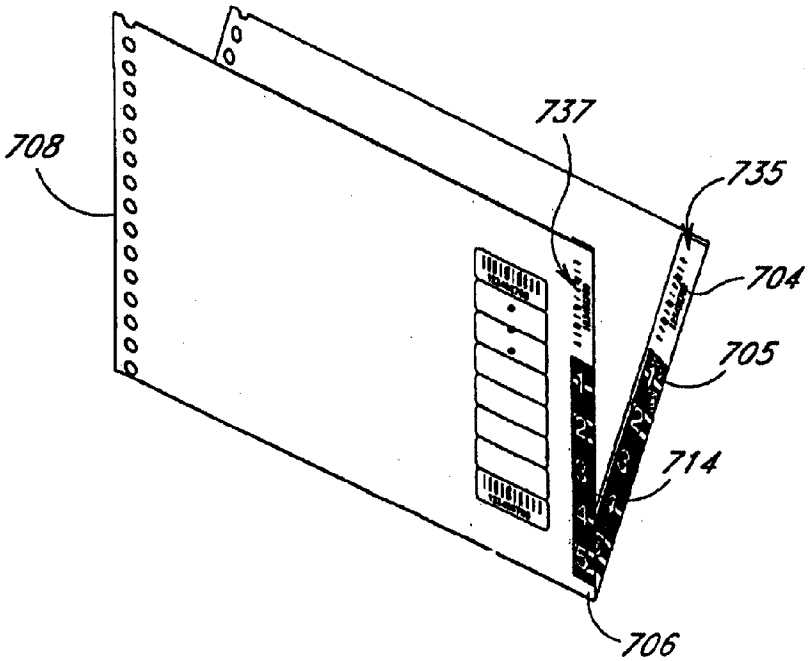
Figure 4B:
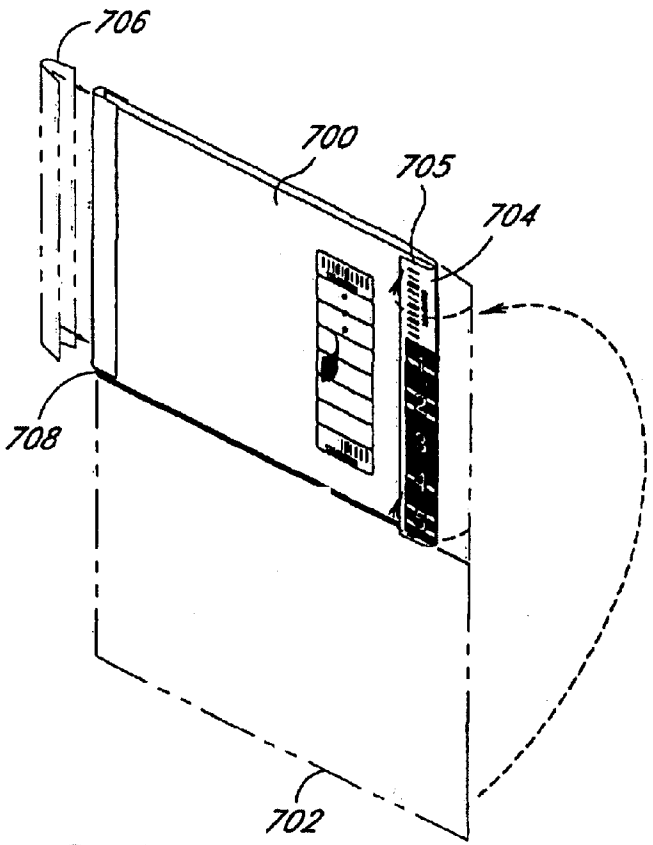
FIG. 4(*a*) is a perspective view of the improved folder showing the perforation tearing and tab removal steps and the steps for peeling-off the release liner from the tabs to create the preferred embodiment of FIG. 2(*a*).
Figure 4A:
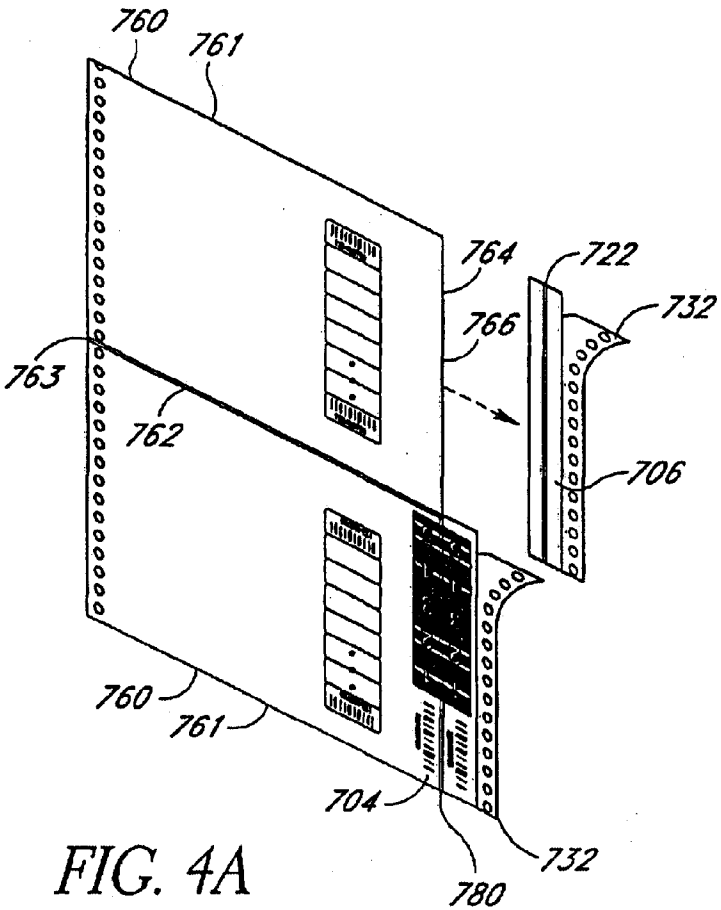
Figure 4D:
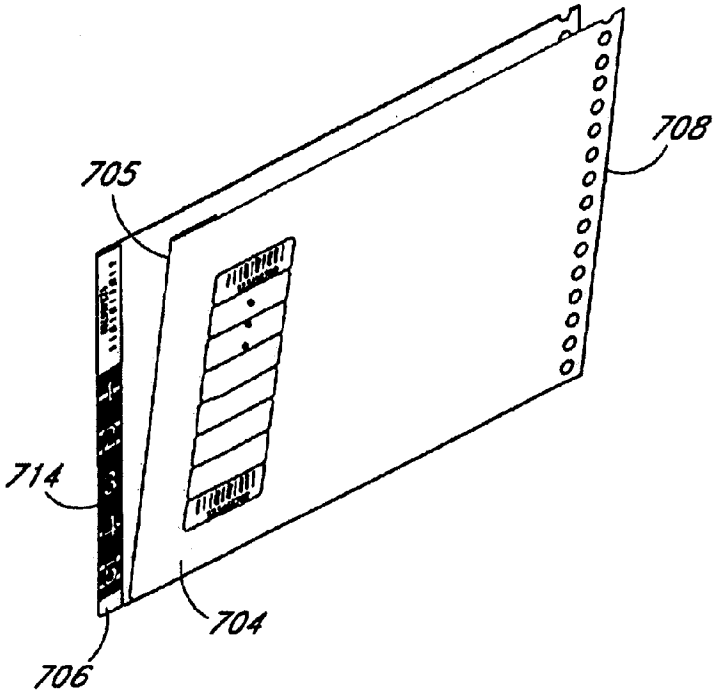
Figure 4C:
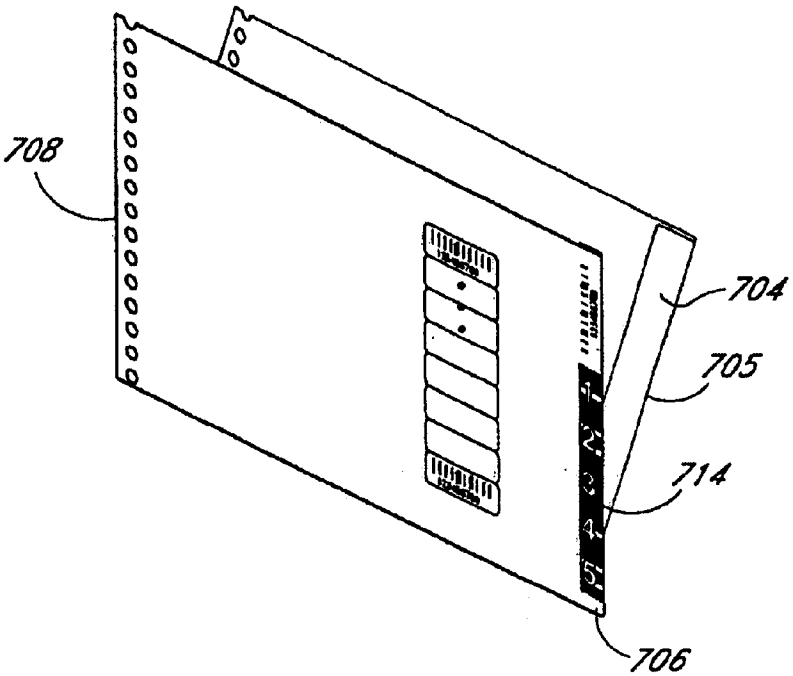
Figure 4F:
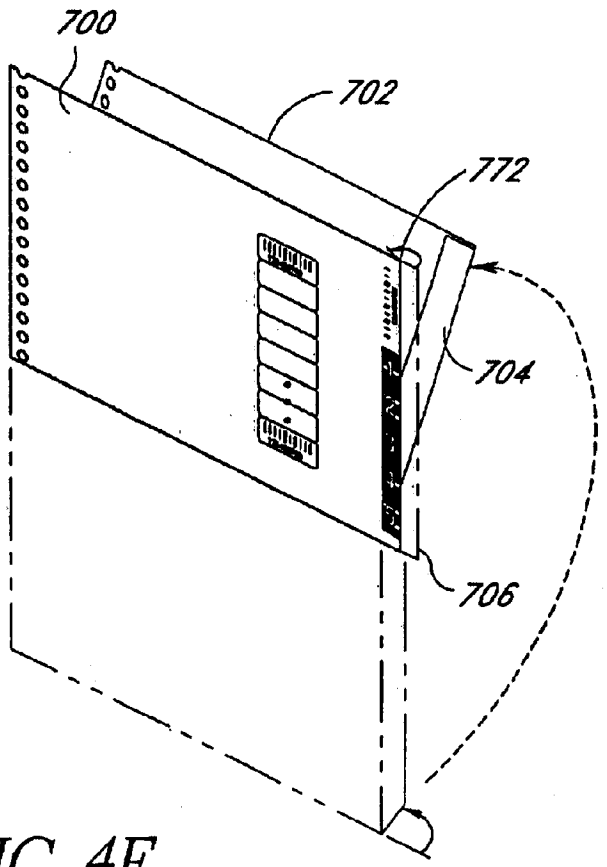
Figure 4E:
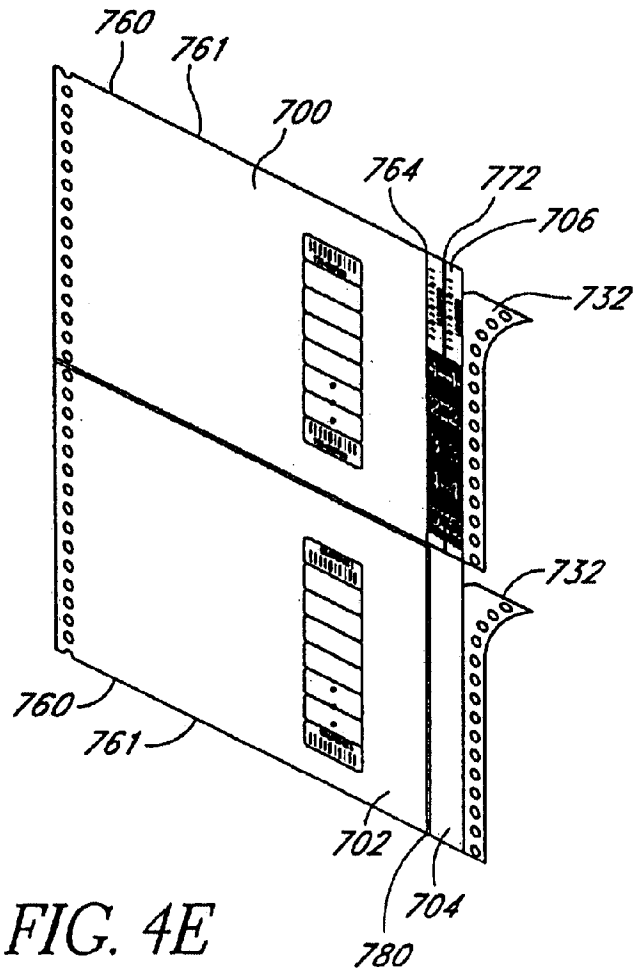

As shown in FIGS. 2(*a*) and (*b*), a preferred embodiment of the improved folder of the present invention has a front panel 700, a back panel 702 and an integrated tab 704 which seals one side 705 of the folder. The folder also has a removable tab 706, which seals the other side 708 of the folder. The integrated tab 704 is an extended portion of the back panel 702. The folder's side and bottom edges form a pocket in which documents can be held awaiting image scanning or stored post image scanning. Sealing the folder along three edges in this manner advantageously provides increased stability to the folder. In the alternative, one side edge 708 of the folder can also remain unsealed, allowing documents to be inserted into the folder from either the side or the top.

During folder assembly, the integrated tab 704 is folded over a folder edge 705 and affixed to the front panel 700 to seal that side edge 705 of the folder. The integrated tab 704 has a back portion 710 and a front portion 712 where duplicative tab indicia 714 are printed. Indicia on the back tab portion 710 are visible from the back side 716 of the assembled folder and indicia on the front tab portion 712 are visible from the front side 720 of the folder. Thus, this integrated folder tab 704 performs the same role as the manually folded and applied conventional label 10 shown in FIG. 1. Because the tab of the improved folder is an integral part of the folder, however, the labor intensive and error prone task of manually labeling a conventional folder tab is eliminated. The task of matching separately printed labels to folders is also eliminated. Letter-sized folders, (which contain 8½"×11" documents) are 9"×12¼" when assembled. Legal-sized folders, (which contain 8½"×14" documents) are 9"×14⅞" when assembled.

Integrated document labels 722 on the front panel 700 and back panel 702 are printed with text 724 and machine-recognizable indicia 726, such as bar codes or OCR fonts. A document separator value 728 is also printed on the front panel 700. The labels have an adhesive backing 730 and can be peeled from a release liner 732 and affixed to folder documents, allowing the documents to be readily identified by a bar code collection device, an image scanner or an individual. The document separator value 728 allows the folder itself to be recognized during document scanning as the item which separates the documents stored in that folder from the documents stored in other folders. The document separator value is advantageously represented by a bar code printed at a specific location on a folder panel. The document separator value can be a null value that does not correspond to any folder or document identifier, for example alternating 1's and 0's. Alternatively, the folder identifier or similar identifier can advantageously be used as the document separator value, thereby imparting information to the scanning system regarding the next document set to be scanned prior to scanning the first document of that set. Thus, in this embodiment, each folder would have a different document separator value. The specific location of the document separator value is known to the scanning equipment and during the scanning process the equipment will look for the separator value at that location. The document scanning process is described in detail below. The integrated tab 704, document labels 722, document separator value 728 and other portions of the panels are printed at the same time and by the same printing process.

The document labels 722 also provide a built-in element verification method. Because only those document labels which are needed for a particular folder are printed, any remaining labels on a panel provide an instant visual indication of which documents have yet to be placed into, or matched to, the folder. Further, the panel area adjacent each document label can be printed with the document label indicia, providing a convenient list of documents placed in the folder. This list can be visually-read or machine-read with a scanner or a bar code wand for auditing purposes. A further advantage of integrated document labels is that the process of matching separately printed document labels with the folder containing the document is eliminated.

FIG. 3(*a*) shows the construction of the preferred embodiment of FIG. 2. The folder is constructed from release liner material 732 attached to paper or card stock (hereinafter "label stock") 734 with pressure-sensitive adhesive, in the manner described in U.S. Pat. No. 5,129,682 and No. 5,271,787. The label stock 734 currently ranges from 7.5 mil, 75 pound Hi-Bulk paper to 9.5 mil, 125 pound Tag paper. This stock is thick enough to provide support for the folder, but thin enough to be accepted by standard printers and scanners. The release liner is formed by coating a web ply with a release material, such as silicon. A coat of pressure sensitive adhesive is then applied to the web and the twice-coated web, which is the release liner 732, is then applied to the label stock 734. The combined label stock 734 and release liner 732 is processed as a continuous roll of folder material to create a series of interconnected folders as shown in FIG. 3(*c*). The silicon coating is applied to the web in a pattern which omits the release coating from longitudinal sections 736, 738 (i.e. sections parallel to the length of the roll of folder material) and transverse sections 740, 742 (i.e. sections perpendicular to the length of the roll of folder material). These sections form a perimeter of "frozen liner" 743 which does not release from the label stock. The label stock 734 is then die cut within the frozen liner perimeter 743 to create releasable integrated document labels 722. Perforations are made in the label stock 760, 766 and liner 761, 764 to create tear lines to separate individual folders from the continuous roll of folder material and to allow separation of the removable tab 706 from each individual folder. Additional perforations are made in the label stock 762, 772, 780 and liner 763 to create fold lines for the integrated tab 704, removable tab 706 and for the folder. These perforations are discussed in more detail below with respect to FIG. 3(*b*). Also, tractor-feed holes 744, 745 are punched at the sides of the roll of folder material. The tractor-feed holes allow the folder material to be continuously feed into a high-speed printer. After printing, the folders are assembled by being separated, folded and sealed as described below. Alternatively, the folders can be constructed with no tractor-feed holes and processed as single-sheets for use with page fed printers, as illustrated in FIG. 3(*d*).

FIGS. 3(*e*), (*g*) and (*f*) show an alternative preferred embodiment of the print pattern used for the file identification symbology. As can be seen in FIGS. 3(*e*), (*g*) and (*f*), the pattern on the right-hand side includes first and second identical file identification symbology sets 733, 735 which are substantially the same so that the file identification can be seen on both sides of the tab when the tab is folded over. A third substantially identical file identification symbology set 737 is advantageously placed on the right-hand side of the front panel, spaced in from the edge so that it is directly above the first set. This permits easy viewing of the file identification set from both sides of the folder when the completed folder is made with an open right-hand side as shown in FIGS. 3(*g*) and (*f*). It is contemplated that this concept could be advantageously used on any of the edges of the folder. Note that where the alphanumerics are not incorporated into the coded pattern (see FIG. 5 for example), the alphanumerics may be on different sides of the patterns in each substantially identical symbology set as may be desired from an aesthetic point of view.

FIG. 3(*b*) shows the detailed construction of the preferred embodiment of FIG. 2 before it is assembled, with the folder front panel 700 and back panel 702 spread apart. The release liner 732 is advantageously 6¼" wide and extends the entire length of the folder. The release liner 732 extends beyond the edge of the label stock 746 on the folder right-side by ⅜", that ⅜" portion containing tractor-feed holes 745. The frozen liner perimeter 743 on each folder panel is made up of a ½" longitudinal section 738, a 1⅝" longitudinal section 736, a 1½" transverse section 742 and a 1 5/16" transverse section 740. Eleven 9/16"×3" labels 722 are die-cut within this perimeter, creating 22 total labels for each folder, 11 on the front panel 700 and 11 on the back panel 702.

Three types of perforations are created in the label stock and the liner: a perforation known in the art as an "easy" perforation which can easily be torn; a perforation known in the art as a "fold" perforation which is a very crude perforation that does not tear easily but allows the material to be easily folded; and a "slit," which completely separates the material on either side of the slit.

A line transverse easy perforation 761 and a label stock transverse easy perforation 760 are made at the boundaries separating each folder, allowing individual folders to be separated from the continuous roll of folder material. A liner transverse fold perforation 763 and a label stock transverse fold perforation 762 are made in the middle of the folder material, allowing the folder to be folded in half to create a front and a back panel.

Several perforations create a removable tab on each folder. A liner longitudinal easy perforation 764 is made in the entire 18" length of the liner 1⅛" from the liner right edge. A label stock longitudinal easy perforation 766 is also made in the top 9" of the label stock in the corresponding location as the liner longitudinal easy perforation 764. In the middle of the folder, a 1⅛" liner transverse slit 770 is made extending from the liner longitudinal liner easy perforation 764 to the edge of the liner. A ¾" label stock transverse slit 771 is made extending from the label stock longitudinal easy perforation 766 to the label stock edge 746. These perforations allow the removable tab 706, which is the top, right ¾"×9" folder section, to be completely removed. A 9" longitudinal fold perforation 772 is made in the label stock ½" from the label stock edge 746, allowing the removable tab 706 to be folded lengthwise. Because the removable tab 706 is ¾" wide, this longitudinal fold perforation 772 creates a ½" wide tab portion 774 and a ¼" wide tab portion 776. This asymmetry allows the ½" wide tab portion 774 to reinforce the label stock longitudinal easy perforation 766 when the folder is alternatively assembled with the removable tab folded onto itself, as described below in conjunction with FIGS. 4(*c*)–(*f*).

Other perforations create an integrated tab 704, which is the bottom, right 1½"×9" folder section. A longitudinal fold perforation 780 is made in the bottom 9" of the label stock corresponding to the bottom 9" of the liner longitudinal easy perforation 764 described above. The transverse slit 771 described above separates the integrated tab 704 from the removable tab 706. Once the liner is removed from the back of the integrated tab 704, it can be folded at the fold perforation 780.

FIGS. 4(*a*) and 4(*b*) show the initial steps for assembling the preferred embodiment of the improved folder of FIG. 2. In step 1, a folder is separated from adjacent folders by tearing the co-located label stock transverse easy perforation 760 and liner transverse easy perforation 761 at the folder boundaries. In step 2, the removable tab 706 is separated from the folder by tearing the co-located label longitudinal easy perforation 766 and liner longitudinal easy perforation 764 from the top 9" of the unassembled folder form to the transverse slit 770. The separated removable tab 706 is then set aside for step 6. For step 3, the folder is folded in half at the co-located label stock transverse fold perforation 762 and liner transverse fold perforation 763 in the middle of the folder. In step 4, the release liner 732 is peeled from the integrated tab 704, exposing the adhesive on the back of the integrated tab label stock. In step 5, the integrated tab 704 is folded from the back panel 702 to the front panel 700 along the label stock longitudinal fold perforation 780, sealing the right edge 705 of the folder. For step 6, the release liner 732 is peeled from the removable tab 706 separated and set aside in step 2, exposing adhesive on the back of the removable tab label stock. In step 7, the removable tab 706 is folded at the label stock longitudinal fold perforation 722. Finally, in step 8, the removable tab 706 is affixed to the front panel 700 and back panel 702, sealing the left edge 708 of the folder. At this point, the folder is completely assembled.

FIGS. 4(*c*) and 4(*d*) show the preferred embodiment of the improved folder of FIG. 3 alternatively assembled, as compared with FIG. 2, such that the folder sides 705, 708 are unsealed, the integrated tab 704 is folded out-of-sight to the inside of the folder, and the removable tab 706 is not removed but folded onto itself to form a protruding folder side tab. If the folder is assembled in this fashion, the tab indicia 714 are printed on the removable tab 706 and not the integrated tab 704.

Referring to FIGS. 4(*e*) and 4(*f*), the improved folder can alternatively be assembled in five steps. In step 1, the folder is separated from adjacent folders by tearing the co-located label stock transverse easy perforation 760 and liner transverse easy perforation 761 at the folder boundaries. In step 2, the liner 732 is peeled-off the removable tab 706 to expose the adhesive on the back of the removable tab label stock. In step 3, the removable tab 706 is folded onto itself along the label stock longitudinal fold perforation 772, creating a protruding label. Because of the position of this fold perforation on the removable tab, when the tab is folded onto itself, ¼" of the tab overlaps the label stock longitudinal easy perforation 764. This reinforces that easy perforation, preventing the removable tab 706 from tearing off the folder. This leaves a ¼" width print area on the removable tab for tab indicia. In step 4, the liner 732 is peeled-off the integrated tab 704 to expose the adhesive on the back of the integrated tab label stock. Finally, in step 5, the integrated tab 704 is folded onto the inside of the back panel along the label stock longitudinal fold perforation 780.

Figure 5A:
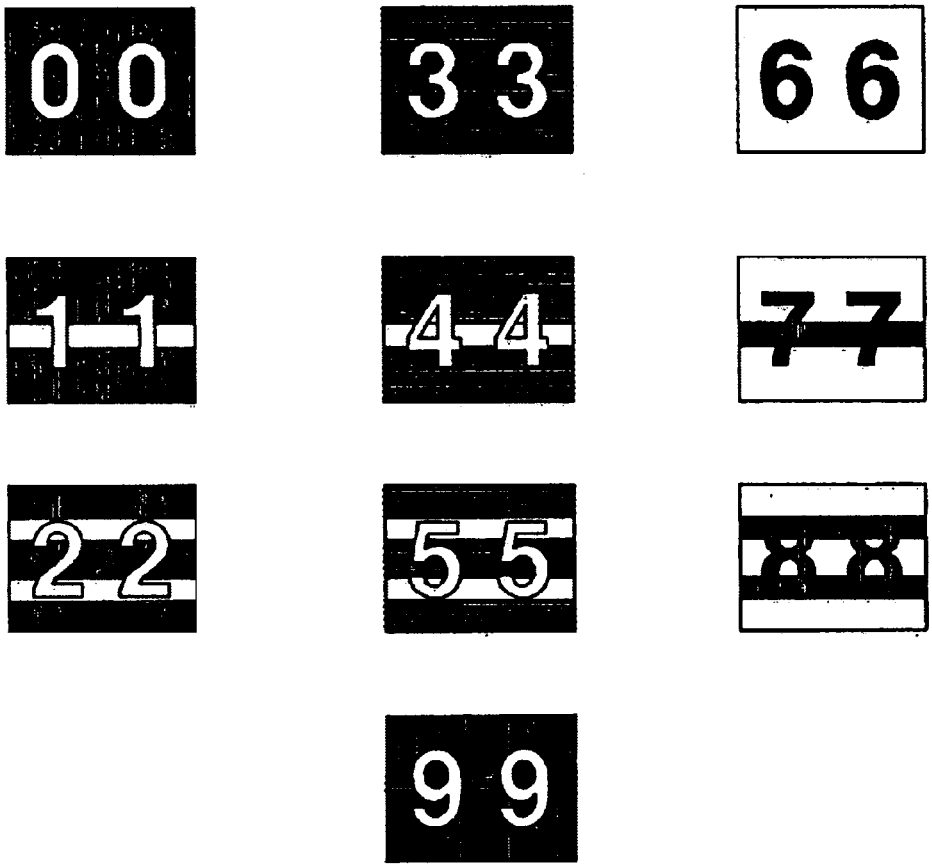
FIG. 5(*a*) shows a preferred monochrome printing scheme for the improved folder using white and black numeral symbols superimposed on white, gray and black backgrounds and bars.
Figure 5B:
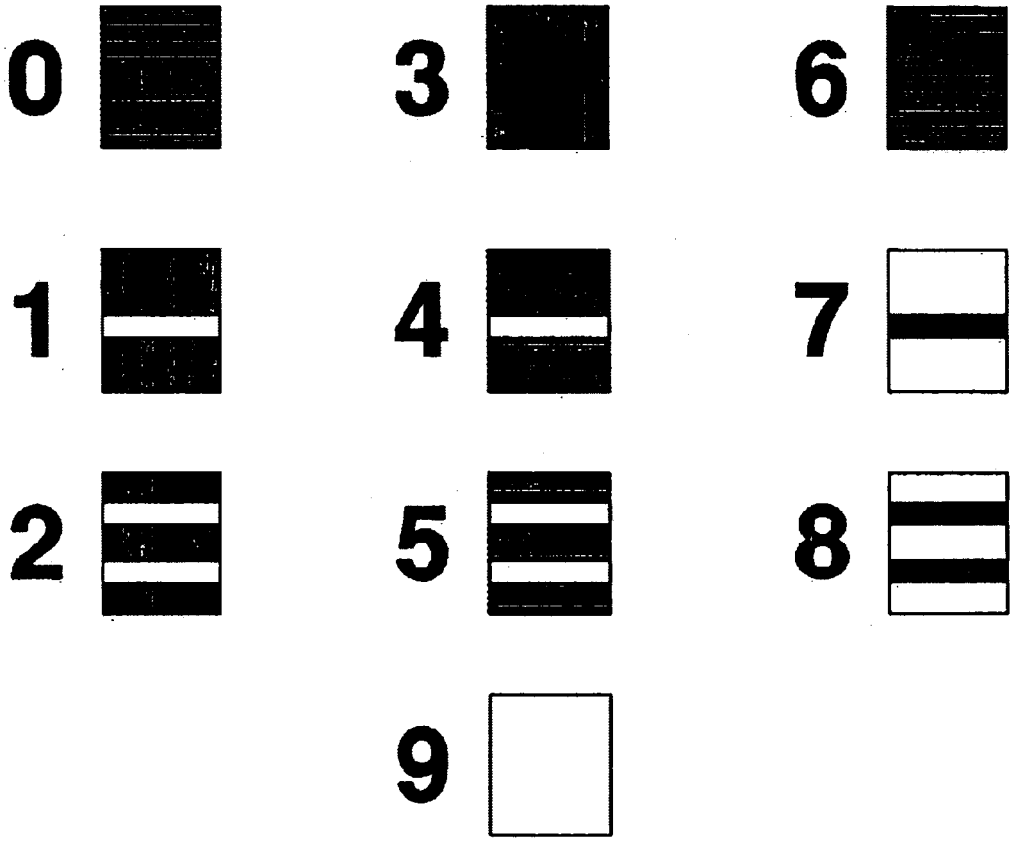
Figure 5C:
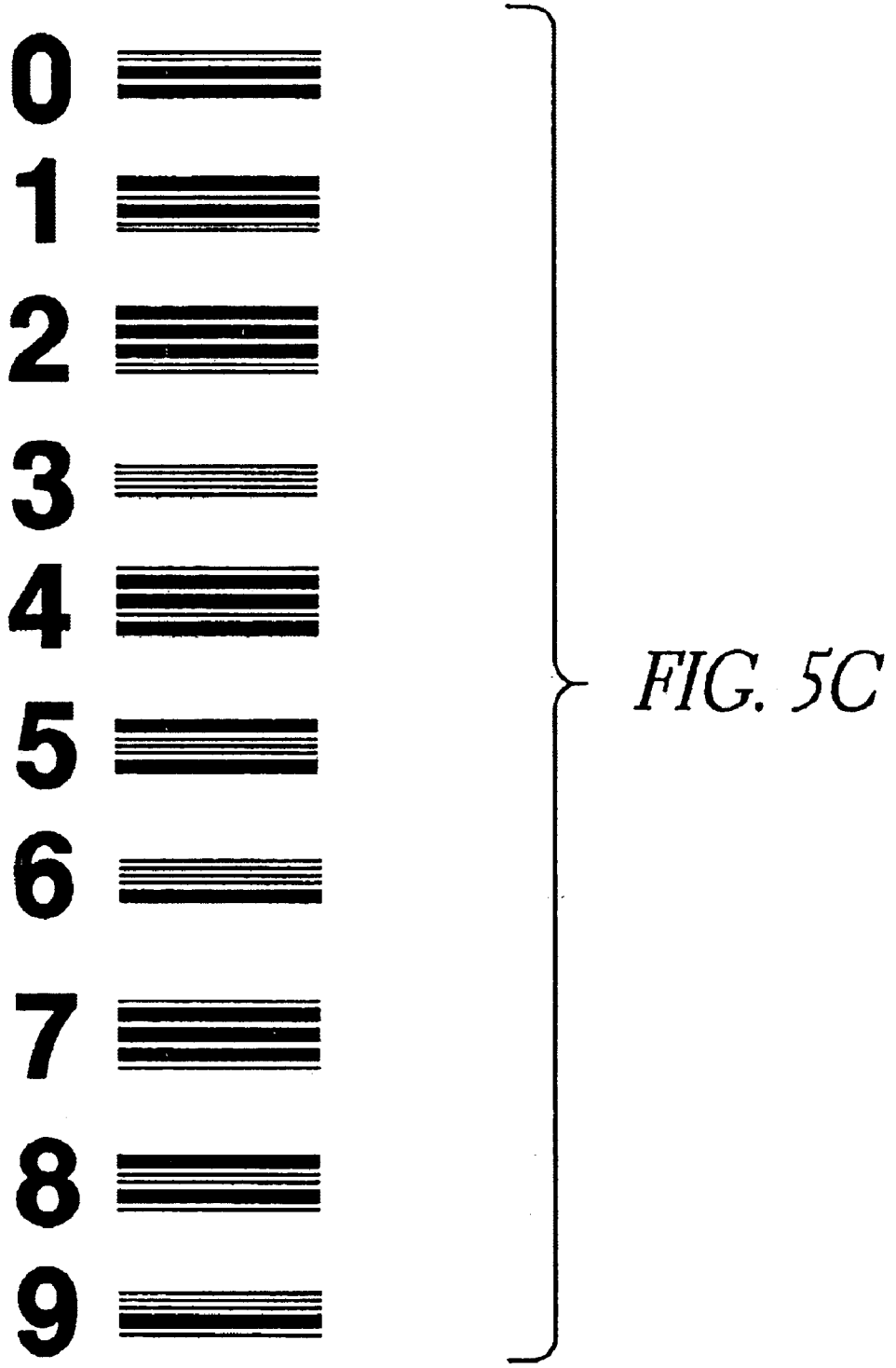

FIGS. 5(*a*), (*b*) and (*c*) show some preferred monochrome tab indicia for folder identification. Because color printers are slower than monochrome printers, monochrome tab indicia can be advantageously utilized to achieve faster printing throughput for the folders than if color tab indicia are used. Also, high contrast indicia are advantageously utilized for quick folder identification. The indicia shown in FIGS. 5(*a*) and (*b*) use a scheme of high contrast backgrounds and bars to ease indicia recognition. In the tab indicia embodiment shown in FIG. 5(*a*), the numbers "0", "1" and "2" are represented as white numbers on a black background; the numbers "3", "4" and "5" are represented as white numbers on a gray background; and the numbers "6", "7" and "8" are represented as black numbers on a white background. Zero, one or two horizontal stripes that contrast with the background are used to distinguish each number in the groups of three described above. The remaining number, "9", is represented as a white number on a black background with a single horizontal gray stripe. Different grouping of numbers can be likewise represented. For example, an alternative scheme would represent the numbers "1", "2" and "3" as white numbers on a black background; the numbers "4", "5" and "6" as white numbers on a gray background; and the numbers "7", "8" and "9" as black numbers on a white background. The remaining number, "0", is then represented as a white number on a black background with a single horizontal gray stripe. FIG. 5(*b*) shows another preferred tab indicia embodiment similar to that of FIG. 5(*a*), but with adjacent numeral symbology and a slightly different background and bar scheme. FIG. 5(*c*) is yet another preferred tab indicia embodiment advantageously using bar codes as high contrast and readily visible tab indicia for folder identification. Another alternative tab indicia embodiment utilizing monochrome printing advantageously uses blocks of highly visible monochrome patterns, such as checkerboards, cross-hatching, vertical and horizontal bars, large dots, X's, etc. It is contemplated that all of the monochrome tab indicia could also be advantageously color coded such that the unique pattern corresponding to each alphanumeric is printed in a color which is also unique to the alphanumeric.

Figure 6:
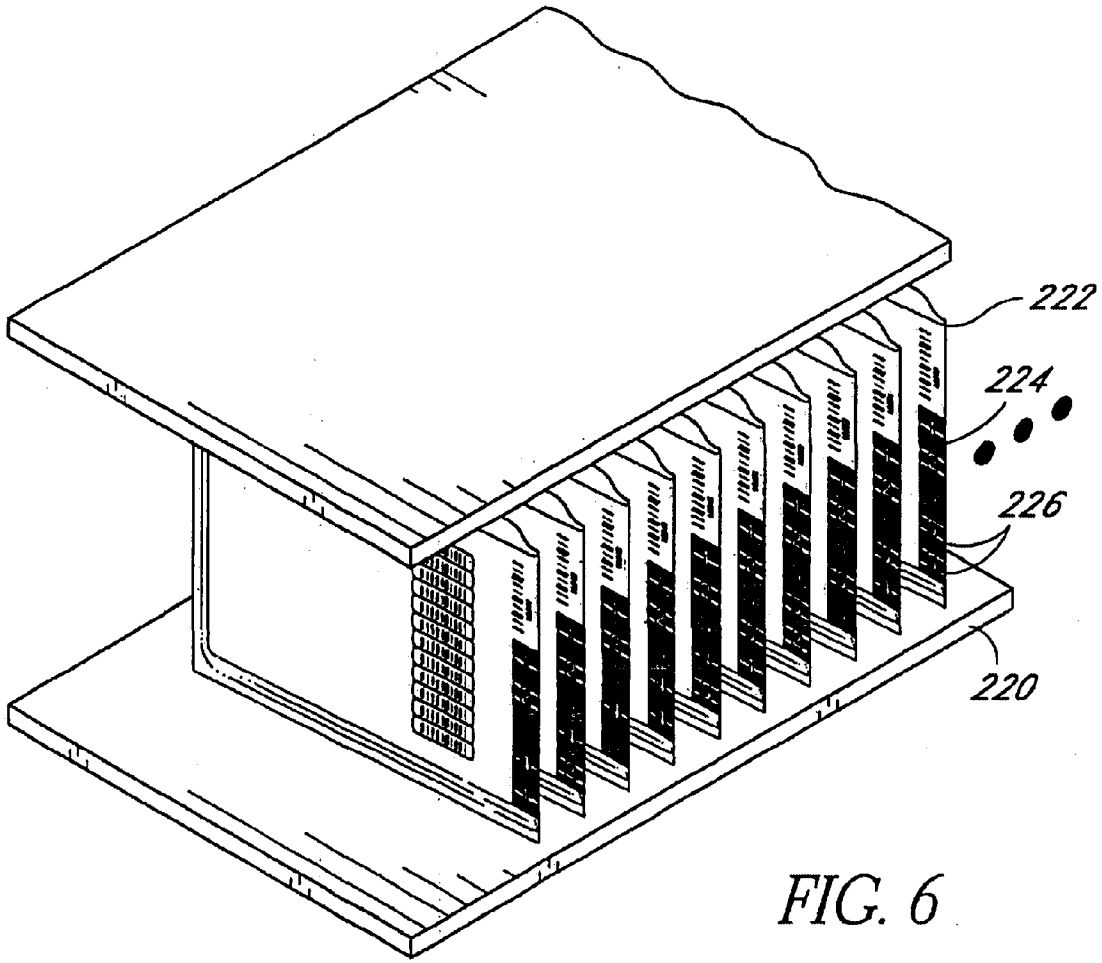
FIG. 6 is a perspective view of the improved folders on a shelf showing the visible tab indicia for folder identification.
Figure 10:
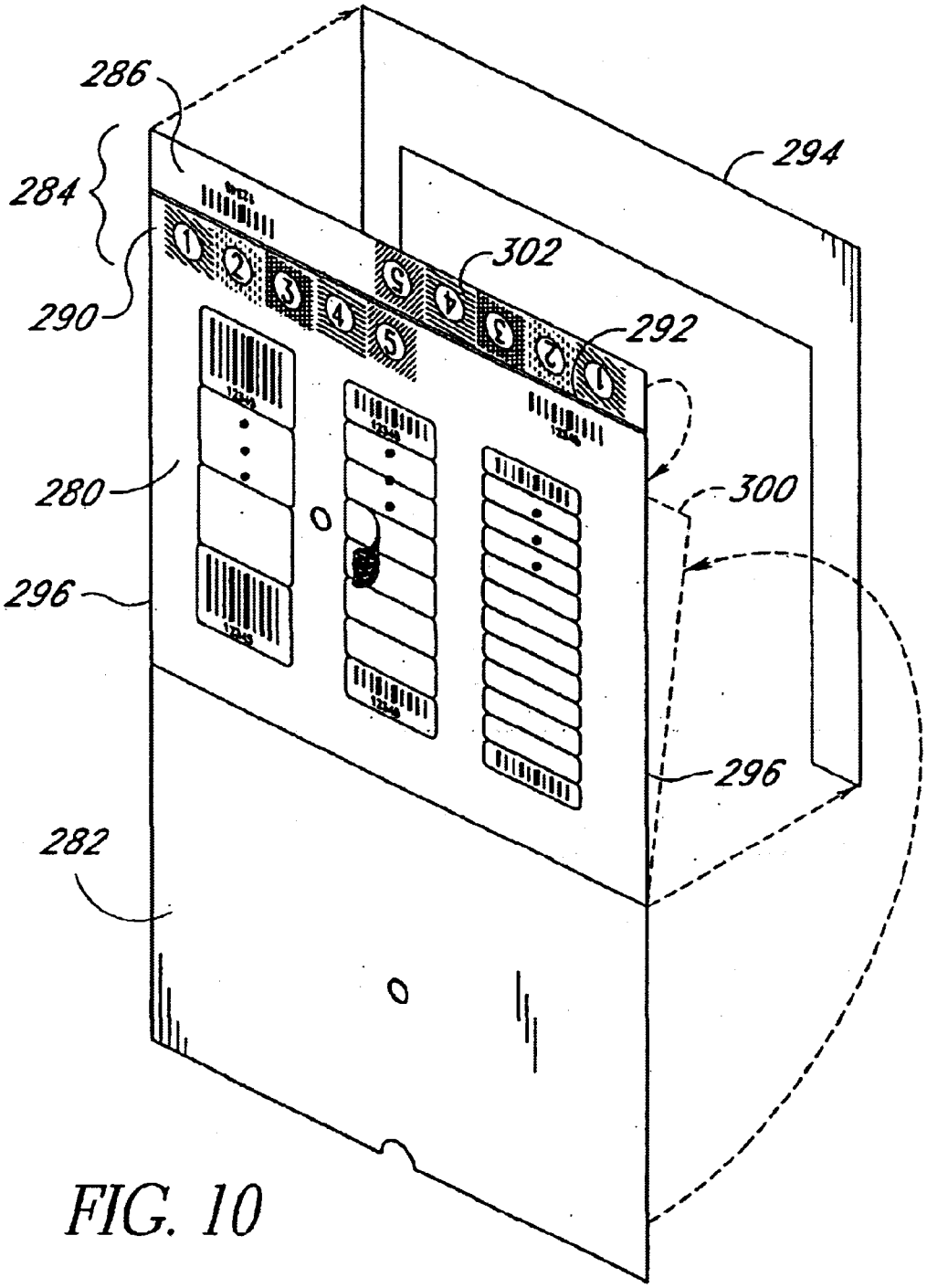
FIG. 10 shows a perspective view of a further embodiment of the improved folder according to the present invention, where the folder has a top tab which folds back upon itself and has panels which are sealed by the adhesive remaining after the release liner is removed.

Referring to FIG. 6(*a*), a preferred embodiment of the improved folder is schematically shown stored on a shelf with other such folders. The folder end tabs and the tab indicia are visible at a glance. Similarly, when folders are stored in a container such as a drawer, folder top tabs would be utilized and these top tabs and the tab indicia would be visible at a glance. An embodiment of the improved folder incorporating top tabs is shown in FIG. 10. Referring again to FIG. 6(*a*), the number blocks 224, allow these folders to be quickly identified as belonging to the "123" group of folders. If a misplaced folder belonging to another group is placed among these folders, it would be readily noticed. In this example, individual folders are identified by the last two digits 226 on the folder tabs 222. The individual folders in the "123" group are "41," "42," "43," "44," "45," "51," "52," "53," "54" and "55."

Figure 7:
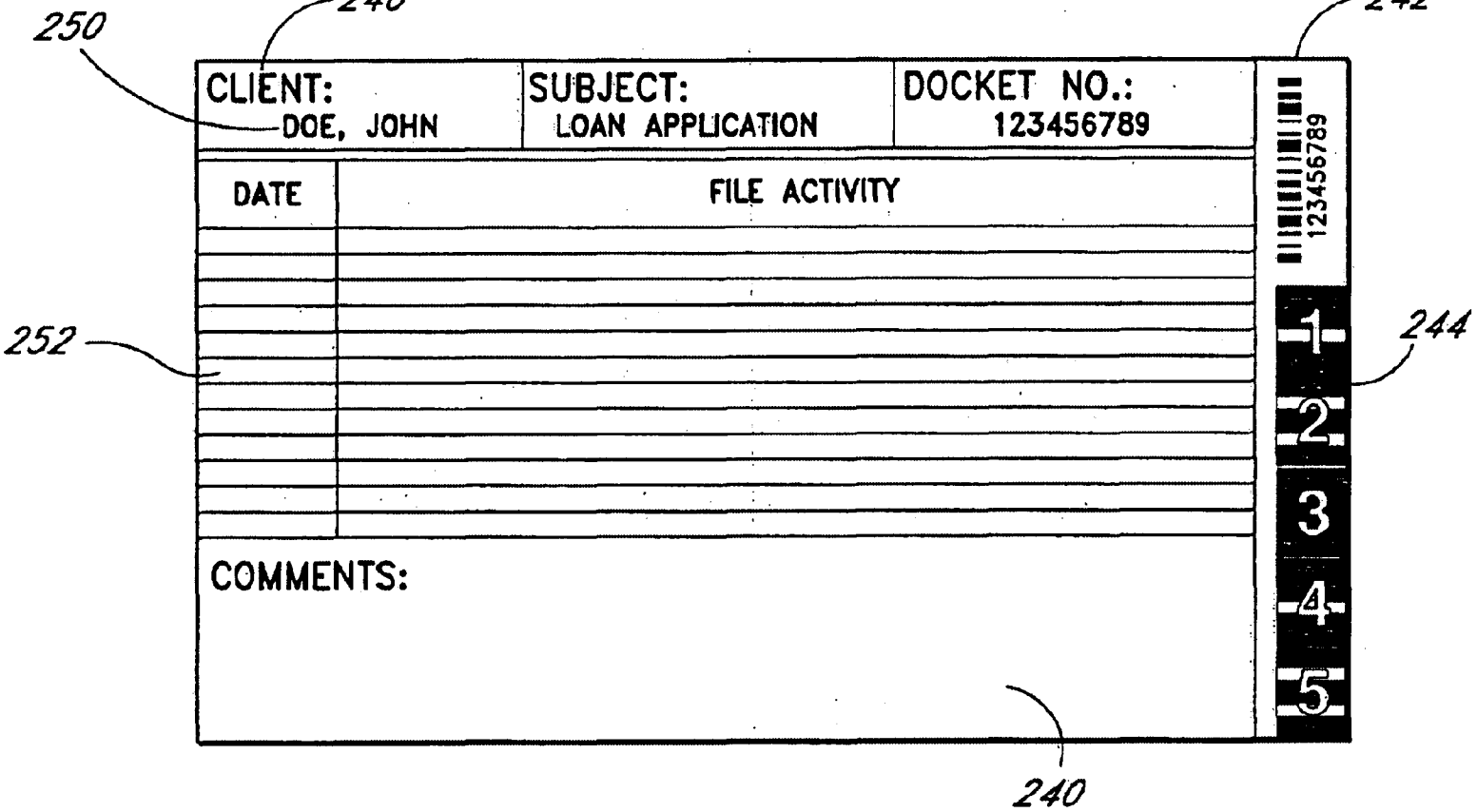
FIG. 7 is a front view of a preferred embodiment of the improved folder showing the folder front panel alternatively pre-printed with categories for handwritten indicia and the tab alternatively printed with color indicia.

Shown in FIG. 7 are alternative color indicia printed on the front panel 240 of a preferred embodiment of the improved folder. FIG. 7 also illustrates that the front panel 240 can be printed with folder identifying text. As an example, a folder identifying form 246 can be advantageously printed on the folder showing categories such as "CLIENT," "SUBJECT," and "FILE NO." Unlike a preprinted folder, however, folder specific text 250, such as a specific name can also be printed into the form 246 at the same time the form itself is printed. This eliminates the need to manually label each folder. These categories 252, however, can also be left blank to be handwritten or labeled at a future time.

Figure 8A:
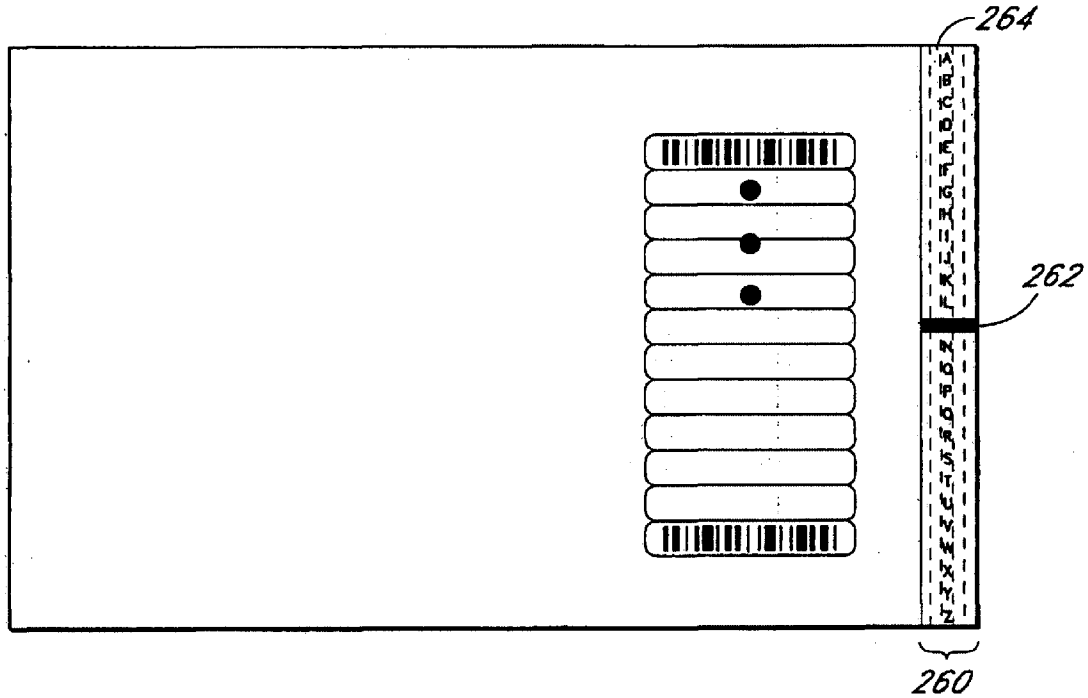
FIG. 8(*a*) is a front view of a preferred embodiment of the improved folder showing the tab alternatively printed with colored-tab and position block indicia.
Figure 8B:
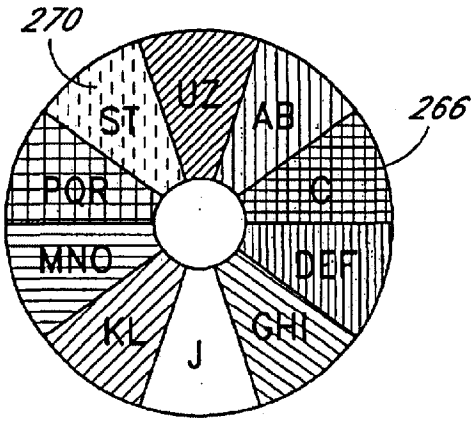
Figure 9B:
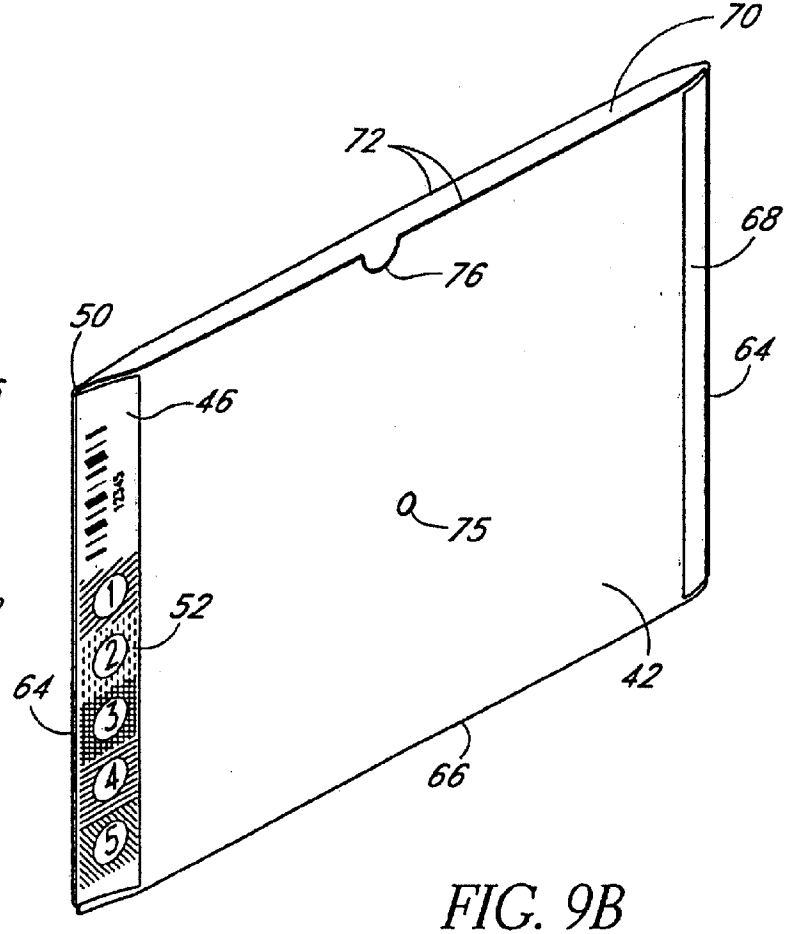
FIG. 9(*a*) is a perspective view of the front side of another embodiment, showing the side edges sealed by a printed, integrated tab at one side edge and an unprinted, integrated tab at the other side edge.
Figure 9A:
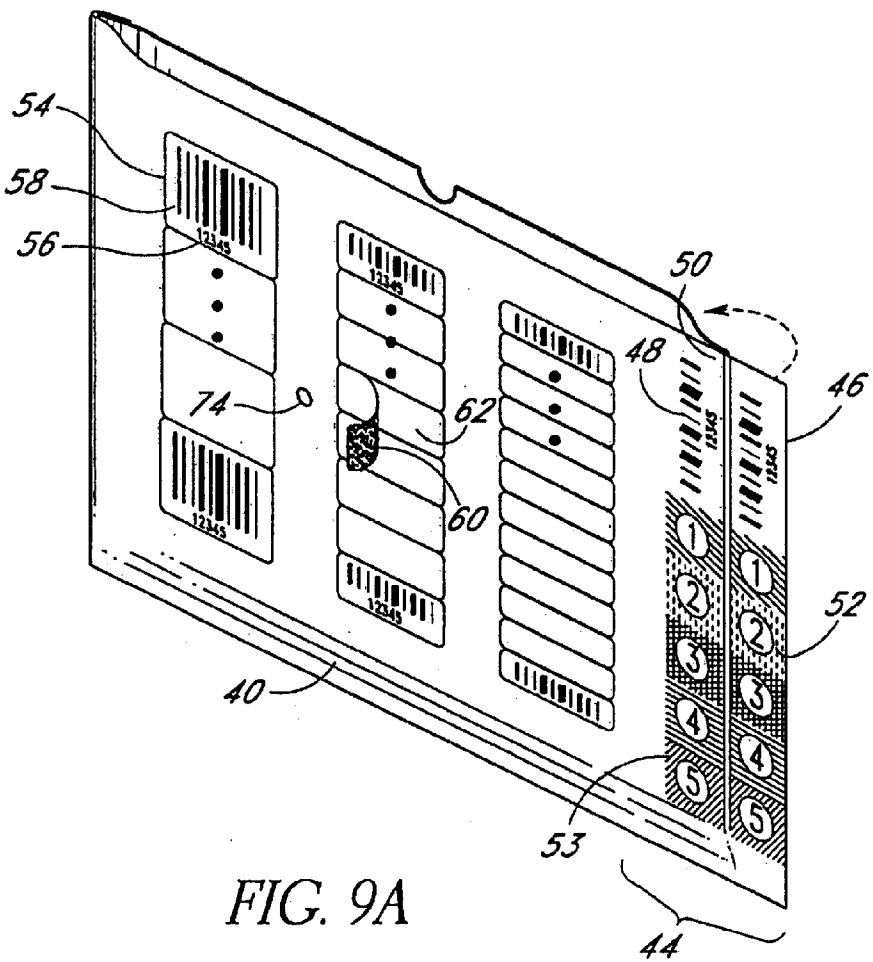
Figure 9C:
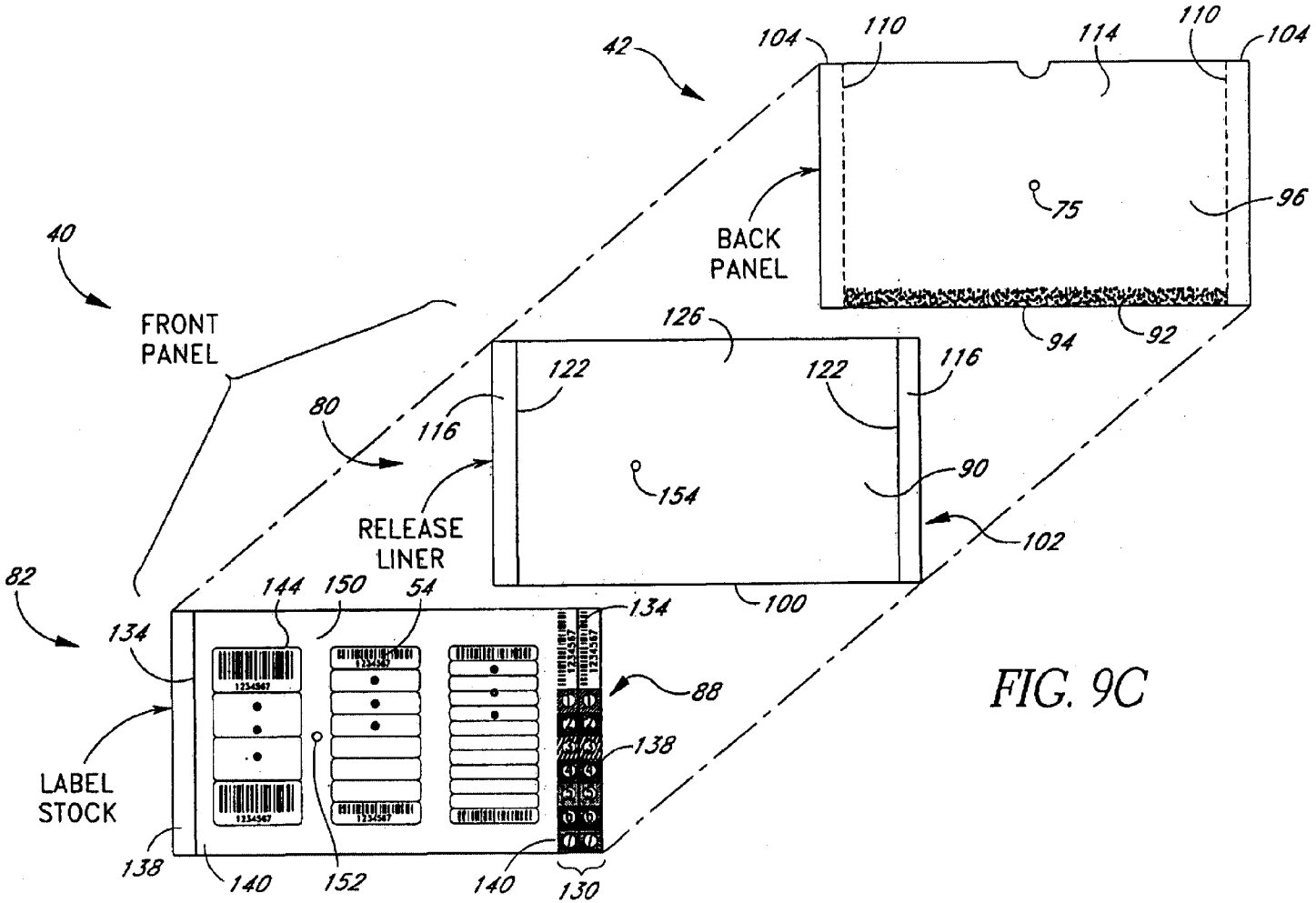
Figure 9E:
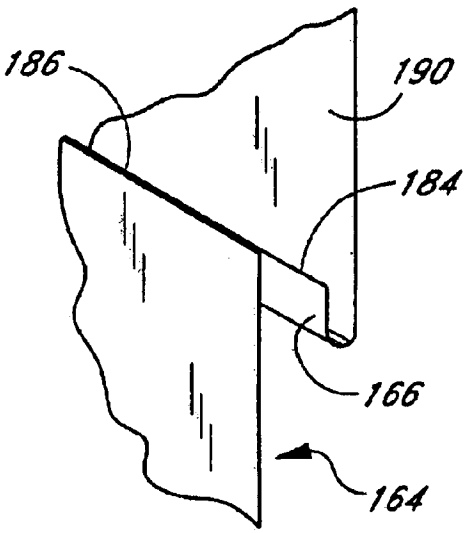
Figure 9D:
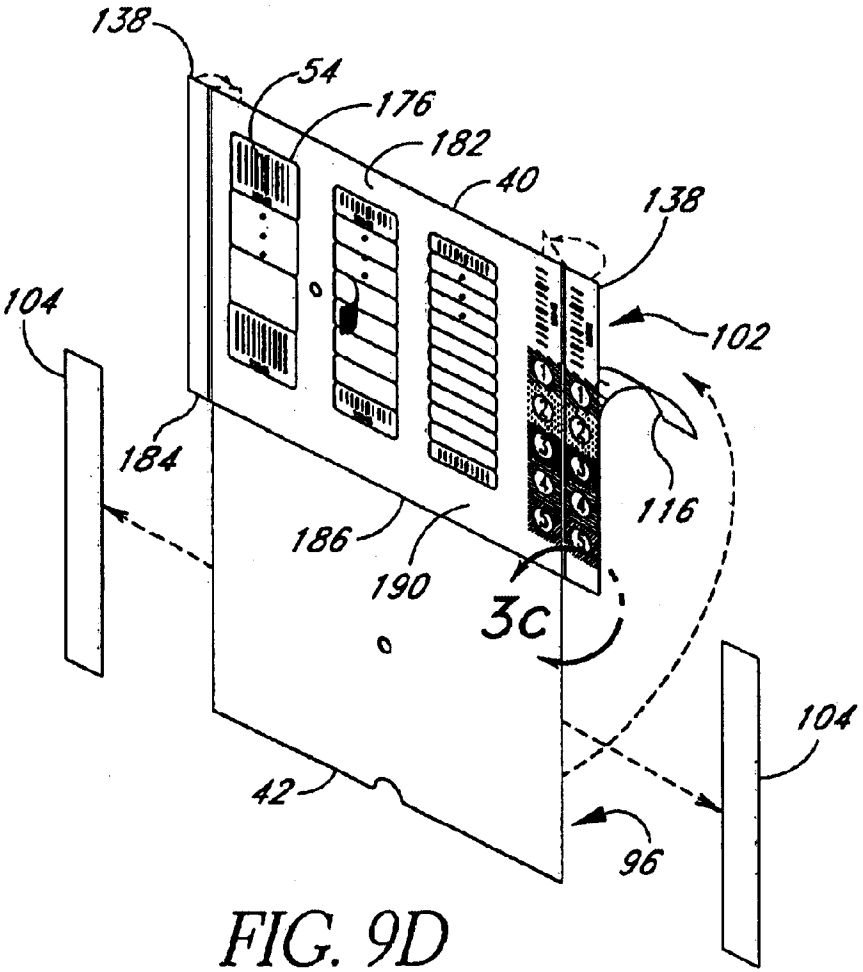
Figure 9F:
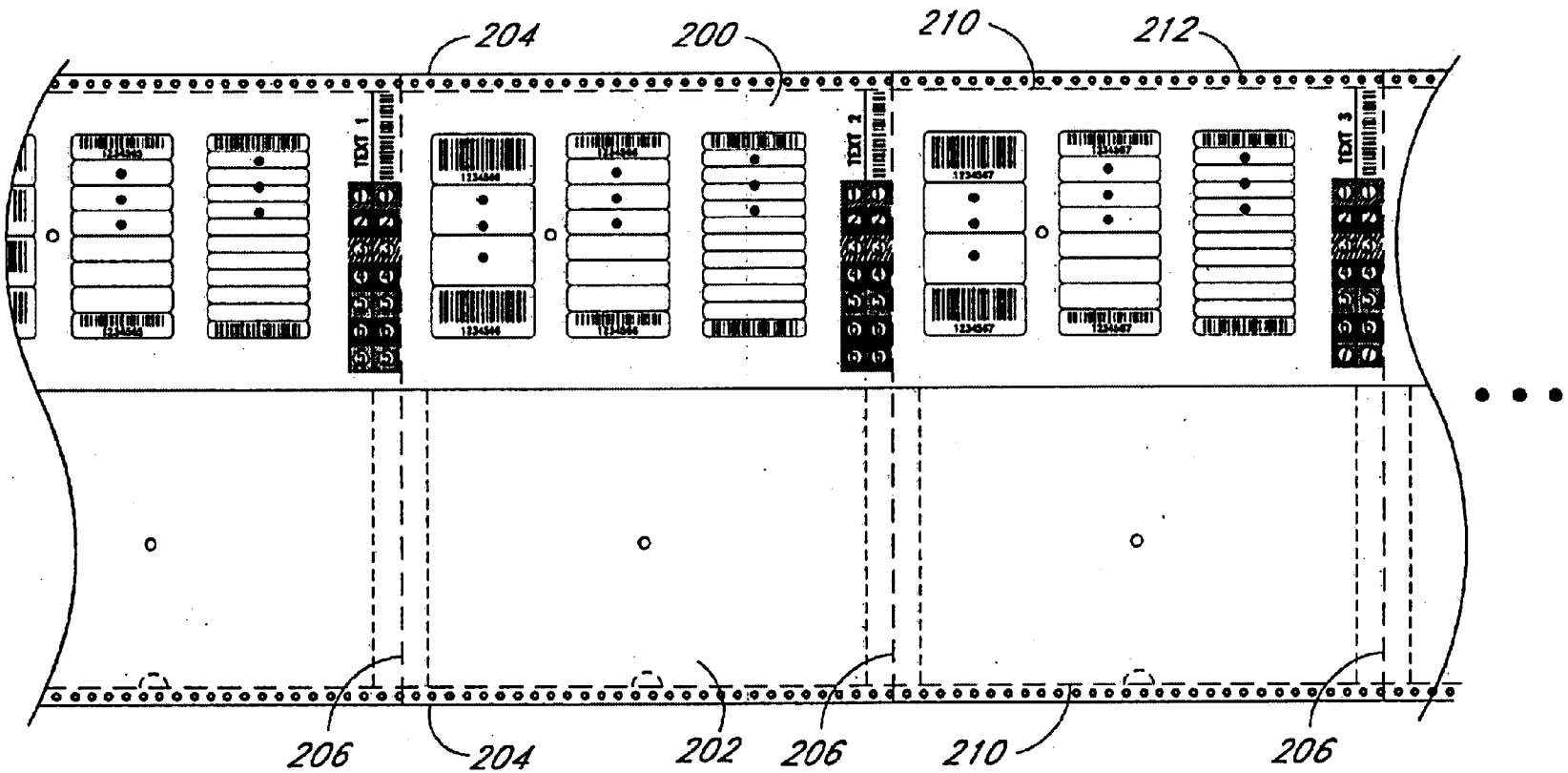
Figure 9G:
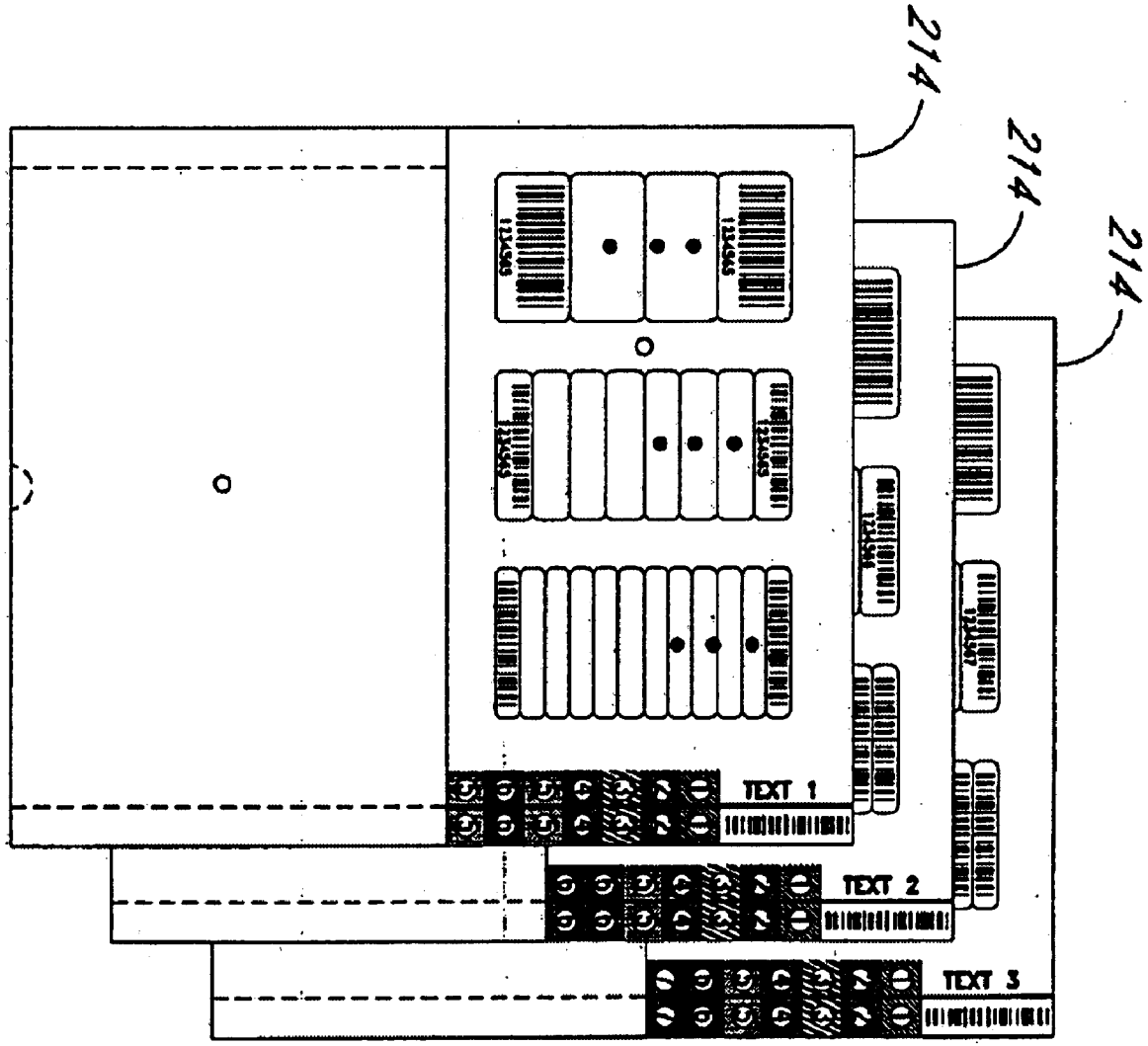

FIG. 8(*a*) illustrates another alternative tab indicia for the preferred embodiment of the improved folder utilizing a colored tab 260 plus a position bar 262. Folders are grouped according to both the tab color and the position of a black bar printed on an alphabetic guide 264. As shown in FIG. 8(*b*), a color wheel 266 specifies the meaning of the tab color. For example, if a filing system identifies folders by company name, the first letter of the first name indicates the alphabetic division (A, B, C, etc.) and hence the location of the position bar on the alphabetic guide. The first letter of the second name indicates the tab color (brown, red, pink, etc.). Single name folders would be filed and color coded under the first letter of the name. Thus, the folder for the company "Murray's Ties" would appear as in FIG. 8(*a*), with the position bar 262 across "M" (for "Murray's") on the alphabetic guide 264 and with a purple folder tab 260 corresponding to the "ST" group 270 (for "Ties") on the color wheel 266 shown in FIG. 8(*b*). On a shelf or in container, specific folder groups printed in this manner can be readily identified. Further folder subdivisions can be created using multiple columns of the alphabetic guides with multiple position bars. As an alternative to a colored tab, a tab could be advantageously printed with a specific shade of gray or a monochrome pattern denoting a particular letter group.

FIGS. 9(*a*) and 9(*b*) show a first alternative embodiment of the improved folder according to the present invention. This embodiment has a front panel 40, a back panel 42 and an integrated tab 44 located on one side of the front panel. The tab has a back portion 46 and a front portion 48 separated by a vertical fold line 50 which is a score or perforation in the panel material. Duplicative tab indicia 52, 53 are printed on both the back 46 and front 48 tab portions. During folder assembly, the printed, integrated tab 44 is folded along the fold line 50 and the back portion 46 is affixed to the back panel 42 as shown in FIG. 9(*b*). Integrated document labels 54 on the front panel are printed with text 56 and machine-recognizable indicia 58 at the same time the integrated tab 44 and other portions of the front panel are printed. These labels have an adhesive backing 60 and can be peeled from the release liner 62 and affixed to folder documents. The front panel 40 and back panel 42 are sealed together along the folder's side 64 and bottom 66 edges to form a pocket 70 in which documents can be stored. The side edges 64 are sealed by the printed integrated tab 44 on one side and the unprinted integrated tab 68 on the other side. Sealing the folder along three edges in this manner advantageously provides increased stability to the folder. In the alternative, one side edge of the folder can remain unsealed, allowing documents to be inserted into the pocket from either the side 64 or the top 72. The front panel 40 and the back panel 42 have air-release holes 74 which allow air trapped in the folder pocket 70 to escape, preventing ballooning of the folder. A finger notch 76 on the top edge of the back panel eases manual separation of the front panel 40 and back panel 42 allowing access to documents contained within the folder pocket 70.

FIG. 9(*c*) shows the construction of this alternative embodiment of the improved folder. The folder is constructed of three layers. A release liner 80 and adhesive-backed label stock 82 together form the front panel 84. The third layer is a back panel 86 made of material which is thicker than the front panel to provide support for the folder yet thin enough to pass through both a printer or a scanner in combination with the front panel. The label stock 82 is layered onto the release liner 80, with the adhesive side 88 of the label stock 82 in contact with the release side 90 of the release liner 80, affixing the two sheets together. A glue line 92 along the bottom edge 94 of the back panel inner side 96 seals the back panel bottom edge 94 to the corresponding bottom edge 100 of the release liner inner side 102 to form the bottom of a document pocket. The back panel 86 has two vertical tear-off portions 104, one on the right side and one on the left side. Easy perforations 110 divide these tear-off portions 104 from the remaining portion 114 of the back panel, allowing the tear-off portions 104 to be removed. The release liner 80 has two corresponding vertical peel-off portions 116 on the right and left sides. Vertical die-cuts 122 divide these peel-off portions 116 from the remaining portion 126 of the release liner 80. The label stock 82 has tab portions 130 on the right and left sides corresponding to the release liner peel-off portions 116 and the back panel tear-off portions 104. Fold perforations 134 in the adhesive sheet 82 divide the back portions 138 from the front portions 140 of the tabs 130. A label die-cut 144 separates a label 54 from the remaining portion 150 of the label stock 82. Multiple label die-cuts may be made as desired for a particular application, creating multiple-labels of advantageous sizes and shapes. The label stock 82 has an air-release hole 152 and the release liner 80 has an air-release hole 154 of identical size and at a corresponding location. The back panel 42 has a similar air-release hole 75.

In FIG. 9(*d*) this alternative embodiment of the improved folder is shown with the front panel 40 attached to the back panel 42. Prior to printing, the blank folder is advantageously provided with both panels in an opened position. This configuration allows the front and back panels to be attached before printing but minimizes the thickness of material which must pass through the printer. After printing, folder assembly is completed by bringing the front panel inner side 102 into proximity with the back panel inner side 96. The front panel peel-off portions 116 are then removed to expose an adhesive-backing on the back tab portions 138. The back panel tear-off portions 104 are also removed to allow the back portions of the tabs 138 to be folded and affixed in a folded position against the back panel 42, sealing the folder sides. This creates a document pocket sealed on three sides with an opening at the top as shown in FIG. 9(*a*).

As described above, the front panel implements several useful features for the improved document folder utilizing an easily manufactured construction. The front panel provides removable, adhesive-backed labels; foldable, adhesive-backed end tabs which seal the folder; a printable surface; and a thin profile allowing the front panel, labels and end tab to all be printed at the same time using a standard printer.

Referring back to FIG. 9(*d*), this alternative embodiment is designed to permit easy printing of the adhesive sheet layer and has several features which minimize the possibility of jamming during high-speed printing operations. The label corners 176 are rounded to minimize the possibility of a peeled-up corner jamming the printer. Also, the labels 54 are flush with the remainder of the label stock 182, which eliminates any discontinuity in the printing surface. The back panel tear-off portions 104, which are removed after printing, also minimize discontinuities in the printing surface at the back tab portions 138.

FIG. 9(*e*) is a detail showing how the front panel bottom edge 184 and the back panel bottom edge 186 are advantageously attached. The front panel bottom edge is folded toward the front panel printed side 190, exposing the front panel inner side 166, which is glued to the back panel inner side 164 at the bottom edge 186.

Referring to FIG. 9(*f*), the first alternative embodiment of the improved folder is shown in a configuration utilized for continuous-feed high-speed printers. A continuous front panel sheet 200 is attached to a continuous back panel sheet 202 in the same manner as detailed in FIG. 3(*d*). Integral tractor-feed strips 204 are incorporated at the top edges of both the front panel and the back panel sheets. Regularly spaced, transverse easy-perforations 206 define the boundary of individual folders and allow the individual folders to be separated from one another. Longitudinal easy-perforations 210 allow the tractor-feed strips 204 to be separated from the folders. The tractor-feed strips 204 contain pin holes 212 which allow a printer's tractor-feed mechanism to guide the connected folders through the printer. After printing, the folders are separated from one another and the tractor-feed strips 204 are removed. The folders are then individually assembled as shown in FIG. 9(*d*). In the alternative, the folders can be configured as individual forms 214, as shown in FIG. 9(*g*) and fed into a printer using a single-sheet feed mechanism.

FIG. 10 shows a second embodiment of the improved folder with the folder tab located at the top edge of the front panel. In this embodiment, the folder front panel 280 is constructed in the same way as the embodiment shown in FIG. 9(*c*), with a label stock 82 affixed to a release liner 80. Referring to FIG. 10, the folder front panel 280 is attached to a back panel 282 in the same way as the alternative embodiment, shown in FIGS. 9(*c*), (*d*) and (*e*). The top tab 284 has a back portion 286 separated from a front portion 290 by a horizontal fold 292. A peel-off portion of release paper 294 is removed after printing to expose adhesive on the back of the top tab 284 and the front panel sides 296. The back panel 282 is then folded up and adhered to the front panel sides 296 to seal those sides and form a document pocket with an opening at the folder top edge 300. The tab 284 is folded in half such that the back portion 286 is affixed to the front portion 290, leaving an unsealed pocket opening at the top edge 300. The tab 284 is printed with folder indicia 302 on both the back 286 and front 290 tab portions. The tab construction of FIG. 10, where the tab is foldable onto itself, also can be advantageously implemented as an end tab. Such an end tab is an alternative to the tab shown in FIG. 9(*d*), where the end tab 138 is folded onto the back panel 42.

Figures 11A, 11B:
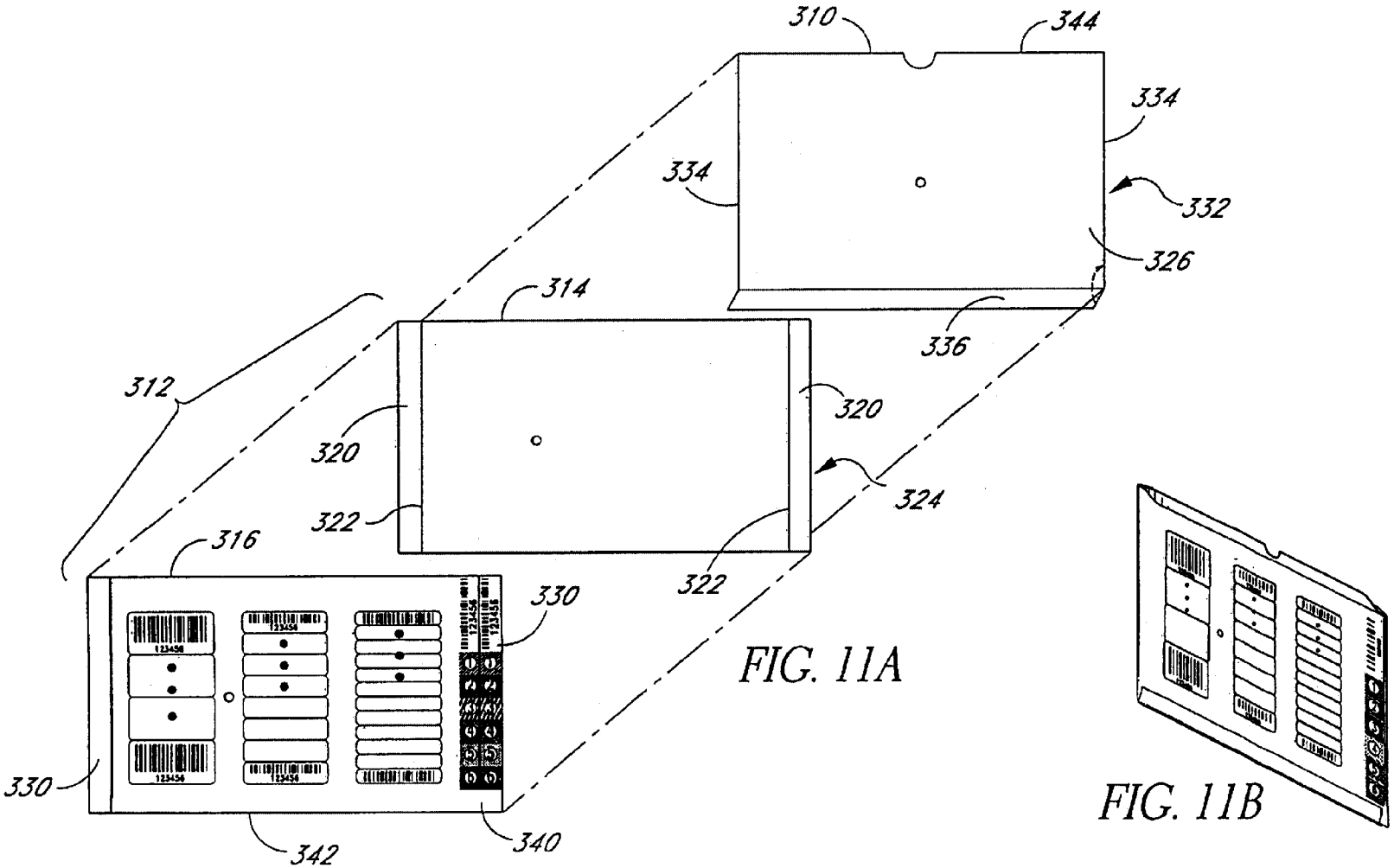
FIG. 11(*a*) is an exploded view of another embodiment of the improved folder in which the front and back panels are sealed along the side edges with front panel tabs and along the bottom edge with a back panel tab.

FIG. 11(*a*) shows the construction of a third embodiment of the improved folder. This embodiment is also constructed of three layers, a back panel 310 and a front panel 312 having a release liner 314 affixed to an label stock 316. In this embodiment, the front panel 312 is advantageously printed before it is attached to the back panel 310, minimizing the thickness of material passing through the printer. After printing, peel-off portions 320, created by die-cuts 322 in the release liner 314, are removed. The front panel inner side 324 is then placed in contact with the back panel inner side 326 and the back tab portions 330 of the front panel are folded and affixed to the back panel outer side 332, sealing the folder sides 334. The back panel 310 has a foldable adhesive tab 336 along its bottom edge which is then folded and affixed to the front panel outer side 340, sealing the bottom edge of the folder 342 and creating a document pocket open at the top edge 344, as shown in FIG. 11(*b*).

Figures 12A, 12B:
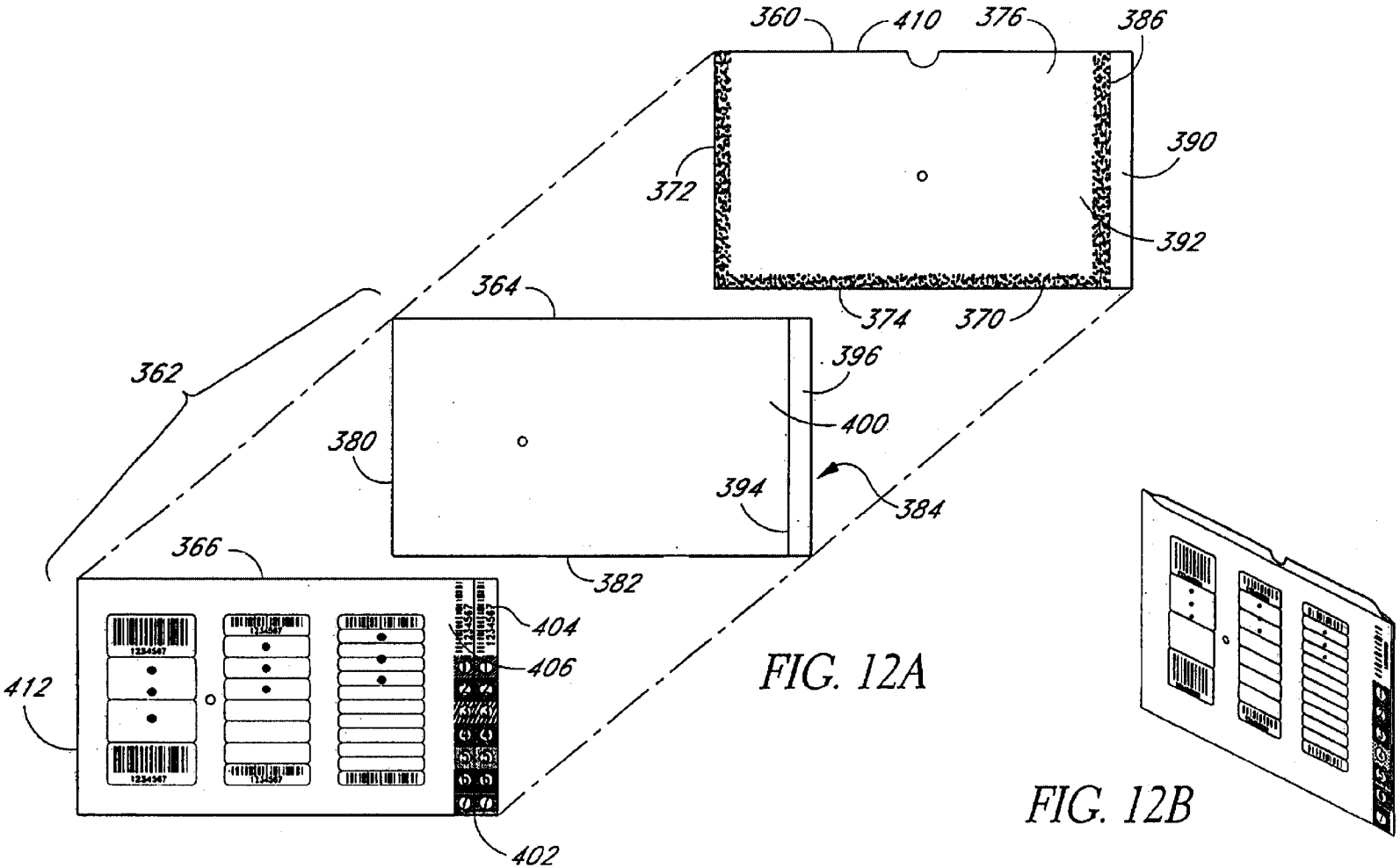
FIG. 12(*a*) is an exploded view of an embodiment of the improved folder in which the front panel and back panels are sealed with a glue-line along the bottom and side edges after the front panel is separately printed.
Figure 12C:
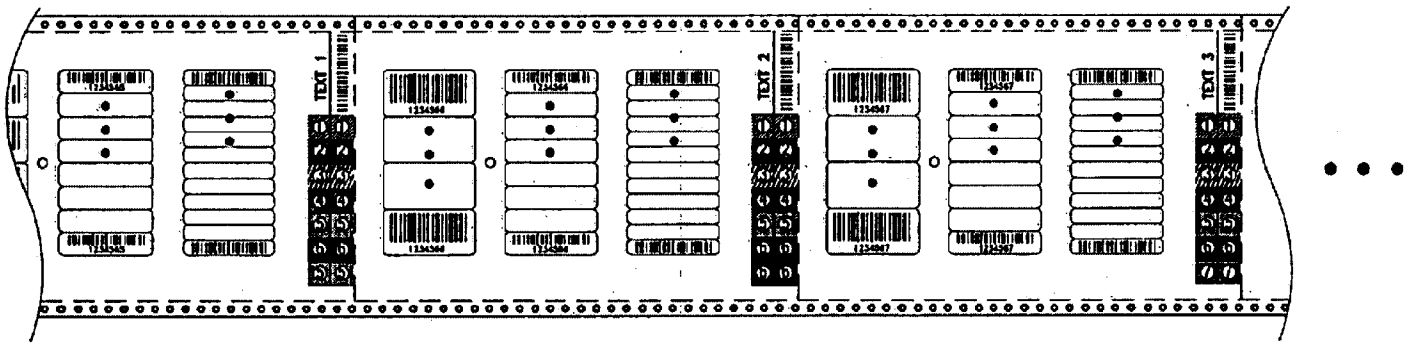
Figure 12D:
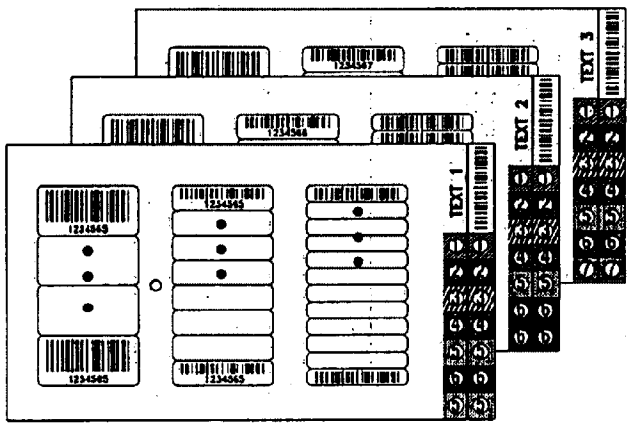

Referring to FIG. 12(*a*), the construction of a fourth alternative embodiment of the improved folder is shown. The folder is again constructed of three layers, a back panel 360 and a front panel 362 having a release liner 364 affixed to a label stock 366. A glue line 370 along the side 372 and bottom 374 edges of the back panel inner side 376 seals these back panel edges to the corresponding side 380 and bottom 382 edges of the front panel inner side 384 to form the folder pocket. A perforation 386 divides the back panel tear-off portion 390 and the remainder of the back panel 392, allowing the tear-off portion 390 to be removed. A release liner die-cut 394 divides a peel-off portion 396 from the remainder of the release liner 400. A fold 402 divides a back tab portion 404 from the remainder of the label stock 406. In this embodiment, the three layers are attached before printing, forming a completed but blank folder with the side and bottom edges sealed and an opening to a folder pocket at the top edge 410. After printing, the tear-off portion 390 is removed. Then the peel-off portion 396 is removed to expose the adhesive on the back of the back tab portion 404, which is folded and affixed to the back panel 360. The presence of the tear-off portion 390 during printing of the folder prevents a discontinuity which might cause jamming of the printer mechanism. After printing, the tear-off portion 390 is removed. In this embodiment, both side edges are sealed and documents must be inserted into the folder pocket at the folder top edge 410, as shown in FIG. 12(*b*). In the alternative, the side edge opposite the tab 412 is advantageously left unsealed to allow documents to also be inserted into the folder pocket at the folder side edge. FIGS. 12(*c*) and (*d*) shown the fourth alternative embodiment configured for continuous-feed printing or single-sheet printing, respectively.

Figure 13A:
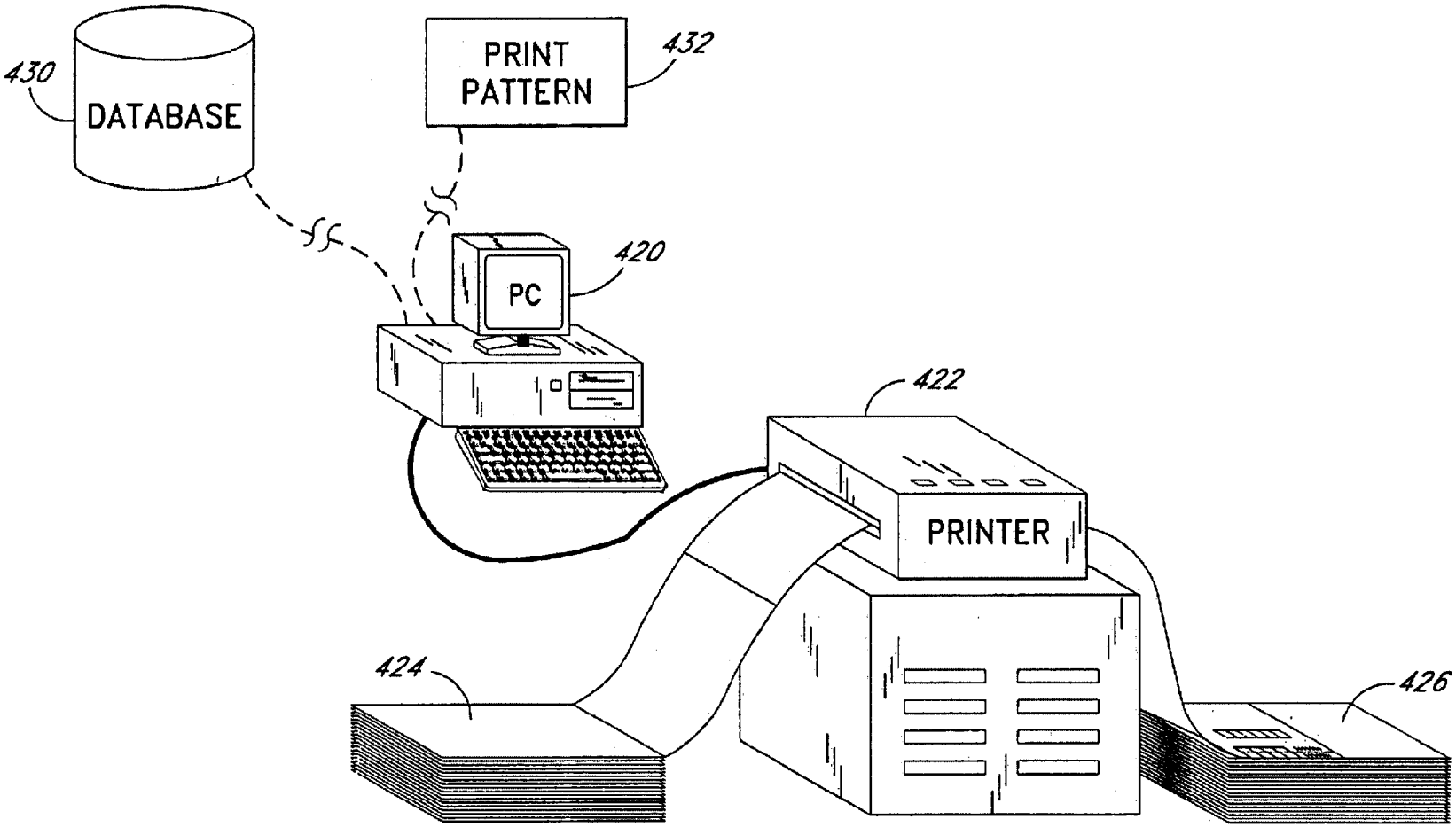
FIG. 13(*a*) is a schematic block diagram of the preferred folder printing system.
Figure 13B:
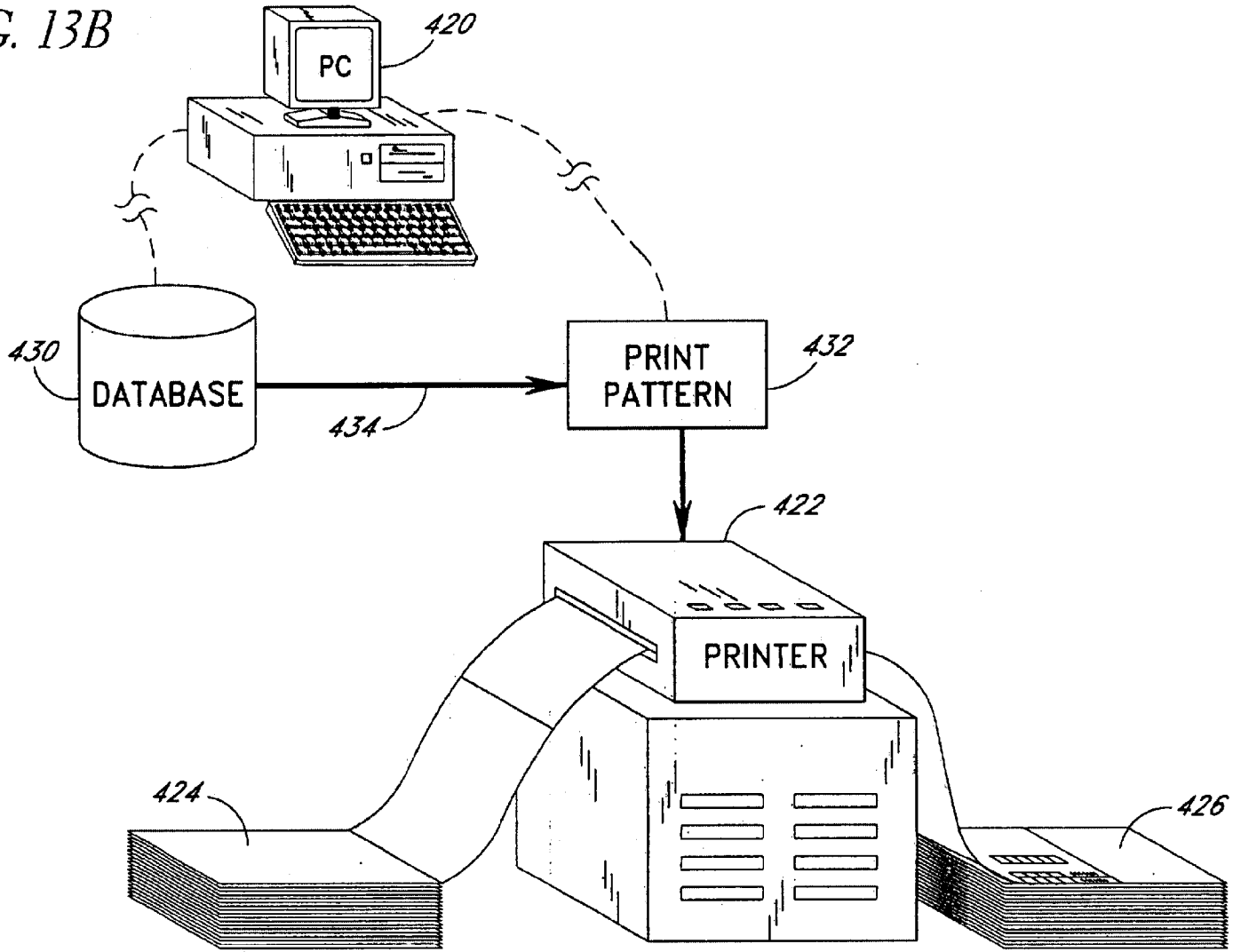

FIG. 13(*a*) schematically illustrates a preferred embodiment of the printing system which prints each folder uniquely in accordance with a selected database entry. In the preferred embodiment of FIG. 13(*a*), the printing system host is an IBM "PC" or compatible computer 420 using an INTEL 486 processor and having a keyboard, a monitor and a hard disk drive. Other computers, for example the APPLE MACINTOSH, can be used as the host. In the preferred embodiment of FIG. 13(*a*), the host is interfaced to a PRINTRONIX Model L5031 printer 422 capable of continuously processing blank folders 424 to produce printed folders 426. Other printers that are capable of accepting the thickness of the folder material can also be used. The blank folders are provided as continuous fanfold sheets as shown in FIG. 3(*c*) or as single-sheets as shown in FIG. 3(*d*). A database 430 residing on the PC hard disk contains information associating specific folders with their sequence identifiers and information regarding the documents in each folder. A print pattern 434 compiles the printer commands and data common to each folder. FIG. 13(*b*) shows the information flow through the printing system. The common print pattern commands and data 432 are merged with specific folder and document data 434 from the database 430 and transferred 436 to the printer 422 for each folder printed. The preferred printing system provides for high-speed data-dependent folder printing. The printing is data-dependent because each folder's tab, document labels and front panel are printed based on the information available on that specific folder in the database. The print pattern, the design of which is described in FIG. 16, utilizes the commonality between folders to reduce the time to compile printer commands and data for each folder. This speeds the printing process.

Figure 14:
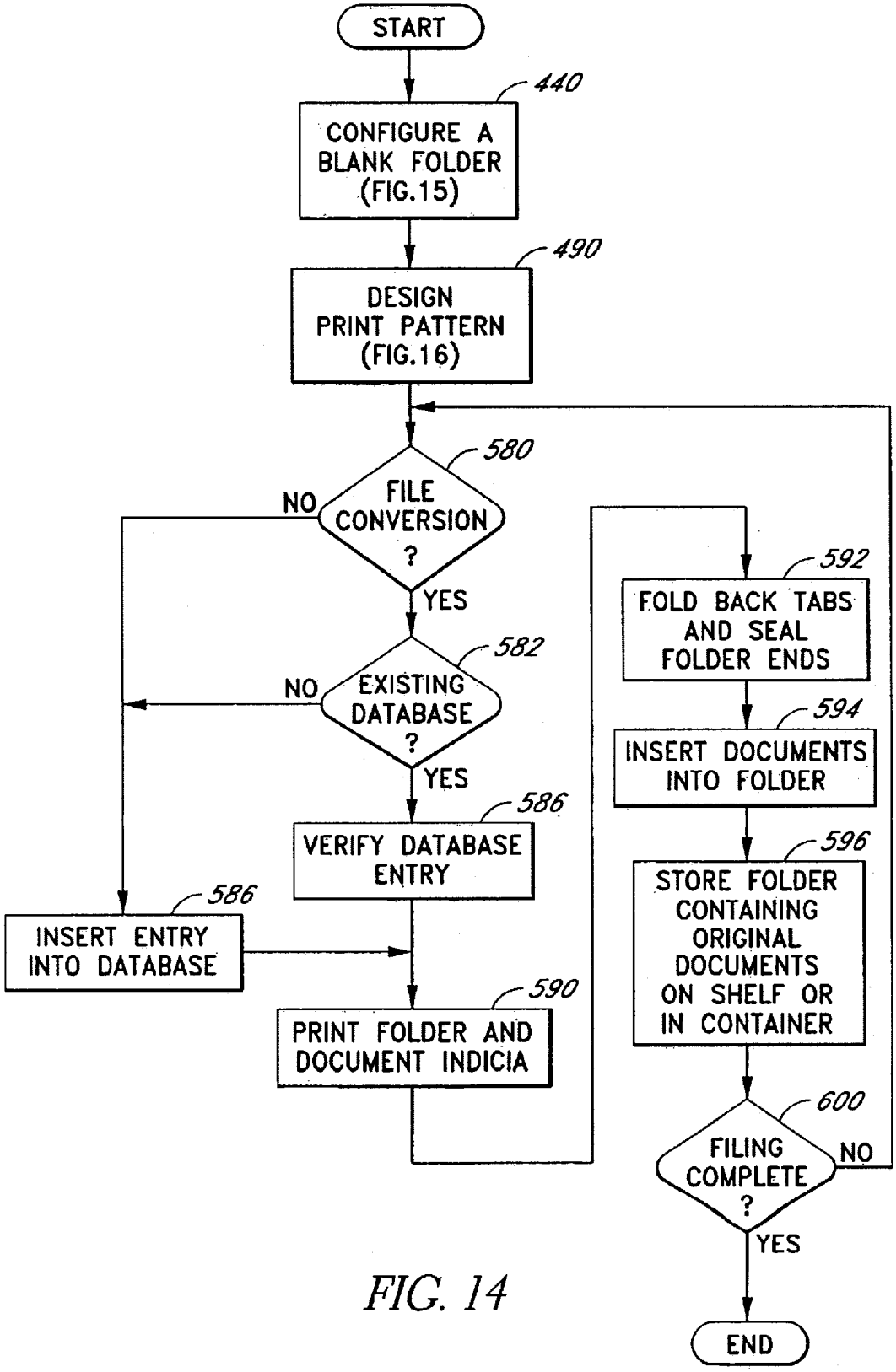
FIG. 14 is a top-level flowchart for the improved folder selecting, printing and assembling processes and the document filing and storing processes using the improved folder.
Figure 15:
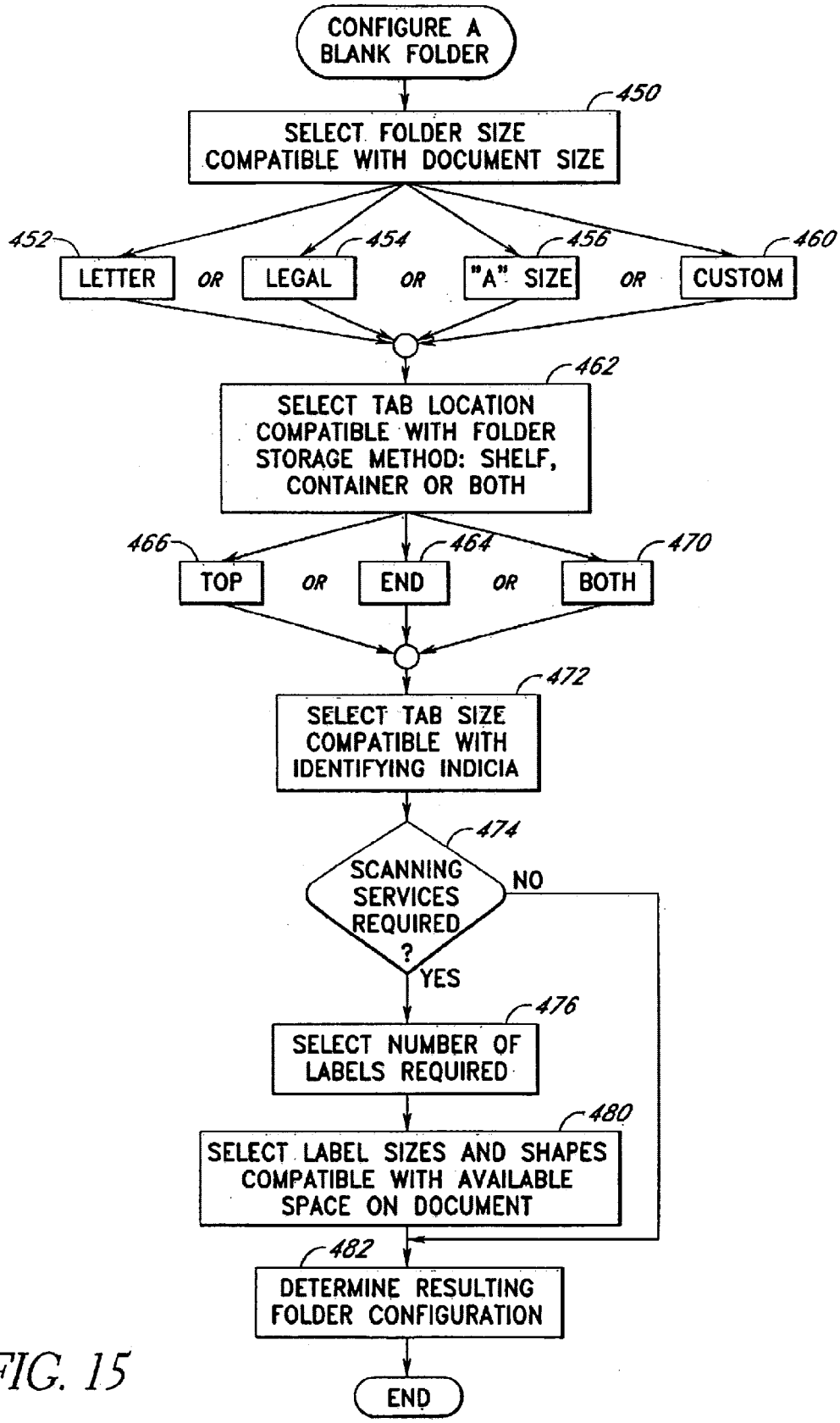
FIG. 15 is a subroutine-level flowchart for determining the physical configuration of the improved folder from application-specific parameters.

As shown in FIG. 14, the method of using the improved folder for a specific filing application begins with determining the physical configuration of the blank folder 440. Referring to FIG. 15, the folder configuration is determined by first selecting a folder size 450. Based on the size of the folder documents, the folder size is determined to be letter 452, legal 454, A size 456 or custom sized 460. Next, the folder tab location is selected 462. If the folder is to be stored on a shelf, an end tab 464 is preferable. If the folder is to be stored in a container, a top tab 466 is preferable. A folder with both top and end tabs 470 is an alternative. The preferred tab size 472 is also selected, constrained by the folder identification method which is to be printed on the tab. If scanning services are required 474, the integrated document labels are specified. The number of labels required 476 is selected based on the number of documents to be labeled. Label sizes and shapes are selected 480 based on the blank space available on the documents to be labeled and the label size preferences. Label sizes and shapes may also be restrained by the document identifying indicia to be printed on the labels. These label parameters determine the die-cut pattern, i.e. the size, shape and quantity of labels on the folder panels. From the foregoing specification of the folder size, tab size and location and label sizes, shapes, quantities and locations, the resulting folder configuration is determined 482. A manufacturing specification for the desired folder can then be printed. Alternatively, if a variety of folder types are maintained in inventory, a part number for the desired folder can be printed.

Referring back to FIG. 14, once a physical folder configuration is determined 440, a print pattern is designed 490. The print pattern design utilizes the folder configuration information determined from the previous step of FIG. 14 in addition to parameters regarding the location and type of information to be printed. This information is translated into a command and data sequence common to all folders for a specific filing application. This common command and data sequence, or pattern, is merged with folder specific data and sent to the printer during the folder printing process. The printer uses the print pattern and the merged data to print a specific folder with integrated tab and label indicia.

Figures 16, 16A, 16B:
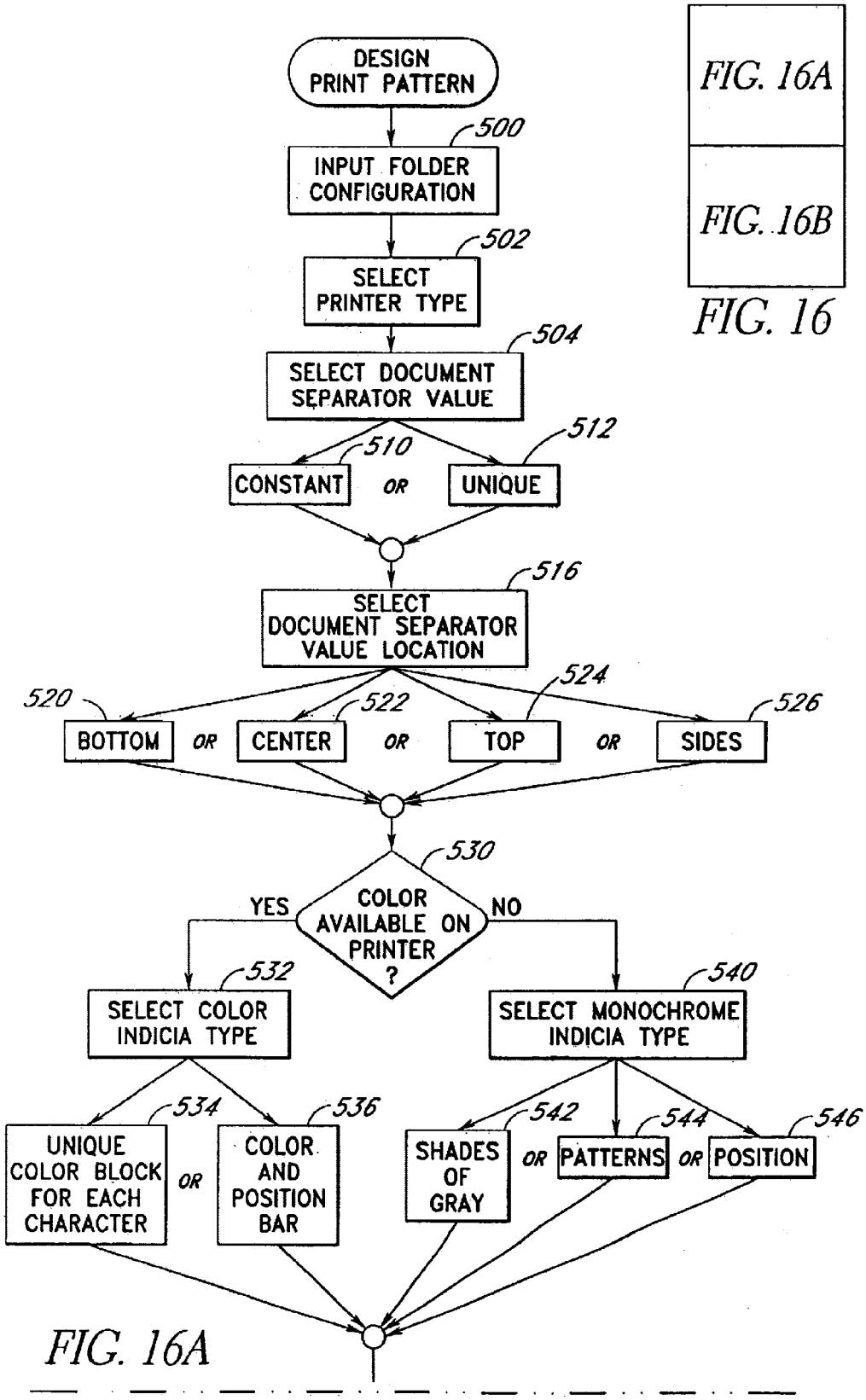
FIGS. 16(*a*) and (*b*) are subroutine-level flowcharts for designing a print pattern for printing the improved folder from application-specific parameters.
Figure 16B:
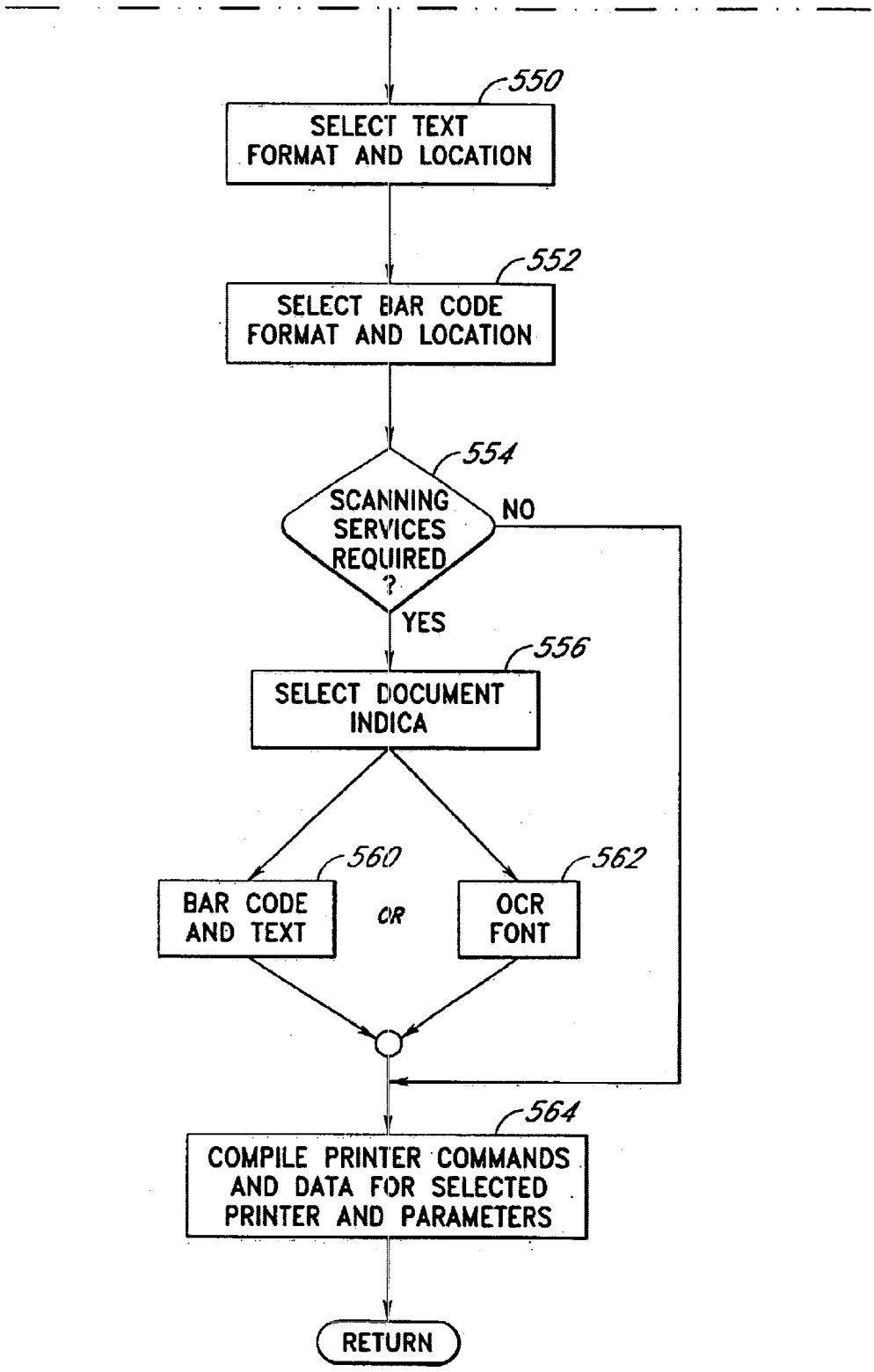

Referring to FIG. 16, the print pattern design begins with the specification of the folder configuration 500 and specific printer 502 used. As noted below, the improved folder can be used as a document separator during scanning. This is accomplished by printing a document separator value on the folder which can be recognized by the scanner. A particular document separator value 504 is also specified. There may be no document separator value 506 if scanning is not contemplated. The document separator values may be constant 510 or may be unique to each folder 512. Next, the document separator value location is specified. The document separator value can be printed on the bottom 520, center 512, top 524 or sides 526 of the folder front panel. If color is available on the printer 530, the particular color tab indicia type is specified 532. A unique color block assigned for numerics 534 or color and position bar indicia 536 may be specified. If color blocks are specified, block quantities, sizes and positions are specified. If color is not available, a monochrome indicia type 540 is selected. Monochrome blocks assigned to numerics can be shades of gray 542 or patterns 544. A monochrome tab and position bar 546 can also be used. After the indicia type is specified, the format and location of folder identifying text on the tab is selected 550. Likewise, the folder identifying bar code format and location is selected 552. If scanning services are required 554, folder labels are printed on the folder front panel. The document identifying indicia used on these labels is selected 556. These may be bar code and associated text 560 or an OCR font 562. Once the front panel, tab and document label indicia are specified, a corresponding sequence of printer commands and data for the selected printer is compiled 564, completing the pattern design.

Referring back to FIG. 14, once the physical folder is configured 440 and the print pattern is designed 490, the next step depends on whether this is a file conversion, that is whether this is an existing filing system to be converted to an improved filing system using the improved folder of the present invention, or whether these documents are being filed for the first time. Converting from an existing filing system without sequenced folders or indexed documents to a system with these features using separate processes for printing document and tab labels, matching labels to folders and to documents, and applying labels is very time consuming. Similarly, creating a filing system with these features from the beginning is time consuming. Because all identifying indicia required are printed on each individual, improved folder according to the present invention, the labor intensive aspects of file conversion or creation are eliminated.

If this is a file conversion 580, and the information regarding each folder is maintained on an existing database 582, there is only a need to verify that the database entry is correct 584. Otherwise, identifying information for each folder to be created is entered into a database 586. With this database entry, the remaining folder-specific information is available to the print pattern. Thus, the next step is to print the folder 590. After printing, the folder is assembled with tabs sealing the folder ends 592. Documents to be stored in the folder are inserted into the folder pocket 594, and the folder is stored 596. If filing is complete 600, that is, if all documents are stored into an improved folder, then the process is finished. Otherwise, another folder is begun, starting with database entry verification 584 or creation 586. There may be uses for the improved folder not involving a mass file conversion, where there is simply an advantage in using the improved folder as a tool in the daily process of adding new folders and new documents to the folders. For such uses, there is no database or, alternatively, the database can be considered as having a single entry or a small number of entries.

The image capture process using conventional folders which require documents to be removed from their folders, document separators inserted, a scanning process performed and then the documents reunited with their folders is prone to mixing the wrong folders with the wrong documents. The image capture process of the present invention eliminates this risk by advantageously using the improved folder according to the present invention as a document separator. The improved folder, which is sufficiently thin to pass through a conventional scanner and is printable, is printed with a document separator value which designates it as a document separator and distinguishes it from other documents. Using the improved folder in this manner maintains the folder in close proximity to the documents normally stored in folder while those documents are being scanned.

Figure 17:
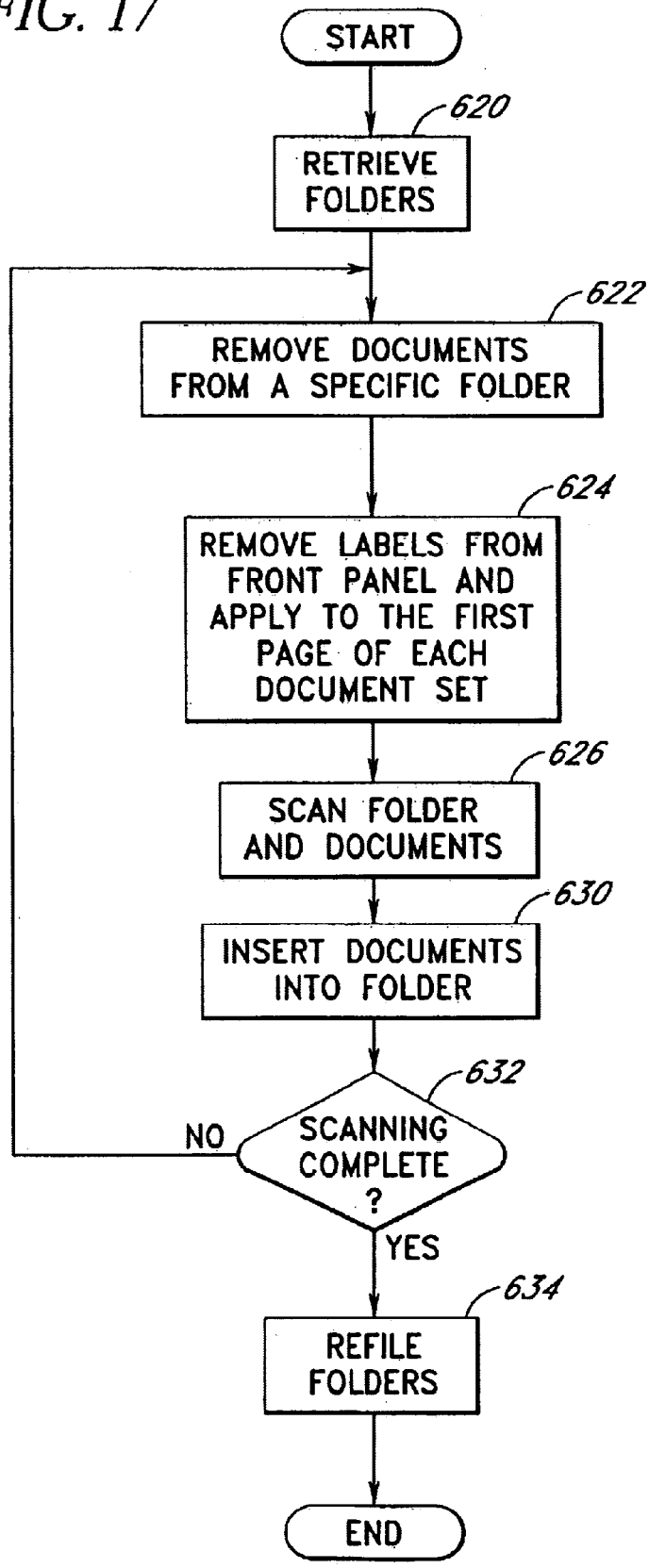
FIG. 17 is a top-level flowchart for utilizing the improved folder to assist document preparation and scanning when optically-stored filing is used.

In FIG. 17, the process of utilizing scanning services with the improved folder is shown. First, the folders to be scanned are retrieved from storage 620. A specific folder is identified and the documents within are removed 622. The document labels on the folder front panel are removed and applied to the first page of each corresponding folder document 624. Next, the documents and folder are scanned together 626, with the folder acting as a document separator from documents contained in the next folder. After scanning, the documents are reinserted into the folder 630. This task is simplified because a folder is scanned with its documents, alleviating the need to match a stack of scanned documents with a stack of empty folders. If all folders have been scanned 630, the folders are refiled or destroyed 634. Otherwise, the next folder to be scanned is identified and the documents removed 622.

With reference again to FIG. 6(*a*), a series of file folders in a typical bulk-storage arrangement is illustrated. In such an arrangement, the edges of the file folders are desirably visible, thereby rendering any identifying-indicia on the edges of the file folders visible as well. As can be best seen from FIGS. 6(*b*) and 6(*c*), when a file folder contains non-uniform identifying-indicia (as does the $8^{th}$ file folder in FIG. 6(*b*)), this discrepancy desirably will become immediately apparent to a casual observer, indicating that the file folder is out of place. The file folder then can be removed from its misplaced position in the bulk storage and can be refiled in its proper position. Without such an indexing system, it is quite possible that misfiled folders will only be located during a comprehensive search of the entire bulk storage location, an expensive and time consuming proposition at best.

Unfortunately, as the above-discussed example illustrates, the identifying indicia used in the arrangement of FIGS. 6(*a*)–(*c*) is highly position-dependent. In other words, a misplaced file can be casually identified only if the identifying indicia of the misplaced folder does not properly align with the indicia of the remaining file folders. Where the file folders themselves are misaligned, however, such as when the file folder is not pushed all the way into the folder stack or all the way down onto the shelf, the resulting misalignment between the file folders can result in false readings. To reduce the likelihood of the false readings, additional space can be provided between the identifying indicia. In addition, the identifying indicia can be enlarged such that slight variations in spacing will not result in false readings. Of course, while each of these solutions reduces false readings, they also concurrently reduce the amount of information that can be printed on the top or edge tab. Thus, while the arrangement in FIGS. 6(*a*)–6(*c*) is suitable for some applications and some slight variations are acceptable for other applications, a further improvement is needed that lends itself to use in high-volume storage locations.

Figure 18A:
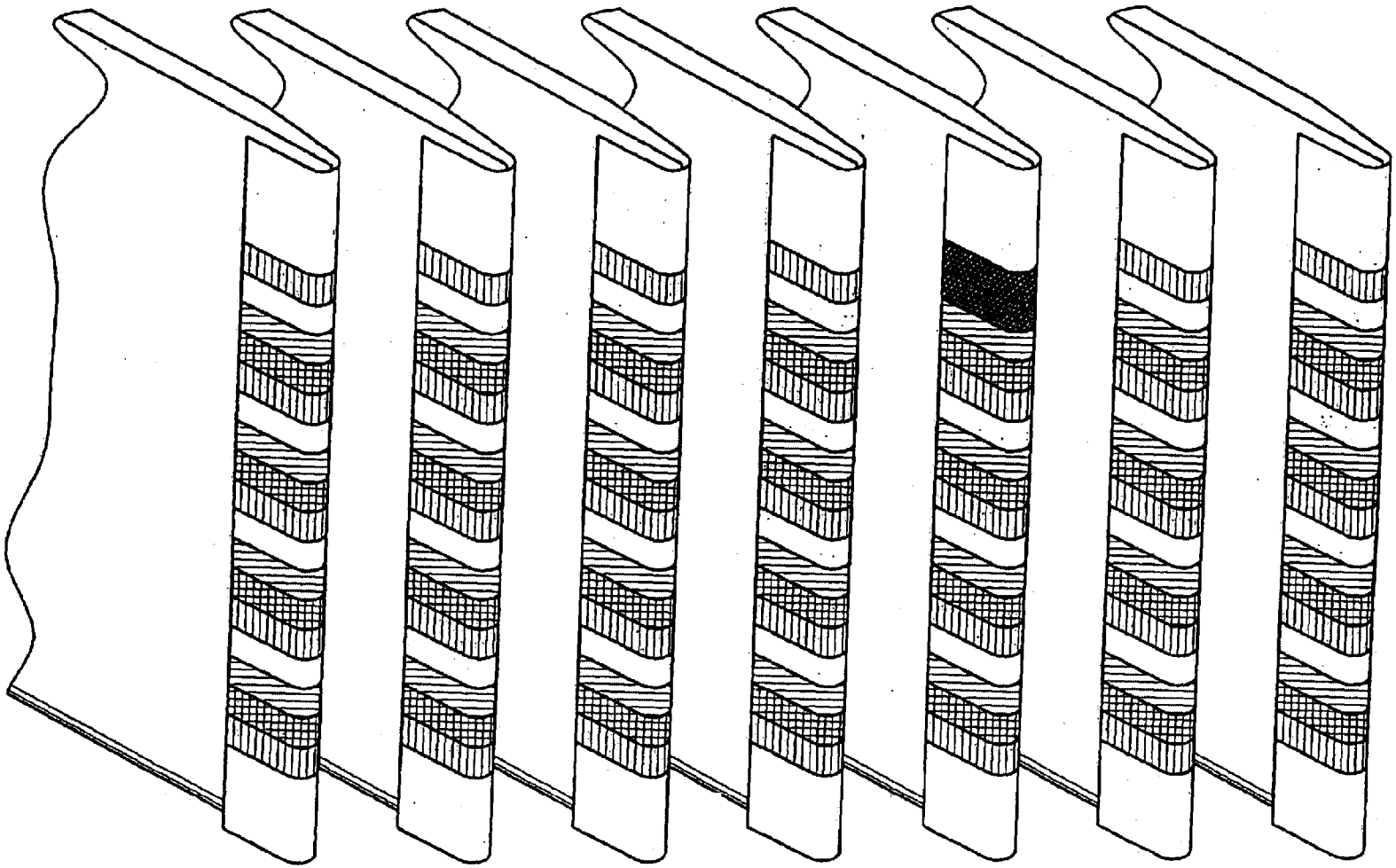
FIG. 18(*a*) is a perspective view of a pair of file folders constructed assembled from printable folder blanks having certain features, aspects and advantages in accordance with the present invention. A multi-color identifying indicia strip was unaltered during printing of the folder on the left and the multi-color identifying indicia strip was altered during printing of the folder on the right.
Figure 18B:
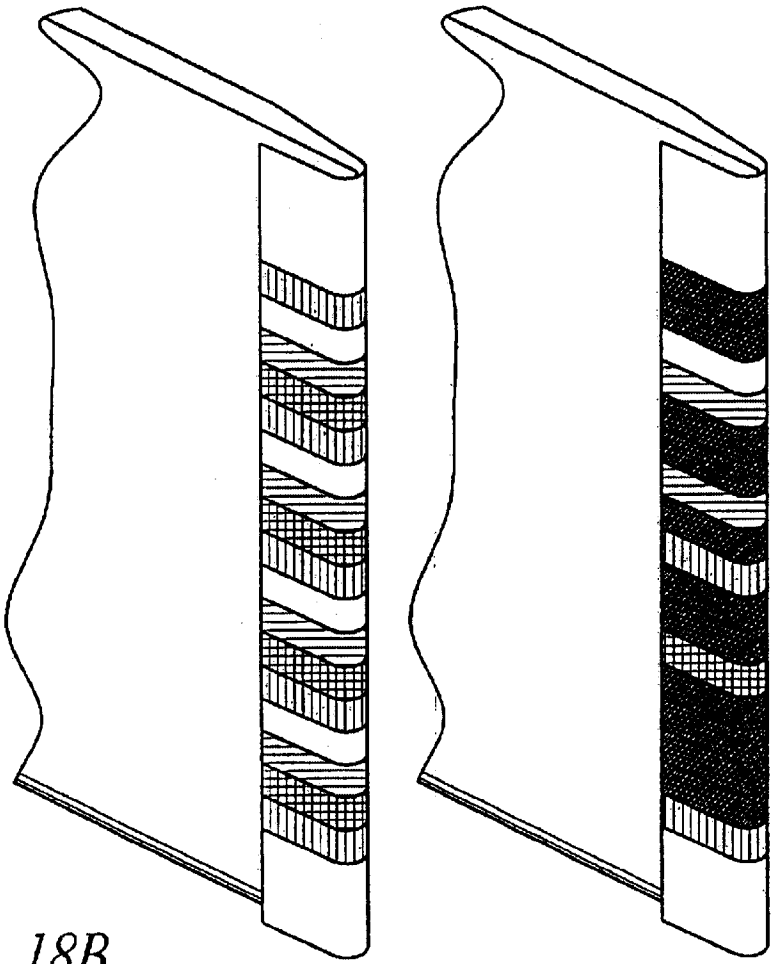
Figure 19A:
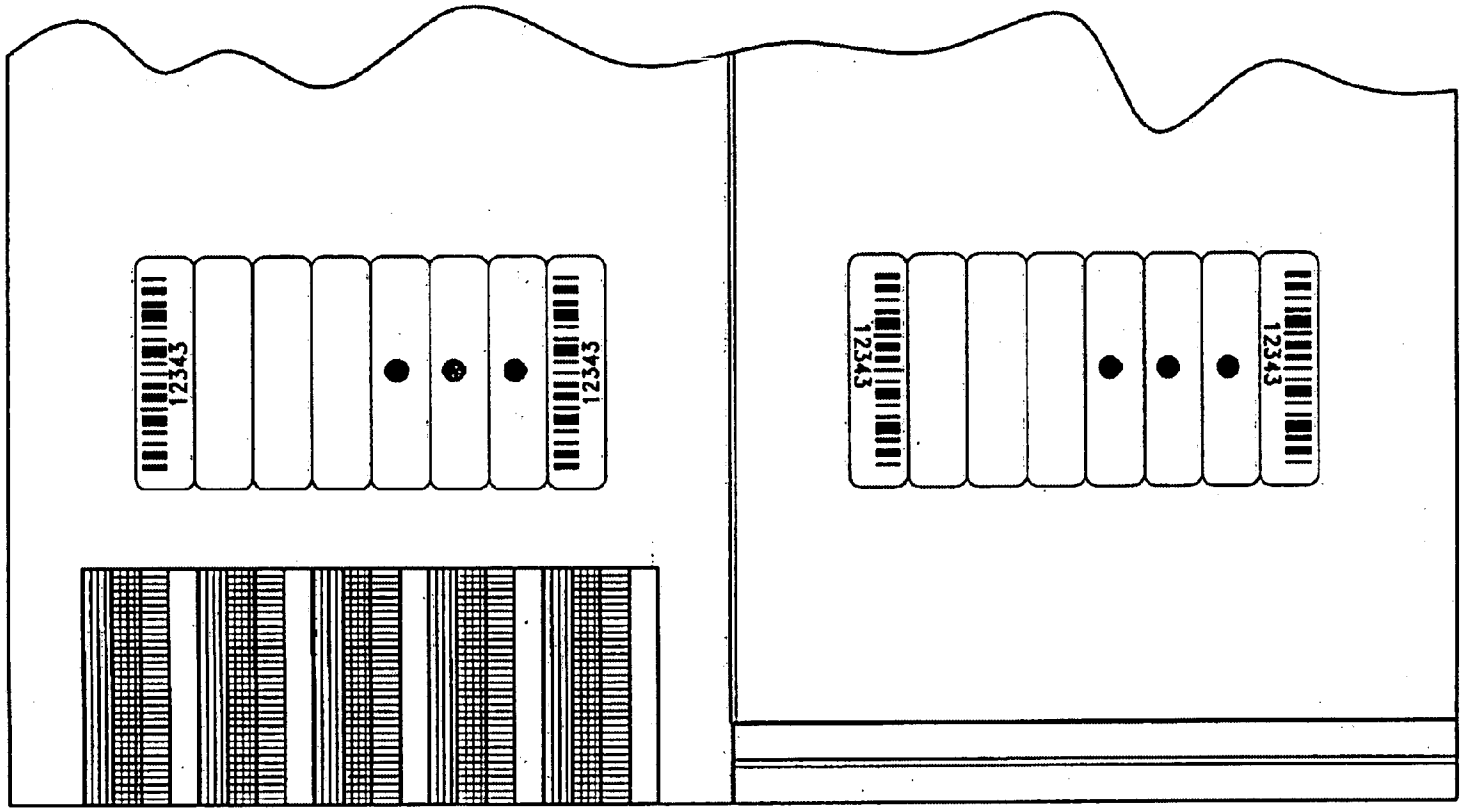
FIG. 19(*a*) is a plan view of a file folder blank having certain features, aspects and advantages in accordance with the present invention. The file folder blank comprises the multi-color identifying indicia strip and the illustrated file folder blank has not been individualized.
Figure 19B:
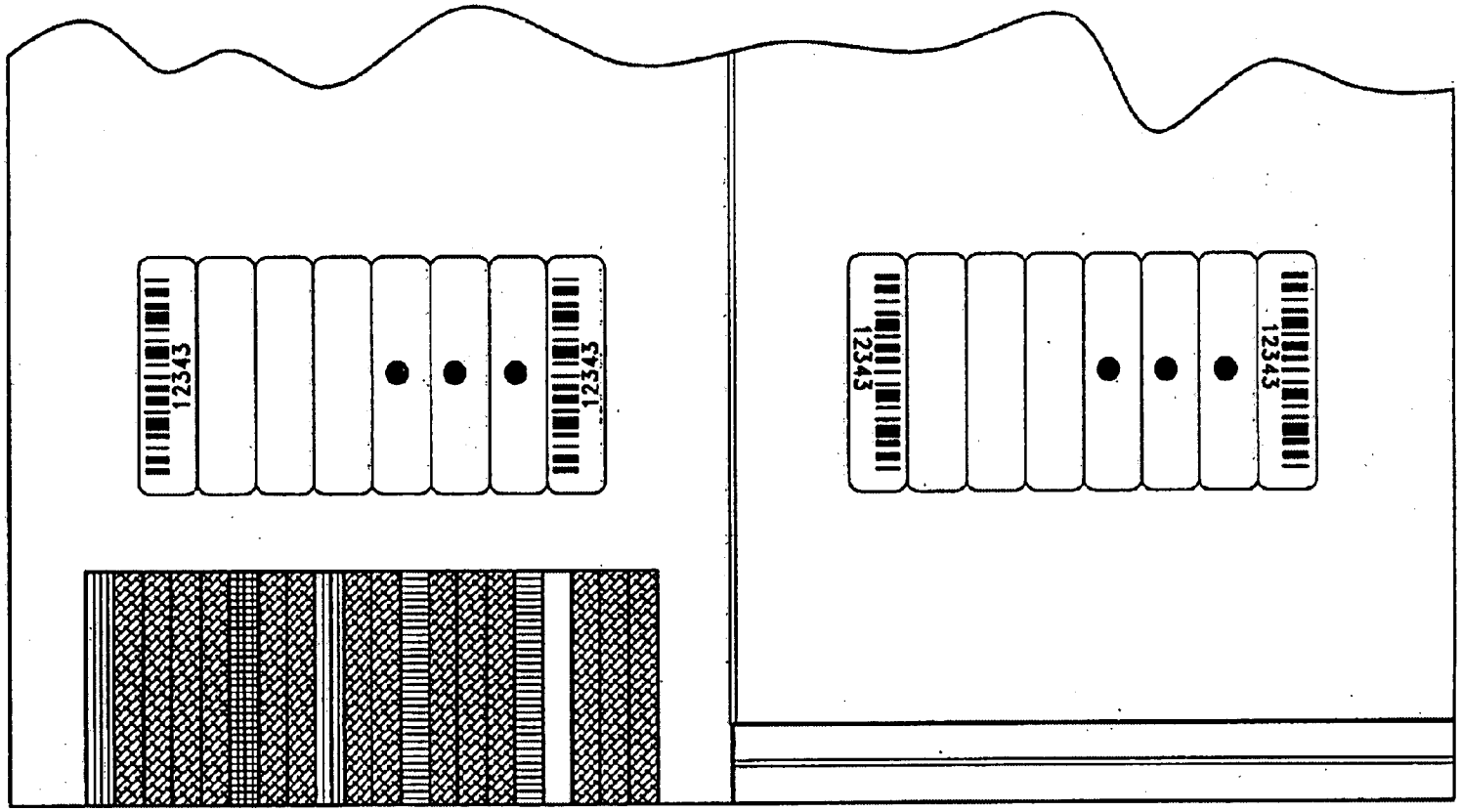

Accordingly, FIG. 18(*a*) depicts one such improvement. The illustrated arrangement incorporates a preprinted series of color-coded identifying-indicia. Preferably, the indicia are provided along the foldable top tab or the foldable end tab, depending upon the type of file folder or file folder blank being used. The indicia advantageously can be preprinted on the file folders during the manufacturing process or can be added to the file folder blanks prior to processing. Desirably, the indicia is printed using a low-cost screening process, which is particularly well suited to printing four distinct colors (i.e., three colors plus the original color of the file folder) on the surface of the file folder. In the illustrated arrangement, the four pre-printed colors can be red, yellow, blue and white. Of course, any number of colors and any chosen colors can be used depending upon the application. In addition, the folder color may or may be one of the colors as desired.

While the file folder is being customized or individualized to reflect the documents contained therein, a monochrome printer can print over various portions of the color bars, covering these sections of the color bars with black ink while leaving the remaining color bar sections visible. This results in an individualized multi-color identifying indicia strip. If desired, a single set of four color-bars can correspond to a number or letter code, such as, for example:

| LETTER | NUMBER | RED | YELLOW | BLUE | WHITE |
|---|---|---|---|---|---|
| A | 0 | covered | covered | covered | covered |
| B | 1 | | covered | covered | covered |
| C | 2 | covered | | covered | covered |
| D | 3 | covered | covered | | covered |
| E | 4 | covered | covered | covered | |
| F | 5 | | | covered | covered |

-continued

| LETTER | NUMBER | RED | YELLOW | BLUE | WHITE |
|---|---|---|---|---|---|
| G | 6 | | covered | | covered |
| H | 7 | | covered | covered | |
| I | 8 | | | covered | |
| J | 9 | covered | | | covered |

Because color printers tend to be slower than monochrome printers, monochrome printing of the color-coded indicia advantageously achieves faster printing throughput of the folders than color printing. Of course, it should be recognized that a color printer can be used to individualize the folders as well. Moreover, it is anticipated that any number of grayscale bars can be used in place of the color-bars, if desired. It is preferred to use vividly contrasting colors for reasons that will be apparent; however, the use of grayscale bars can allow more rapid preparation of the file folders in some applications. Furthermore, it should be recognized that varying numbers of color can increase or decrease the available combinations (i.e., 4 colors=16, 5 colors=25, etc.).

When the file folder is assembled, the printed color-bars desirably are positioned along the top or side of the file folder with the color-bar being visible within the array of file folders. An example of such an arrangement is illustrated in FIG. 18(*b*). File folders that are properly filed will incorporate common identifying-indicia, which are desirably uniform along the top or edge of the folder. Because the disclosed identifying-indicia are color-coded, and are not solely position-dependent, misaligned folders can be quickly identified and replaced based on color alone. This is possible because while misfiled folders will become immediately apparent by both their non-uniform color coding and positioning.

While the arrangement of FIGS. 6(*a*)–6(*c*) results in closely grouped identifiers, the arrangement of FIGS. 18(*a*)–19(*b*) results in spaced color patterns. Thus, slight misalignments still produce the same color patterns in the same relative positions. Moreover, because each color in the color bar is spaced apart by other colors before it repeats, the multi-color groupings can remain closely arranged which allows a larger number of groupings to be compressed together along end or top of the file folder. As will be appreciated, the close placement of adjacent color grouping results in a significant increase in the amount of information that can be contained on the top or side of the file folder thereby allowing a greater number of easily-identifiable codes to be utilized in the indexing-system for a given amount of surface area as compared to arrangement illustrated in FIGS. 6(*a*)–6(*c*).

Figure 20:
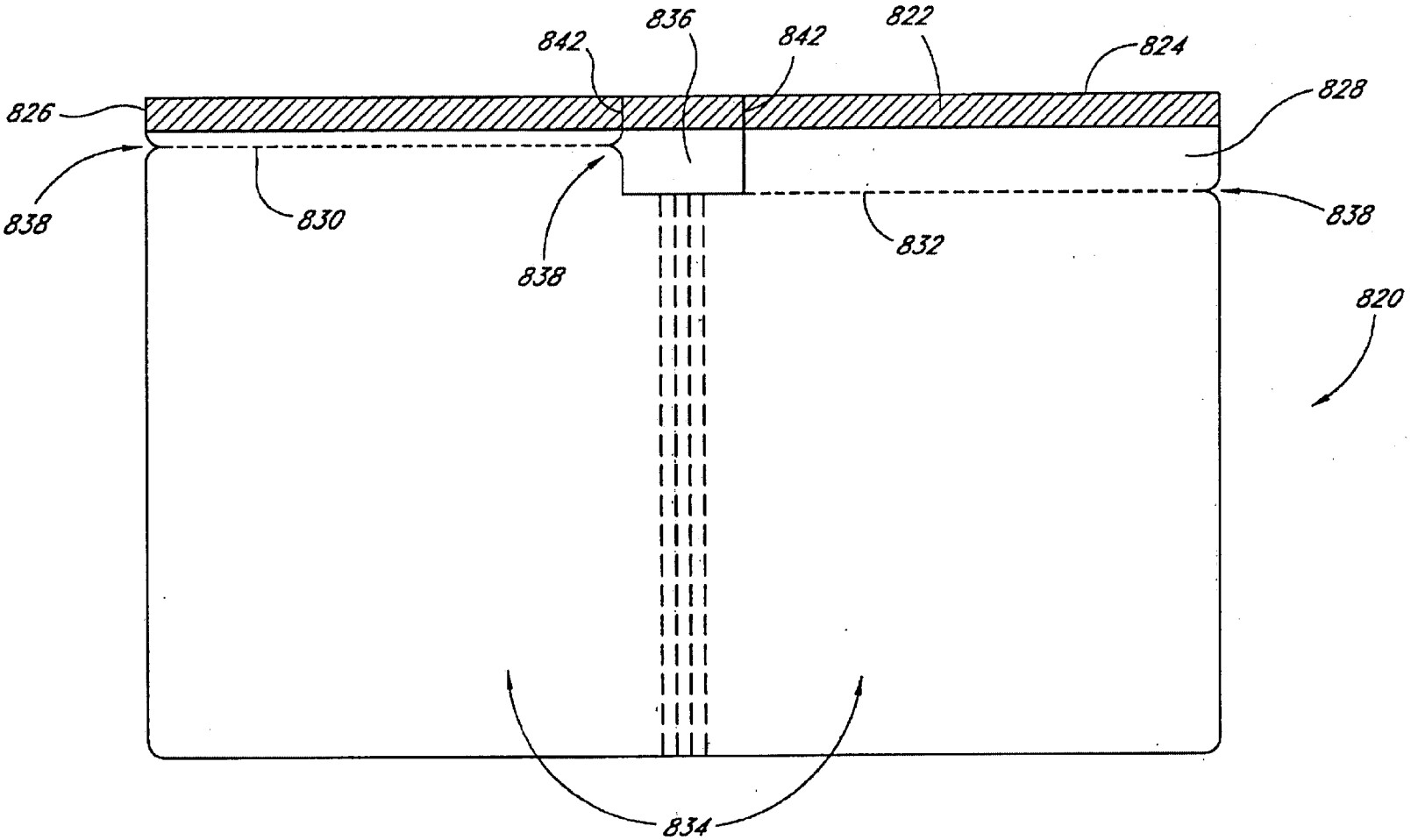
FIG. 20 is a plan view of an inside of a printable folder blank arranged and configured in accordance with certain features, aspects and advantages of the present invention.
Figure 22:
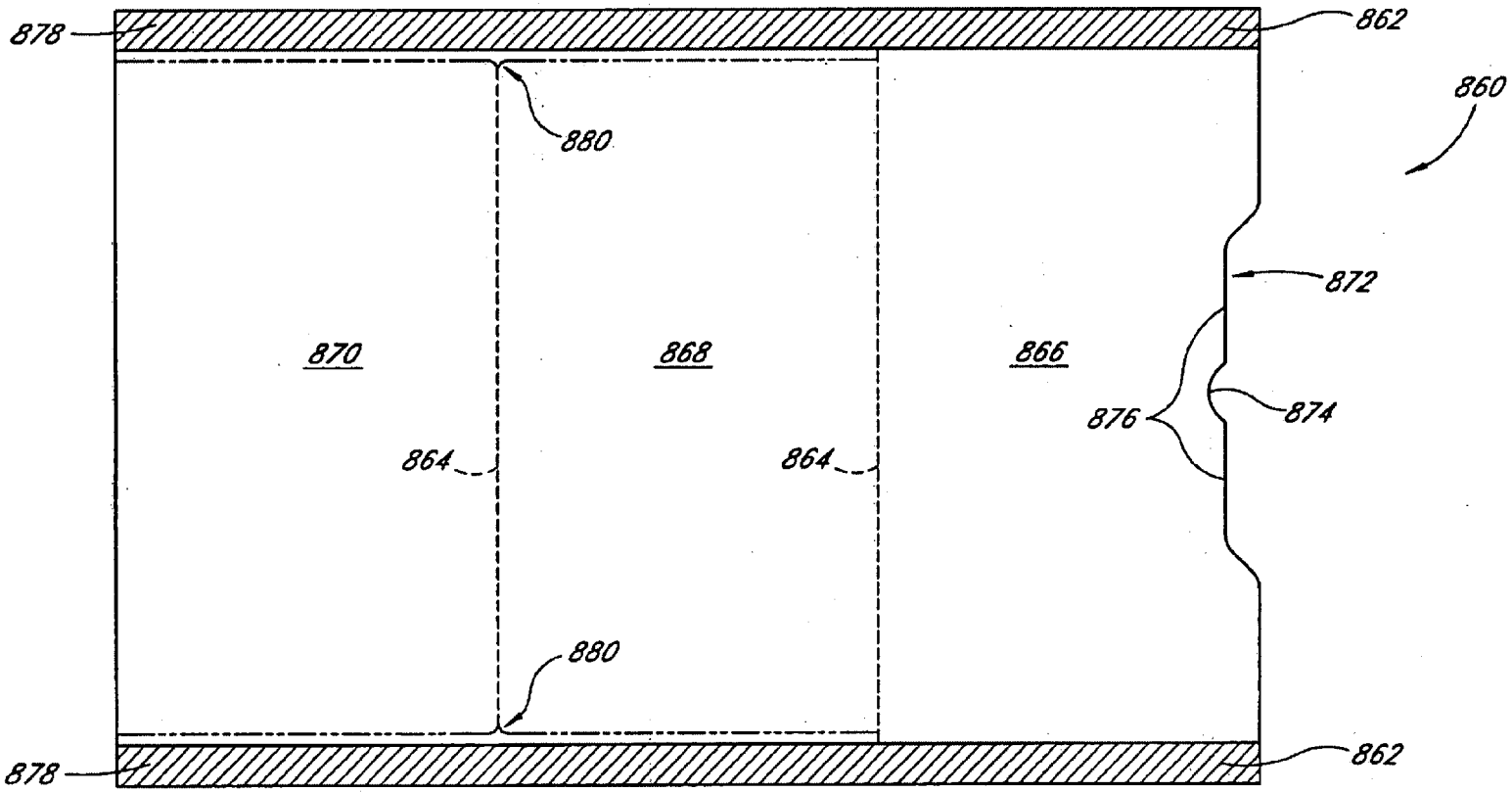
FIG. 22 is a plan view of an inside of another printable folder blank arranged and configured in accordance with certain features, aspects and advantages of the present invention.

With reference now to FIGS. 20 and 22, another set of exemplary folder blanks are illustrated therein. The folder blanks are but two more examples of folders that have certain features, aspects and advantages in accordance with the present invention. While the present invention will be described in the context of these folder blanks as well as those discussed above, it is anticipated that certain features, aspects and advantages of the present invention may be found in other folder blanks not distinctly described herein. In addition, it should be apparent that several of the features, if not all of the features, that will be described or that have been described, with reference to a particular folder blank or folder can be incorporated into any of the other folders that will be described or that have been described even though the possibility is not specifically mentioned in the description of that folder blank, folder or feature.

With this being said, all of the folder blanks described herein advantageously can be used with standard printers on the market. The printers can comprise most desktop or business type of printers. For example, an Epson 1160 printer can be used to print the folder blanks arranged and configured in accordance with certain features, aspects and advantages of the present invention. The printers can provide printing on a single side of the folder blank although printing on both sides of the completed folder is desired. In fact, the printers can be used to print on a single side of a single panel of the folder blank even though printing on both sides of the single panel of the folder blank is desired. This configuration greatly reduces manufacturing costs and allows end-users to implement a standard printer rather than having to invest in an expensive dedicated printer or having to purchase pre-printed forms. Moreover, double-sided printers do not have to be implemented to achieve dual sided characters on the completed folders when folder blanks arranged and configured in accordance with certain features, aspects and advantages of the present invention are used.

With particular reference now to FIG. 20, a folder blank, which is generally identified by the reference numeral 820, is illustrated therein. This folder blank design allows printing on at least one side prior to folding. More preferably, this folder blank design only allows printing on at least one side that will be visible when the folder is completely folded and documents are properly positioned within the folder. As discussed above, the folder blank can be printed in accordance with any desired identifiers, color-coding schemes or the like. Some exemplary printing schemes and techniques have been described above.

In addition, the folder blank can include locations for printing of images, graphs, graphical illustrations or pictures, for instance. In fact, a photo quality paper stock can be embedded in any desired location, such as that indicated at 848 on FIG. 21, for instance. The photo paper stock can be embedded in any suitable manner or can be adhered or otherwise attached to the folder blank for use during printing. The photo paper stock allows high resolution graphics to be directly printed on the folder blank while the folder blank is being individualized.

Moreover, the folder blank can receive pre-printed or printed location identifiers for fasteners. For instance, two prong fasteners often are used to attach documents to file folders. The two prong fasteners can extend through a portion of the file folder blank or can be adhered to the folder blank. Advantageously, providing graphical indicia indicating preferred locations for the fasteners can improve the uniformity from file to file.

Furthermore, to emphasize some of the printing options discussed above, the folder blank can received labels that are embedded into the file folder blank and that can be custom printed. Again, the labels can be embedded in any suitable manner, including the manner discussed above. Upon removal of the labels, a backing portion preferably remains to maintain the structural integrity of the folder. In other words, when the labels are removed, the backing helps ensure that an opening or hole is not formed in the folder. Of course, the removable piece can be labels in some applications or can be other items, such as maps, pictures, graphs or the like. Also, alphanumeric, bar codes, or other identifying information can be printed on the file folder, such as, for example but without limitation, locations in which the file folder should be stored, where the file folder is located (i.e., a series of office numbers that can be selected for scanning by a hand-wand) and the like. Furthermore, any desired forms, blank or completed, can be printed directly on the file folder. In applications in which a two sided printing operation is used, any desired indicia can be directly printed on the inside of the file folder, as well.

With continued reference to FIG. 20, the blank 820 preferably comprises a self-adhesive strip 822 along one edge 824. As will be described, the adhesive strip 822 in the illustrated arrangement extends along the edge 824 that a tab end 826 and a reinforcing front flap 828 are formed along. The adhesive strip 822 desirably includes an easily removable backing strip that can be removed to expose the adhesive portion of the adhesive strip 822. It is anticipated that the adhesive strip can be formed in any suitable manner.

In addition, while the illustrated adhesive strip 822 is disposed along the edge 824, it is envisioned that the adhesive strip can be disposed in other regions of the blank 820. For instance, a pair of weakened fold lines 830, 832 are formed in the illustrated blank 820. The fold lines 830, 832 can be formed in any suitable manner. The fold lines 830, 832 define, at least in part, the tab end 826 and the reinforcing front flap 828. Accordingly, the adhesive strip can be disposed along either or both fold lines 830, 832, such that when the tab end 826 is folded against the main body 834 of the blank 820 and when the reinforcing front flap 828 is folded against the main body 834 of the blank 820, the tab end 826 and the front flap 828 are secured in position. Preferably, the tab end 826 and/or the front flap 828 extend into the interior of the file folder some distance to better reinforce the corresponding portions of the associated file folder.

With continued reference to FIG. 20, the folder blank 820 preferably includes a removable tear away portion 836. In the illustrated arrangement, the tear away portion 836 is defined between the tab end 826 and the front flap 828. In some arrangements, the tear away portion 836 can encompass the front flap 828 such that the tear away portion 836 and the front flap 828 can be removed from the main body 834 of the blank. It is presently preferred, however, that the front flap 828 remain attached to the main body 834 of the blank to reinforce the folder, once assembled, and to reduce waste resulting from the assembly process. In addition, it should be noted that the tear away portion can comprise labels or other information that can be applied to documents or the folder after being removed from the folder blank. Thus, the labels or other information can be printed during the individualizing of the file folder blank.

It should be noted that a number of radiused corners 838 are provided in the blank 820. The corners 838 can be formed with the initial outline of the blank 820 or can result from the tear away portion 836. The rounded corners 838 reduce snagging and accidental destruction of the files during use. In addition, the rounded corners 838 preferably are formed on the portions of the file folder that advantageously are reinforced during the formation of the folder. Furthermore, rounding corners as fold locations insets the fold from the edges to reduce undesired and accidental snagging of the folder that can cause tearing of the folded portions of the folder.

With continued reference to FIG. 20, the folder blank 820 also can include at least one center fold line 840 and preferably more than one center fold line 840. The fold line or fold lines can be weakened to encourage accurate folding and can be formed in any suitable method. Preferably, the fold lines 840 are disposed along a portion of the folder blank 820 that is juxtaposed with the location of the tear away portion 836. This configuration advantageously raises the lowermost edges 842 of the tab 826 and the front flap 828 above the portion of the assembled folder that will rest on a shelf when stored on end.

Figure 21:
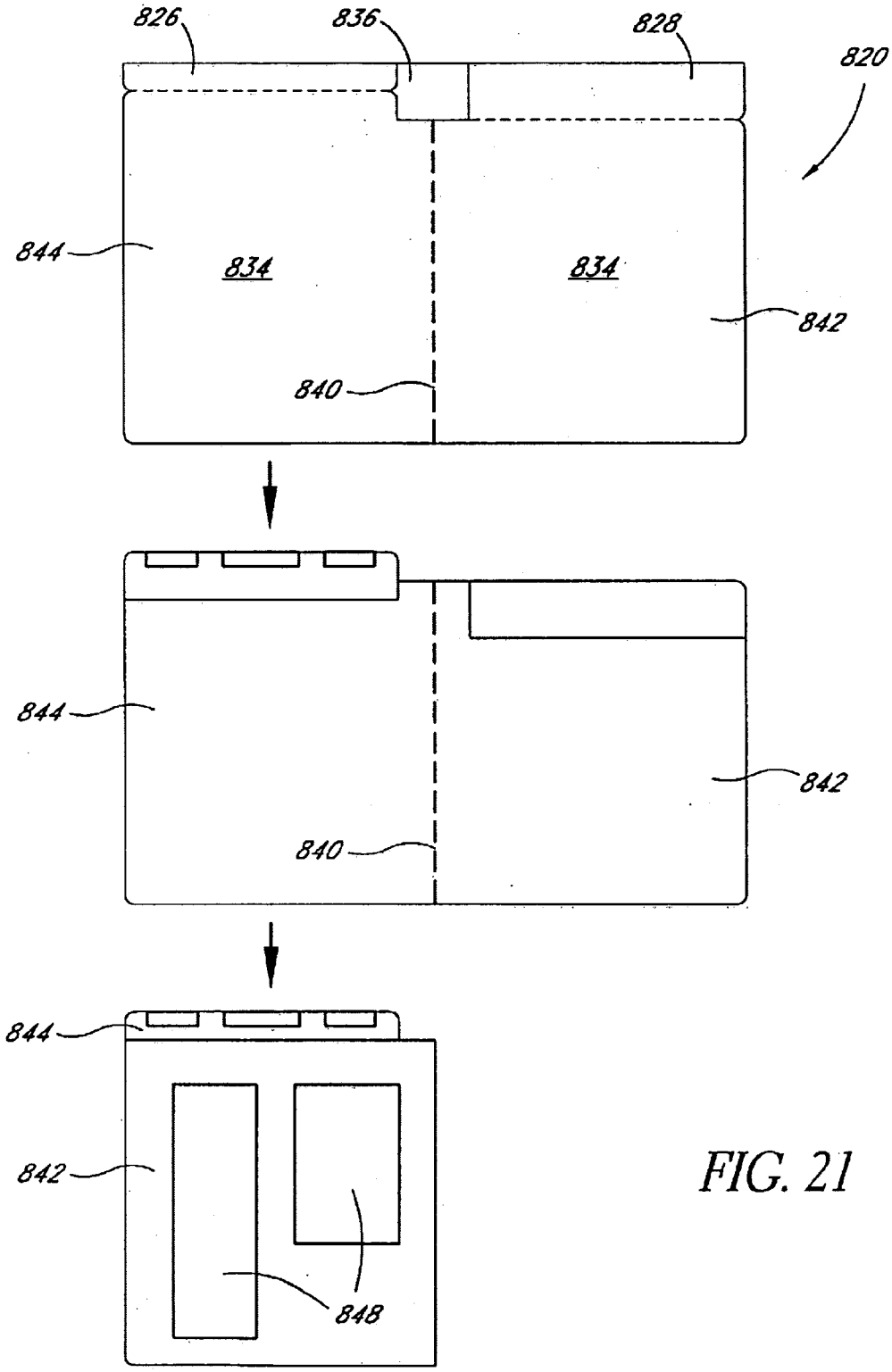
FIG. 21 is a folding diagram that illustrates an assembly process for a folder created by the printable folder bank of FIG. 20.

With reference now to FIG. 21, an assembly process for the folder blank 820 is illustrated therein. As illustrated, the tear away portion 836 can be removed and the tab 826 and the front flap 828 can be folded down against the main body 834 of the blank 820. Preferably, the backing layer of the adhesive strip 822 is removed and the tab 826 and the front flap 828 are secured to the main body of the blank 820. This results in reinforcement of the folder along these edges. Additionally, because the presently preferred folder will be pre-printed on the outer surface, folding a portion of the tab 826 in the manner described provides printing on surfaces facing two sides of the assembled folder although only a single side of the presently preferred folder blank 820 was printed. Furthermore, the assembled folder will comprise a front panel 842 and a back panel 844 with the back panel comprising the folder tab 826 and the back panel will have printing on two sides although only a single side of the presently preferred folder blank 820 was printed.

The folder then can be folded along the center fold line 840 or the selected one or ones of the center fold lines 840. Once again, by folding the folder blank in this manner, printing is provided on both outer surfaces of the folder even though only a single side of the folder blank was printed. Thus, the front panel 842 and the back panel 844 both have printing on an outer surface and the back panel has printing on an inner surface as well. Of course, if the front panel 842 had an exposed inner surface or if printing on the inner surface were desired, such a configuration could be accomplished in a manner similar to that described above. Of course, the illustrated arrangement clearly depicts printing of indicia 846 on the inner surface of the tab 826 that is formed on the back panel 844 and printing of indicia 848 on the outer surface of the front panel 842.

With reference now to FIG. 22, another folder blank 860 is illustrated therein. The illustrated folder blank can be used to form a custom printed pocket-type folder. Accordingly, the folder blank 860 advantageously comprises a pair of self-adhesive strips 862. The self-adhesive strips 862 can be similar to those described above. Preferably, the self-adhesive strips 862 are such that the folder blank 860 can be manufactured at the manufacturing facility and the end-user need only print on the folder blank 860, if desired, and remove a removable backing strip to use the self-adhesive strips 862.

As will be appreciated, the illustrated folder blank 860 is a tri-fold type of folder blank and, as such, comprises a pair of weakened fold lines 864. Preferably, the weakened fold lines 864 extend generally perpendicular to the adhesive strips 862 for reasons that will become apparent. Additionally, in the illustrated arrangement, the weakened fold lines are positioned such that a front flap 866 is shorter than a back flap 868 and/or an intermediate flap 870. Thus, in the illustrated arrangement, the back panel which is formed by the back flap 868 and the intermediate flap 870 is slightly longer than the front panel which is formed by the front flap 866. Additionally, the front flap preferably includes a contoured edge 872 to provide easier access to materials positioned within the assembled folder. For instance, the contoured edge 872 can include a finger notch 874 and a shorter central region 876 that provide easier access to the contents of the assembled folder. Of course, in arrangements that use the front flap 866 and the back flap 868 to form the front panel of the assembled folder, the contoured edge would be positioned along the fold line 864 separating the two flaps 868, 870.

With continued reference to FIG. 22, the illustrated folder blank 860 also comprises a pair of tear away portions 878.

The tear away portions 878 in the illustrated arrangement extend along a portion of the adhesive strips 862 and are illustrated with phantom lines. The illustrated tear away portions 878 comprise notches 880 that create aesthetically pleasing rounded upper corners to the assembled sleeve folder. Of course, the rounded corners could be replaced by slanted, angled, or otherwise contoured corners and the corners could remain square in some applications. The tear away portions allow the portion of the back flap 868 that contains the adhesive strips 862 to be folded over a portion of the front panel (i.e., the combined front flap 868 and the intermediate flap 870) to better secure the front panel to the rear panel. Of course, in some applications, the tear away portions can remain attached to the main body of the folder blank and the front panel and the rear panel can be directly bonded to each other.

Figure 23:
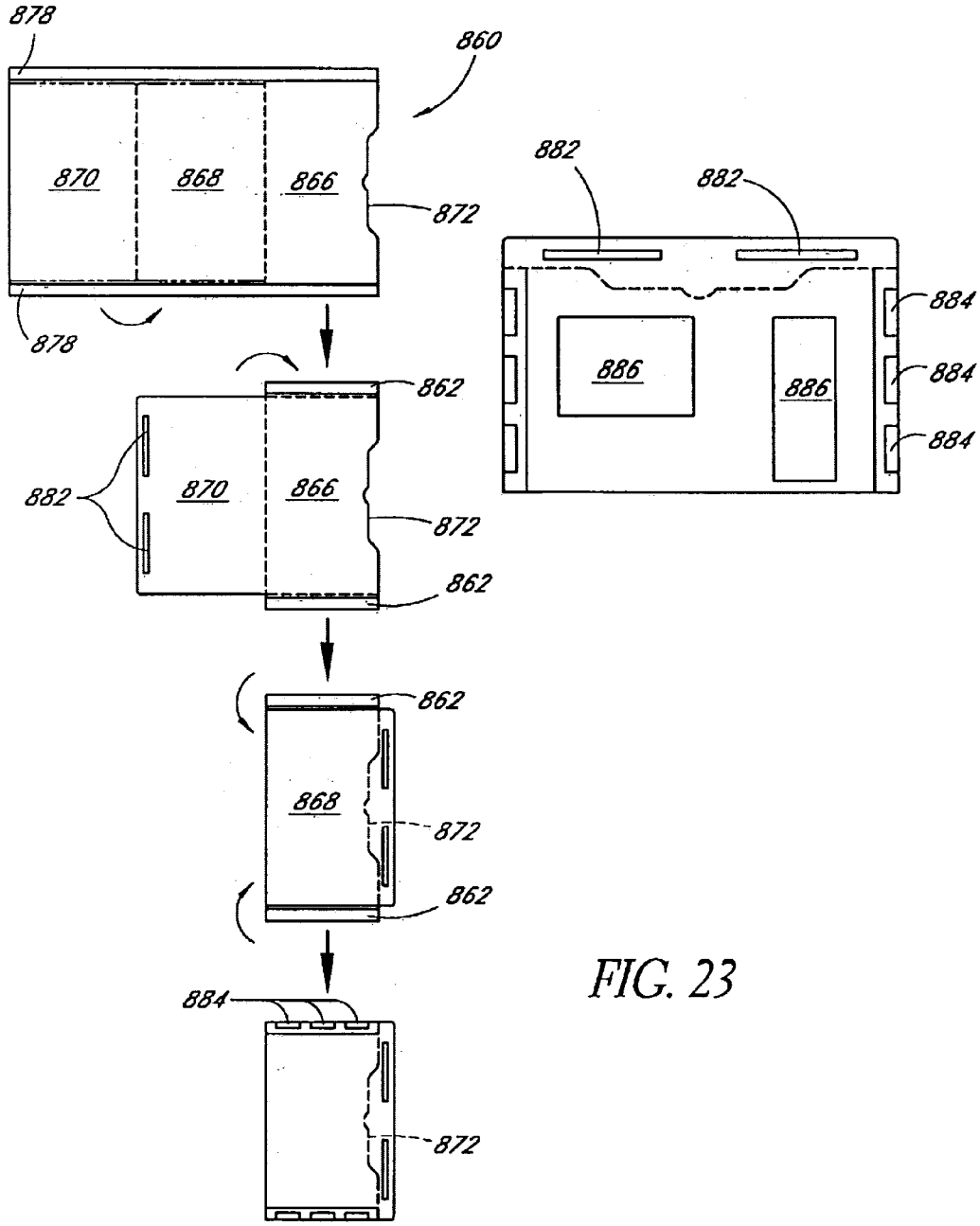
FIG. 23 is a folding diagram that illustrates an assembly process for a folder created from the printable folder blank of FIG. 22.

With reference now to FIG. 23, a presently preferred assembly process for the illustrated folder blank 860 is illustrated therein. In the illustrated arrangement, the tear away portions 878 preferably are removed and the intermediate flap 870 is folded over the front flap 868. By folding the intermediate flap 870 over the front flap, printing on the back side (as illustrated) of the intermediate flap 870 is brought to the front side. Thus, a rear panel is formed with printing on two sides. The printing is schematically illustrated in FIG. 23 and indicated with the reference numeral 882.

After the rear panel has been formed in the illustrated process, the rear panel is folded to the front panel (i.e., the front flap 868). Preferably, the printing 882 extends above the contoured edge 872 such that the printing is visible above the contoured edge 872. The adhesive strips 862 then can be folded over the rear panel (i.e., the back flap 868) to join the front panel and the rear panel. While not described above, the backing strips can be removed from the adhesive strips at any point prior to the folding of the adhesive strips but the backing strips preferably are removed just prior to the folding of the adhesive strips 862 to reduce the likelihood that the strips bond to the wrong surface.

Notably, by folding the adhesive strips, that is the portions of the folder blank carrying the adhesive strips, over to bond the adhesive strips to the rear panel from the front panel printing on the back side (as illustrated) of the front panel can be viewed on the rear panel. This configuration allows printing on the edge of the assembled folder, as well as on the front panel and the rear panel to be perfectly aligned. Such indicia are schematically represented in FIG. 23 and are identified by the reference numeral 884 therein. Also, as illustrated in FIG. 23, printing can be positioned on the outer surface of the assembled folder. The printing is schematically illustrated in FIG. 23 and is identified by the reference numeral 886. Of course, this printing can be on the front of the folder, the rear of the folder or both.

Figure 24:
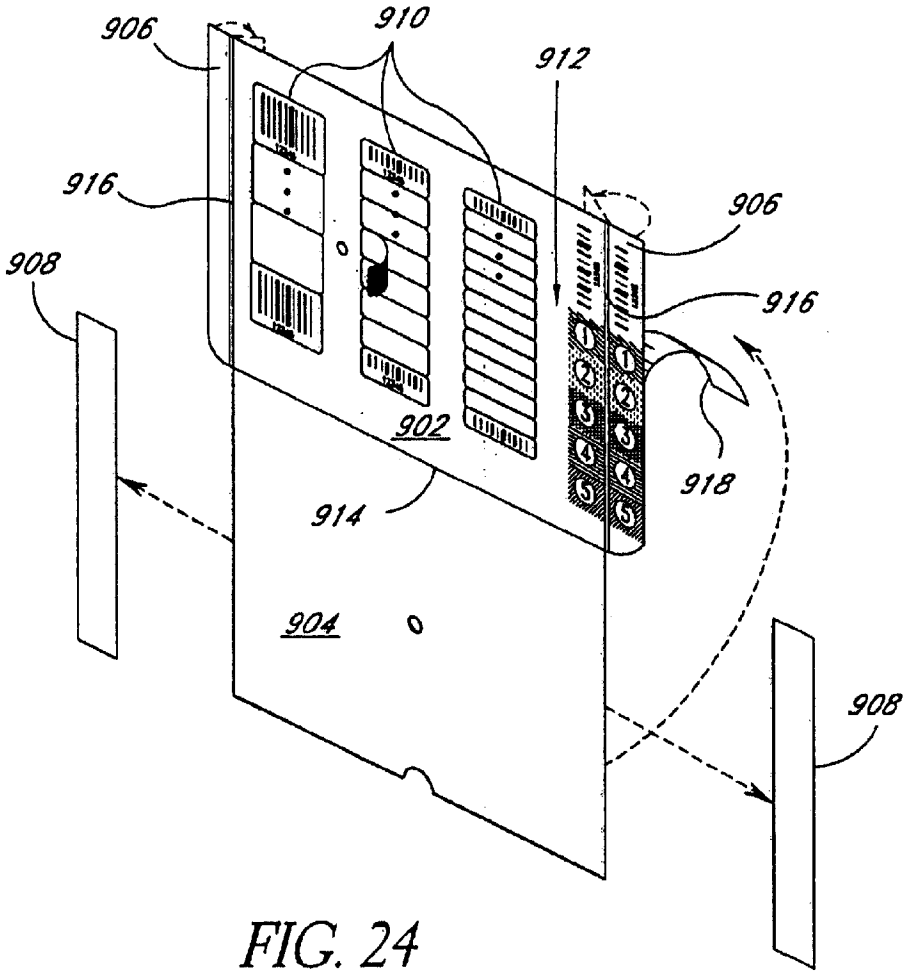
FIG. 24 is a perspective illustration of another printable folder blank arranged and configured in accordance with certain features, aspects and advantages of the present invention. Suggested folding movements of various portions of the folder blank are illustrated with the dashed arrows.

With reference now to FIG. 24, yet another construction of a folder blank is illustrated therein. Removal of certain portions and folding of other portions is illustrated with broken arrows in the figure. It should be noted that the illustrated arrangement of FIG. 24 incorporates curved foldable edges, such that when the file folder is assembled, the folded sections of the edges do not extend beyond the periphery of the file folder. Because these edges are recessed, the folded edges of the file folder are less likely to "catch" on other file folders when the file folder is removed and/or replaced into the bulk storage location, thereby significantly reducing wear on the file folder and reducing the chance of damage to the file folder. This feature can be used in any of the blanks described herein.

In this configuration, the folder blank 900 comprises a front panel 902 and a rear panel 904. The front panel 902 in the illustrated arrangement includes a pair of foldable wings 906. The wings 906 preferably comprise an adhesive strip or are sized and configured to engage with an adhesive strip positioned on the rear panel 904. The adhesive strip (not shown) can be arranged and configured in any suitable manner, including those described above.

In the illustrated arrangement, the rear panel 904 comprises a pair of tear away portions 908. Of course, in some applications, the rear panel 904 can comprise the wings 906 while the front panel 902 comprises the tear away portions 908 or one of each of the tear away portions 908 and the wings 906 can be disposed on each of the front panel 902 and the rear panel 904. Generally speaking, the tear away portions can be removed either by the end-user or as a manufacturing step performed prior to shipping. This can apply to any of the folder blanks discussed or inspired by the present disclosure.

In addition, the tear away portions 908 can comprise labels or the like, as suggested above. For instance, the blank can have labels embedded into the form proximate the tear away portions 908. Thus, at least some of the printed indicia of the file folder blank can comprise removable labels that are preformed into the blank in locations that can include the tear away portions 908.

With continued reference to FIG. 24, at least one of the panels receives printing on at least one side. Advantageously, printing upon one side at least one of the panels can result in the placement of printing on both sides of a folder assembled from the folder blank 900. For instance, in the illustrated arrangement, the front panel 904 receives indicia, which is indicated at 910, that can be positioned on tear away sticker portions or that can form a more permanent portion of the assembled folder. Additionally, the illustrated front panel 904 also receives indicia which is indicated at 912 and which can be viewed from the front of the folder and the rear of the folder. Advantageously, this allows substantially perfect alignment of the indicia on the front of the folder and on the rear of the folder.

In the illustrated arrangement, the rear panel 904 can be folded against the back of the front panel 902 along a fold line 914. In some arrangements, the fold line 914 is a preformed weakened line that substantially ensures proper folding of the folder blank 900. After the rear panel 904 panel 902 are folded together, the wings 906 are folded along respective fold lines 916 to secure the front panel 902 and the rear panel 904 together. Of course, an adhesive backing strip 918 preferably is removed just prior to the wings being folded to contact the rear panel but the backing strip 918 can be removed at any time.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combination or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A folder blank for a continuous-feed printer folder system, comprising:

a plurality of alternatingly sequentially connected first panels and second panels, said first panels being detachably connected to said second panels in pairs, so that when a first and second panel are detached from the plurality of first panels and second panels, said first and second panels are connected and are capable of being folded to form a folder sized to hold documents of the type ordinarily found in a business office, said first panel comprising an elongated tab extending at east partially along one side of said folder blank, said tab comprising a length, a width and an edge surface that extends along said length of said tab, said tab being foldable along a first fold line extending along the length of said tab and extending parallel to said one side of said folder blank, whereby when said tab is folded along said first fold line any identifying indicia which may be printed on the tab on one side of said first fold line can be seen from a front of the folder and any identifying indicia which may be printed on the tab on the other side of said first fold line can be seen from a back of the folder, said second panel including an elongated portion extending at least partially along said one side of said folder blank, said elongated portion comprising a length, a width and an edge surface that extends along said length of said elongated portion, said elongated portion being foldable along a second fold line extending along the length of said elongated portion and extending parallel to said one side of said folder blank, whereby when said elongated portion is folded along said second fold line said elongated portion reinforces at least a portion of said second panel.

2. The blank of claim 1, wherein said identifying indicia comprises a repeating pattern of a plurality of color bars.

3. The blank of claim 2, wherein said plurality of color bars comprises bars of four colors and said pattern repeats four times.

4. The blank of claim 2, wherein said folder blank has a first color and said first color forms one bar of said plurality of color bars.

5. The blank of claim 2, wherein said plurality of color bars are monochromatic.

6. A folder blank for a continuous-feed printer folder system, comprising:

a plurality of alternatingly sequentially connected first panels and second panels, said first panels being detachably connected to said second panels in pairs, so that when a first and second panel are detached from the plurality of first panels and second panels, said first and second panels are connected and are capable of being folded to form a folder sized to hold documents of the type ordinarily found in a business office, said first panel comprising an elongated tab extending at least partially along one side of said folder blank, said tab comprising a length, a width and an edge surface that extends along said length of said tab, said tab being foldable along a first fold line extending along the length of said tab and extending parallel to said one side of said folder blank, whereby when said tab is folded along said first fold line any identifying indicia which may be printed on the tab on one side of said first fold line can be seen from a front of the folder and any identifying indicia which may be printed on the tab on the other side of said first fold line can be seen from a back of the folder, said second panel including an elongated portion extending at least partially along said one side of said folder blank, said elongated portion comprising a length, a width and an edge surface that extends along said length of said elongated portion, said elongated portion being foldable along a second fold line extending along the length of said elongated portion and extending parallel to said one side of said folder blank, whereby when said elongated portion is folded along said second fold line said elongated portion reinforces at least a portion of said second panel, a first set of printer-feed elements along said one side of said folder blank; and a second set of printer-feed elements along a second side opposite said one side, so that said first and second sets of printer-feed elements may engage a feeding mechanism in a tractor-feed printer.

7. The blank of claim 6, wherein the first set of printer-feed elements comprises a first set of tractor-feed holes, and the second set of printer-feed elements comprises a second set of tractor-feed holes.

8. The blank of claim 7, wherein said first set of tractor-feed holes is disposed on a removable release liner.

9. The blank of claim 7, wherein said second set of tractor-feed holes is substantially covered by said elongated portion when said elongated portion is folded along said second fold line.

* * * * *